US010270162B2

(12) United States Patent
Ng et al.

(10) Patent No.: US 10,270,162 B2
(45) Date of Patent: Apr. 23, 2019

(54) OMNIDIRECTIONAL ANTENNAS, ANTENNA SYSTEMS, AND METHODS OF MAKING OMNIDIRECTIONAL ANTENNAS

(71) Applicant: Laird Technologies, Inc., Earth City, MO (US)

(72) Inventors: Kok Jiunn Ng, Perak (MY); En Chi Lee, Kedah (MY); Yih Jia Teoh, Pulau (MY)

(73) Assignee: LAIRD TECHNOLOGIES, INC., Chesterfield, MO (US)

( * ) Notice: Subject to any disclaimer, the term of this patent is extended or adjusted under 35 U.S.C. 154(b) by 10 days.

(21) Appl. No.: 15/703,652

(22) Filed: Sep. 13, 2017

(65) Prior Publication Data

US 2018/0090834 A1 Mar. 29, 2018

(30) Foreign Application Priority Data

Sep. 23, 2016 (MY) ..... PI2016703484
Sep. 26, 2016 (MY) ..... PI2016703513

(51) Int. Cl.
*H01Q 21/20* (2006.01)
*H01Q 1/52* (2006.01)
(Continued)

(52) U.S. Cl.
CPC ..... *H01Q 1/521* (2013.01); *H01Q 3/04* (2013.01); *H01Q 9/28* (2013.01);
(Continued)

(58) Field of Classification Search
CPC ..... H01Q 1/42; H01Q 25/005; H01Q 21/005; H01Q 21/062; H01Q 21/0006; H01Q 9/28; H01Q 3/04; H01Q 1/521
(Continued)

(56) References Cited

U.S. PATENT DOCUMENTS 4,395,685 A 7/1983 Davies et al.
6,201,510 B1 * 3/2001 Lopez ..... H01Q 9/16 343/797

(Continued)

FOREIGN PATENT DOCUMENTS

CA 2266998 C 1/2008
CN 1862879 11/2006

(Continued)

OTHER PUBLICATIONS

Aten et al.; A Wideband, Low Profile, Shorted Top Hat Monocone Antenna; IEEE Transactions on Antennas and Propagation, vol. 60, No. 10, Oct. 2012, 7 pages.

(Continued)

*Primary Examiner* — Linh V Nguyen
(74) *Attorney, Agent, or Firm* — Harness, Dickey & Pierce, P.L.C.; Anthony G. Fussner

(57) ABSTRACT

Exemplary embodiments are disclosed of antennas, antenna systems, and methods of making antennas. In an exemplary embodiment, an antenna generally includes a ground plane and first and second antennas each including a first feed. The antenna system further comprises a neutral line having first and second end portions coupled to the first feed of the respective first and second antennas, and/or one or more decoupling stubs integrally formed from and extending outwardly relative to the ground plane. In another exemplary embodiment, a method of improving isolation between first and second antennas of an antenna system generally includes coupling first and second end portions of a neutral line to a first feed of the respective first and second antennas, and/or integrally forming one or more decoupling stubs from a ground plane.

20 Claims, 43 Drawing Sheets

(51) Int. Cl.

| | |
|---|---|
| ***H01Q 25/00*** | (2006.01) |
| ***H01Q 21/06*** | (2006.01) |
| ***H01Q 21/00*** | (2006.01) |
| ***H01Q 3/04*** | (2006.01) |
| ***H01Q 9/28*** | (2006.01) |
| *H01Q 1/42* | (2006.01) |

(52) U.S. Cl.
CPC ..... *H01Q 21/0006* (2013.01); *H01Q 21/062* (2013.01); *H01Q 21/205* (2013.01); *H01Q 25/005* (2013.01); *H01Q 1/42* (2013.01)

(58) Field of Classification Search
USPC ..... 343/793, 797, 798, 799, 801, 802, 803, 343/805, 807, 822
See application file for complete search history.

(56) References Cited

U.S. PATENT DOCUMENTS

| | | | | |
|---|---|---|---|---|
| 7,688,275 | B2 * | 3/2010 | Montgomery | H01Q 1/243 343/820 |
| 8,184,060 | B2 | 5/2012 | Du et al. | |
| 8,421,700 | B2 | 4/2013 | Sanford | |
| 8,698,675 | B2 | 4/2014 | Shtrom et al. | |
| 9,673,536 | B2 | 6/2017 | Ng et al. | |
| 2005/0030232 | A1 * | 2/2005 | Monebhurrun | H01Q 9/16 343/702 |
| 2006/0164307 | A1 | 7/2006 | Smith et al. | |
| 2007/0202912 | A1 | 8/2007 | Wu | |
| 2008/0320156 | A1 | 12/2008 | Chen et al. | |
| 2009/0267856 | A1 * | 10/2009 | Schadler | H01Q 1/246 343/797 |
| 2010/0289705 | A1 * | 11/2010 | Shtrom | H01Q 9/0442 343/702 |
| 2011/0030015 | A1 | 2/2011 | King et al. | |
| 2012/0013519 | A1 | 1/2012 | Hakansson et al. | |
| 2012/0068892 | A1 * | 3/2012 | Shtrom | H01Q 9/26 343/702 |
| 2012/0127038 | A1 * | 5/2012 | Kim | H01Q 1/243 343/700 MS |
| 2012/0169560 | A1 | 7/2012 | Lee et al. | |
| 2012/0319919 | A1 * | 12/2012 | Kirovski | H01Q 1/243 343/853 |
| 2013/0088402 | A1 | 4/2013 | Lindmark et al. | |
| 2013/0093641 | A1 * | 4/2013 | Ng | H01Q 1/521 343/841 |
| 2013/0135168 | A1 | 5/2013 | Kim et al. | |
| 2014/0035698 | A1 * | 2/2014 | Schadler | H01P 1/184 333/128 |
| 2015/0263434 | A1 * | 9/2015 | Bench | H01Q 21/24 342/357.51 |
| 2016/0233590 | A1 | 8/2016 | Ng et al. | |
| 2016/0294063 | A1 * | 10/2016 | McGough | H01Q 9/28 |
| 2017/0054198 | A1 * | 2/2017 | Le | H01Q 1/243 |
| 2017/0358841 | A1 * | 12/2017 | Chen | H01B 3/30 |

FOREIGN PATENT DOCUMENTS

| | | |
|---|---|---|
| CN | 201360040 Y | 12/2009 |
| CN | 201859942 | 6/2011 |
| DE | 102005030631 B3 | 1/2007 |

OTHER PUBLICATIONS

Chen et al., Super wideband characteristics of monopolar patch antenna; The Journal of Engineering; Received on Oct. 23, 2013; Accepted on Nov. 4, 2013, 3 pages.

SQUINTTM Single Port Multiband, Multimode Ceiling Mount Antenna, 1999, 3 pages.

Yang, et al., Multiband MIMO Antenna for GSM, DCS and LTE Indoor Applications, 1536-1225(c) 2015, IEEE, http://www.lee.org/publications_standards/publications/rights/index.html, 4 pages.

Chen, et al., MIMO Antenna with Enhanced Isolation Elements for USB Dongle Applications, 2012 Cross Straight Quad-Regional Radio Science and Wireless Technology Conference, IEEE, 4 pages.

Lin, et al., Miniaturized Dual-Layers LTE MIMO Printed antenna with Hybrid Decouplling Elements to Improve Isolation, 2015 by IEICE, Department of Electronic Engineering, National Taipei University of Technology, 4 pages.

* cited by examiner 2.3 GHz 2.5 GHz 2.7 GHz

4.9 GHz

5.5 GHz 5.875 GHz

OMNIDIRECTIONAL ANTENNAS, ANTENNA SYSTEMS, AND METHODS OF MAKING OMNIDIRECTIONAL ANTENNAS

CROSS-REFERENCE TO RELATED APPLICATIONS

This application claims the benefit of and priority to Malaysian Patent Application No. PI 2016703513 filed Sep. 26, 2016. This application also claims the benefit of and priority to Malaysian Patent Application No. PI 2016703484 filed Sep. 23, 2016. The entire disclosures of the above applications are incorporated herein by reference.

FIELD

The present disclosure generally relates to antennas, antenna systems, and methods of making antennas.

BACKGROUND

This section provides background information related to the present disclosure which is not necessarily prior art.

Omnidirectional antennas are useful for a variety of wireless communication devices because the radiation pattern allows for good transmission and reception from a mobile unit. Generally, an omnidirectional antenna is an antenna that radiates power generally uniformly in one plane with a directive pattern shape in a perpendicular plane, where the pattern is often described as "donut shaped." Sometimes, omnidirectional antennas may be installed indoors, such as mounted to a ceiling, and may be part of a distributed antenna system (DAS).

DRAWINGS

The drawings described herein are for illustrative purposes only of selected embodiments and not all possible implementations, and are not intended to limit the scope of the present disclosure.

FIG. 1 is a perspective view of an antenna according to an exemplary embodiment, and also showing a ground plane and a feed electrically coupled to a feed point of the antenna;

FIG. 2 is a perspective view of an omnidirectional multiple-input multiple-output (MIMO) multiband/broadband antenna system according to an exemplary embodiment, where the antenna system includes four of the antennas shown in FIG. 1, four separate ground plane portions or sectors, and four separate feeds where each feed is shown electrically coupled to the feed point of a different one of the four antennas;

Figure 2:
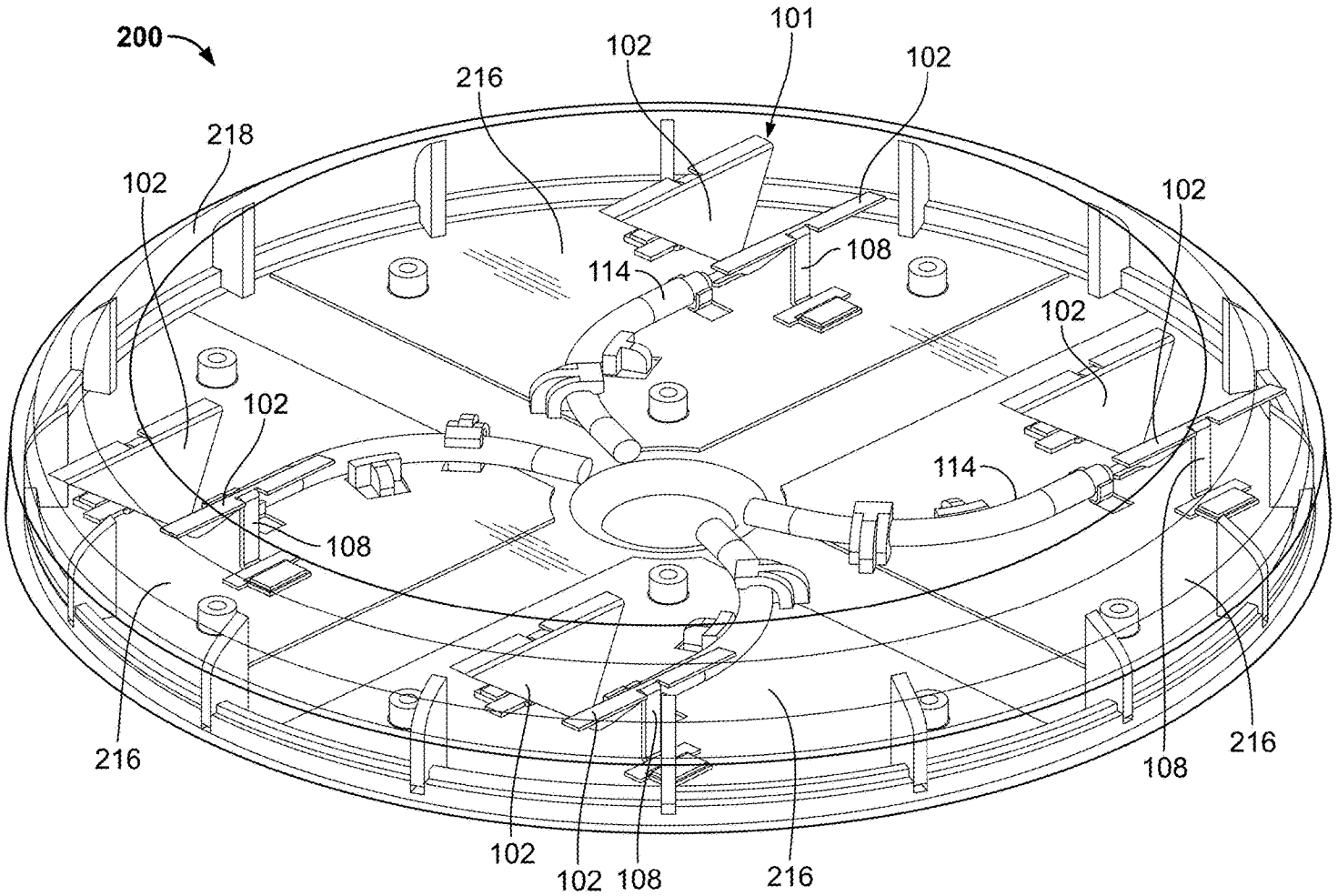
Figure 18:
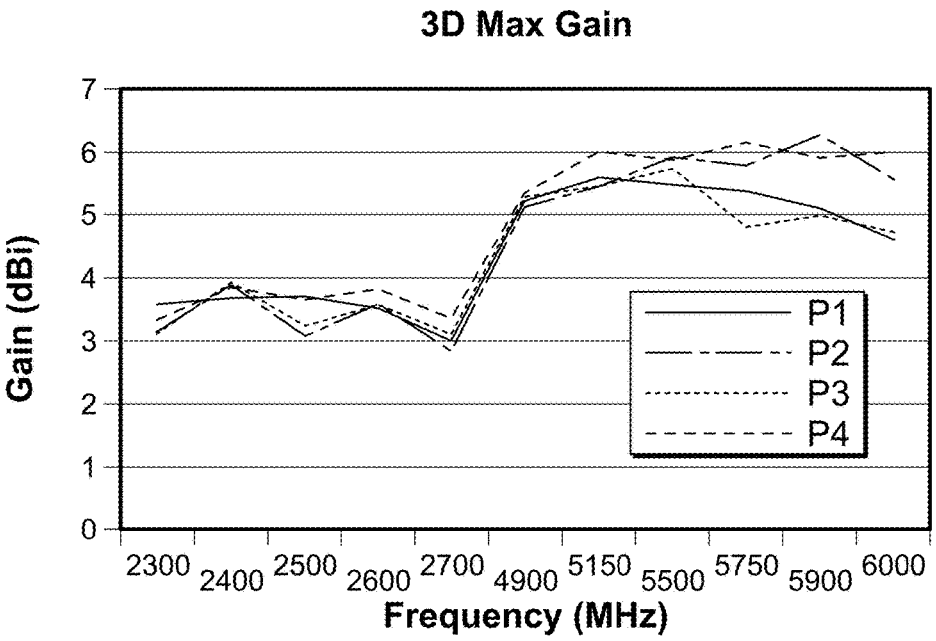
Figure 19:
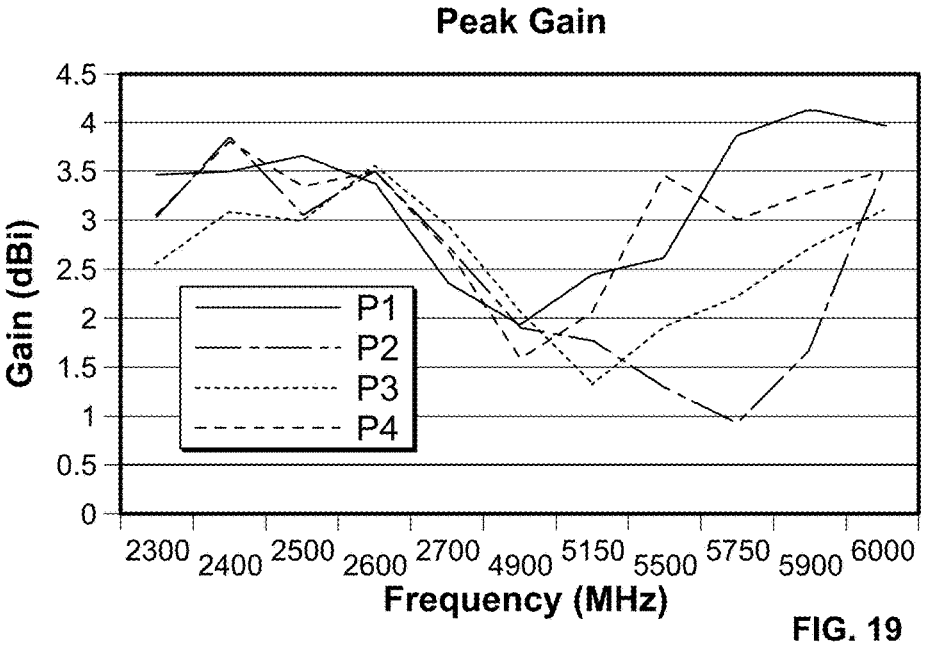
Figure 20:
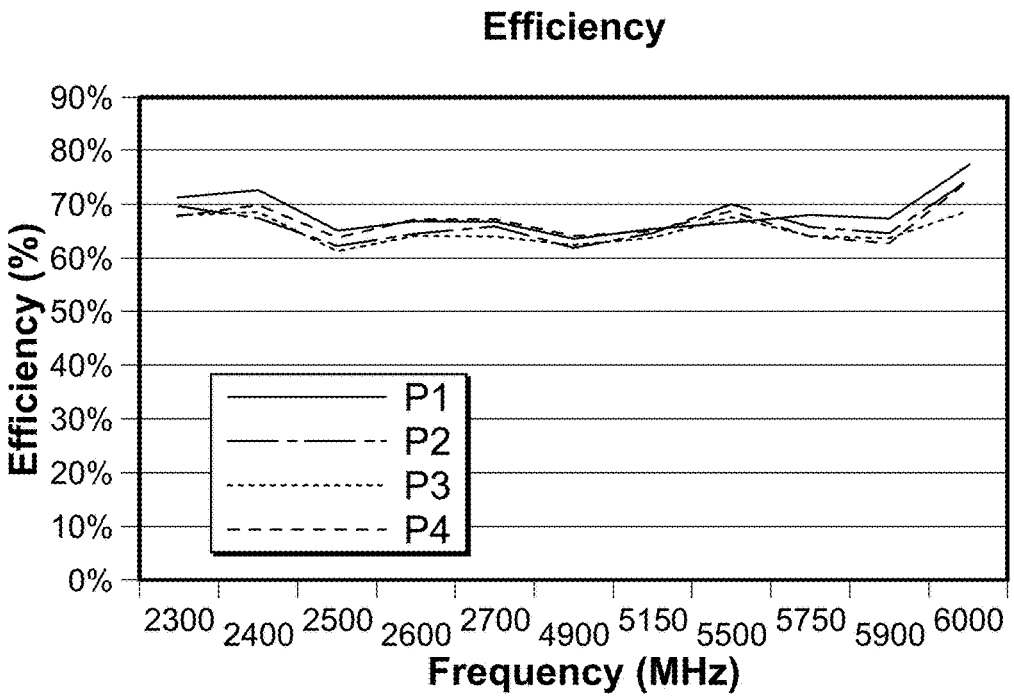
Figure 21:
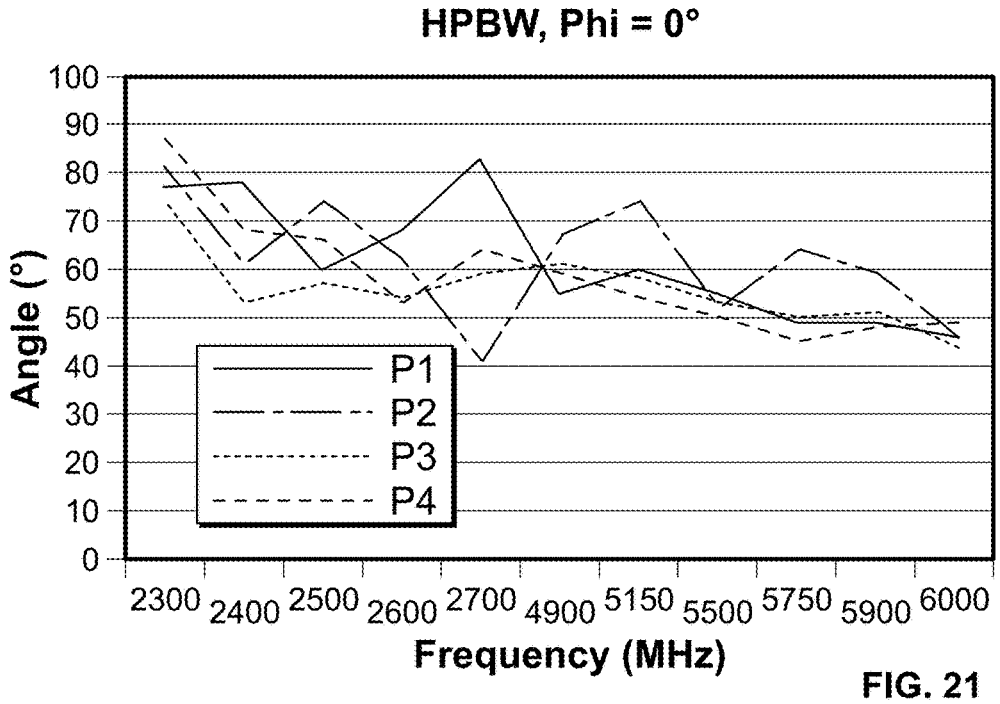
Figure 22:
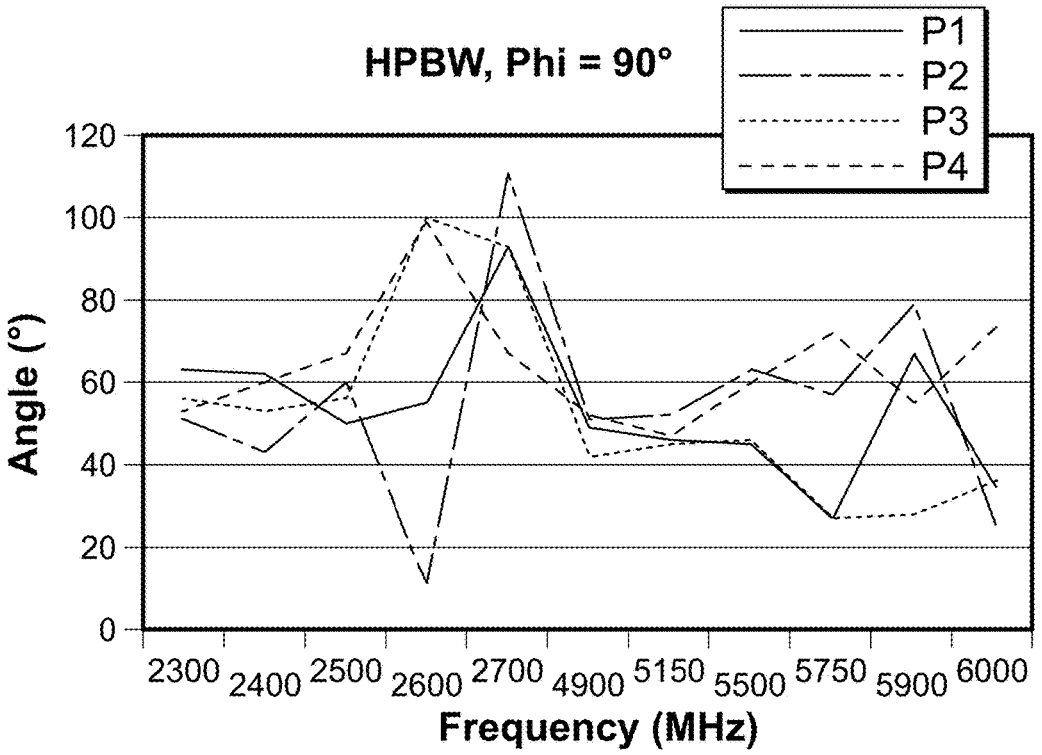
Figure 23:
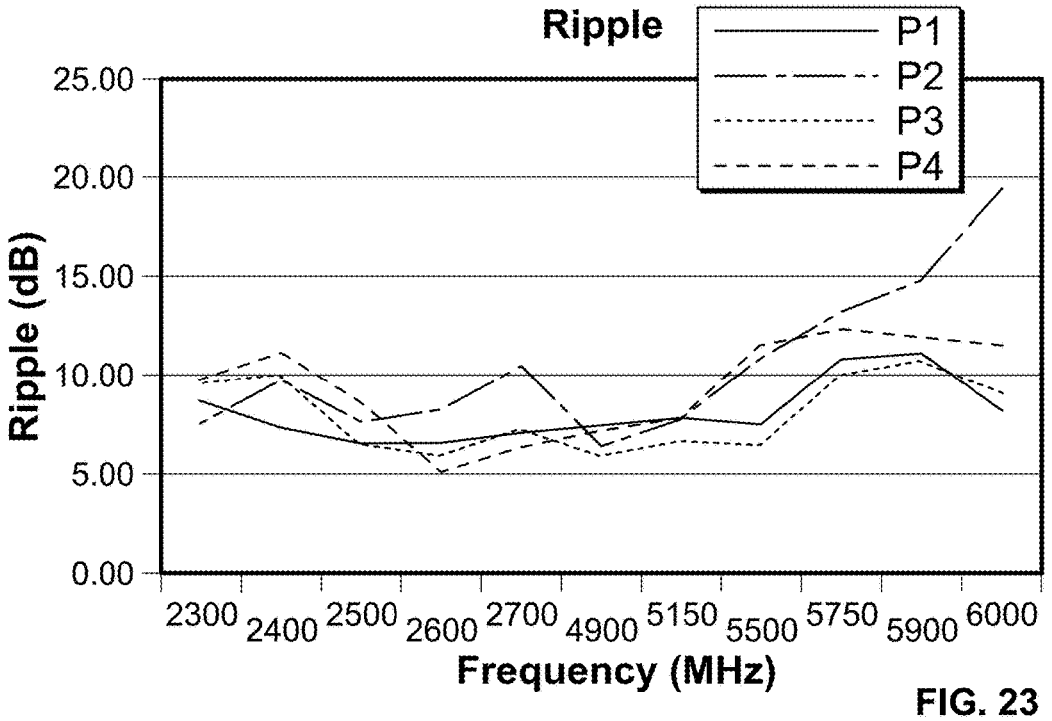
Figure 24:
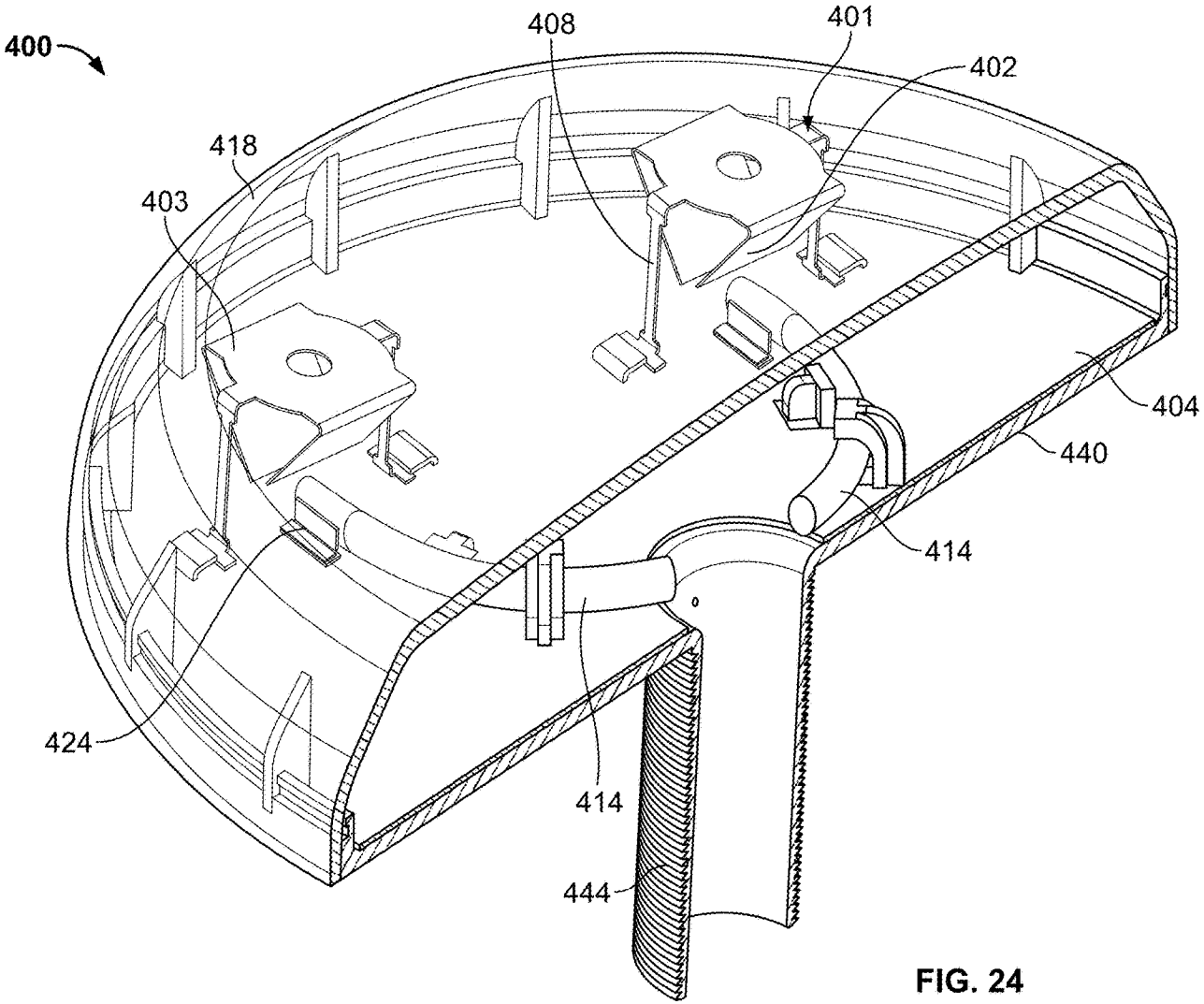
Figure 25:
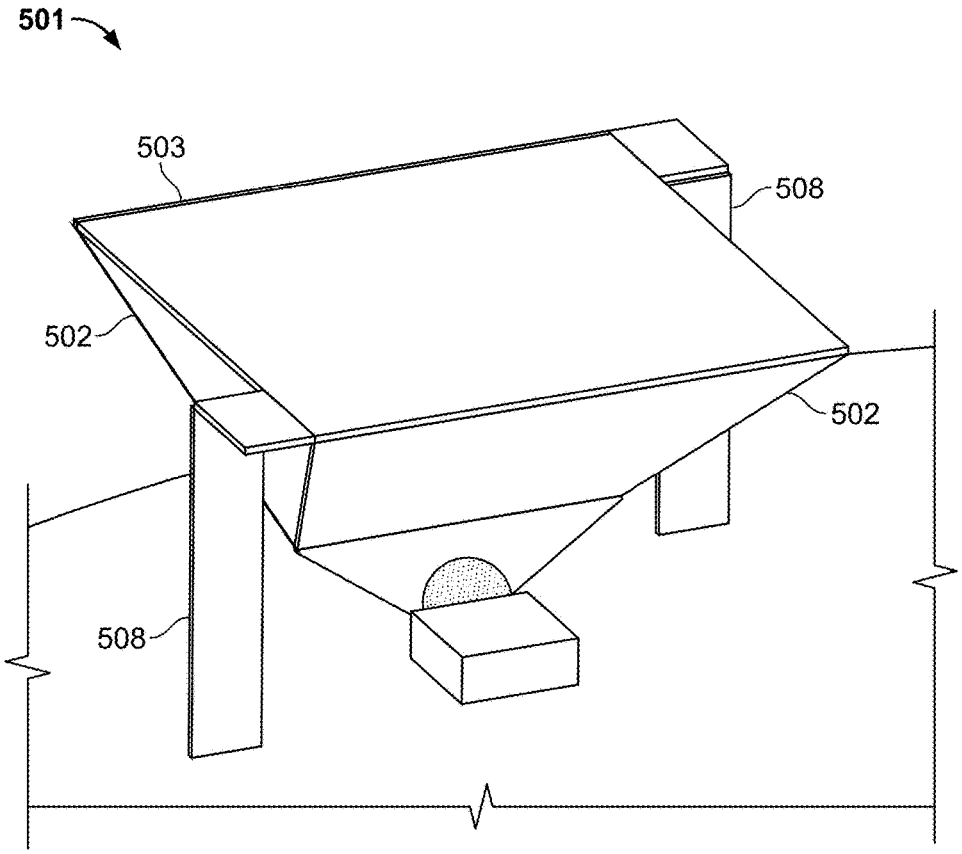
Figure 26:
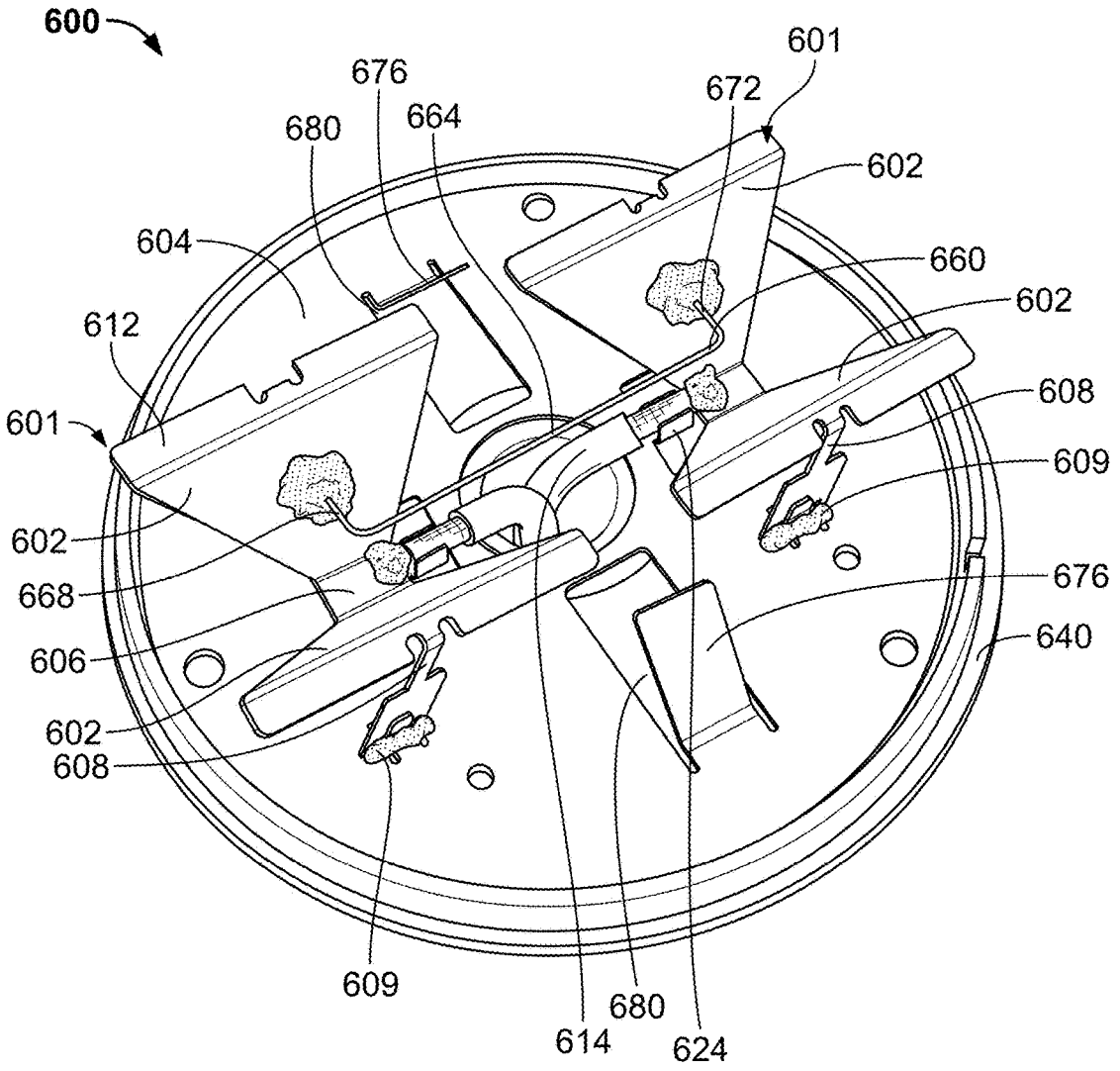
Figure 27:
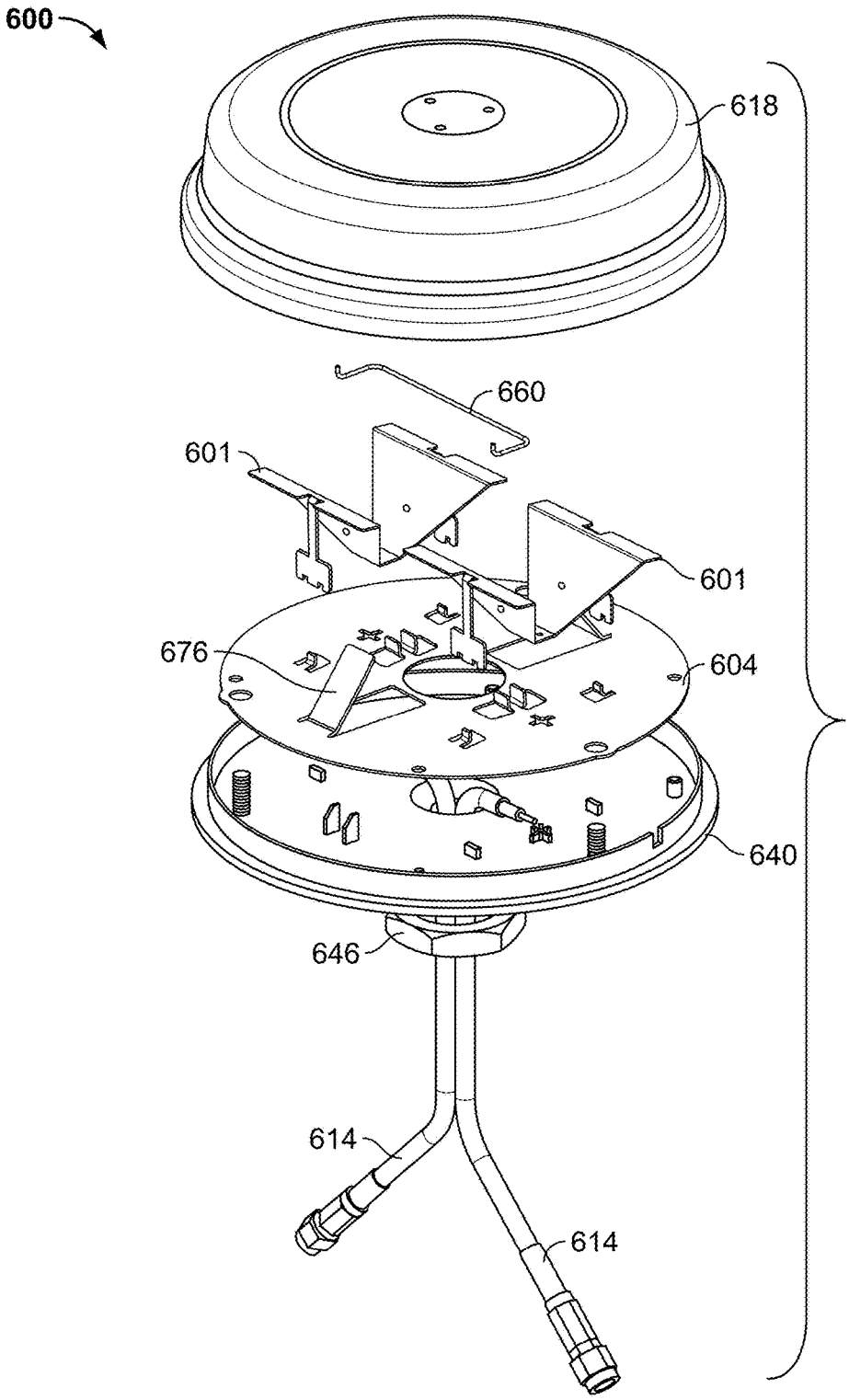
Figure 28:
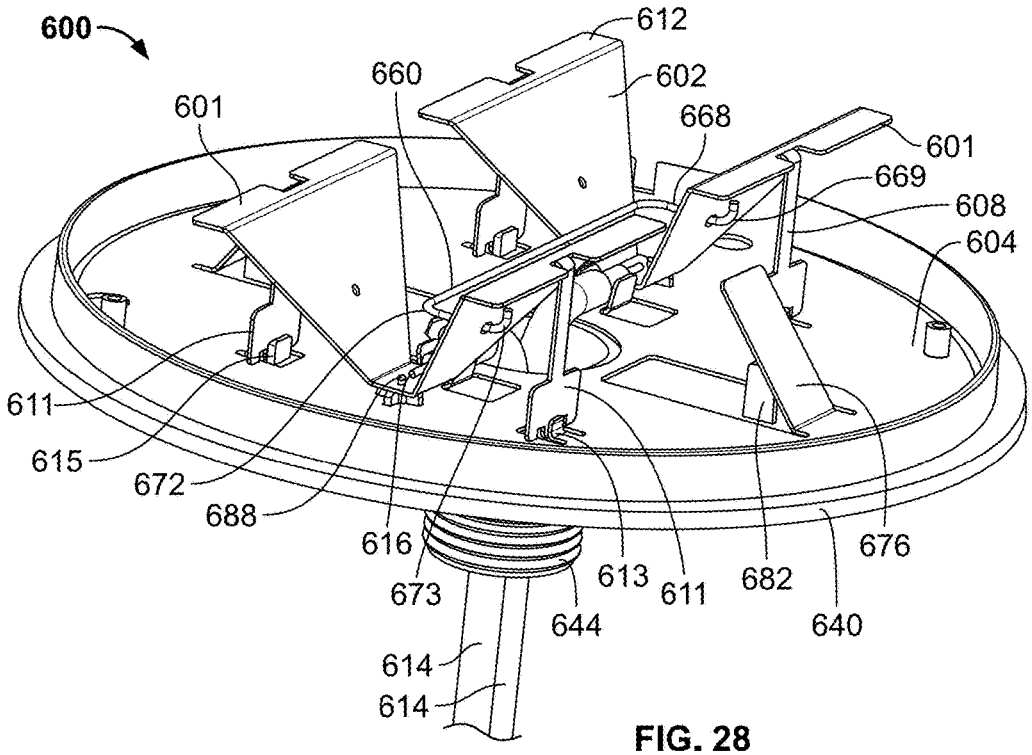
Figure 29:
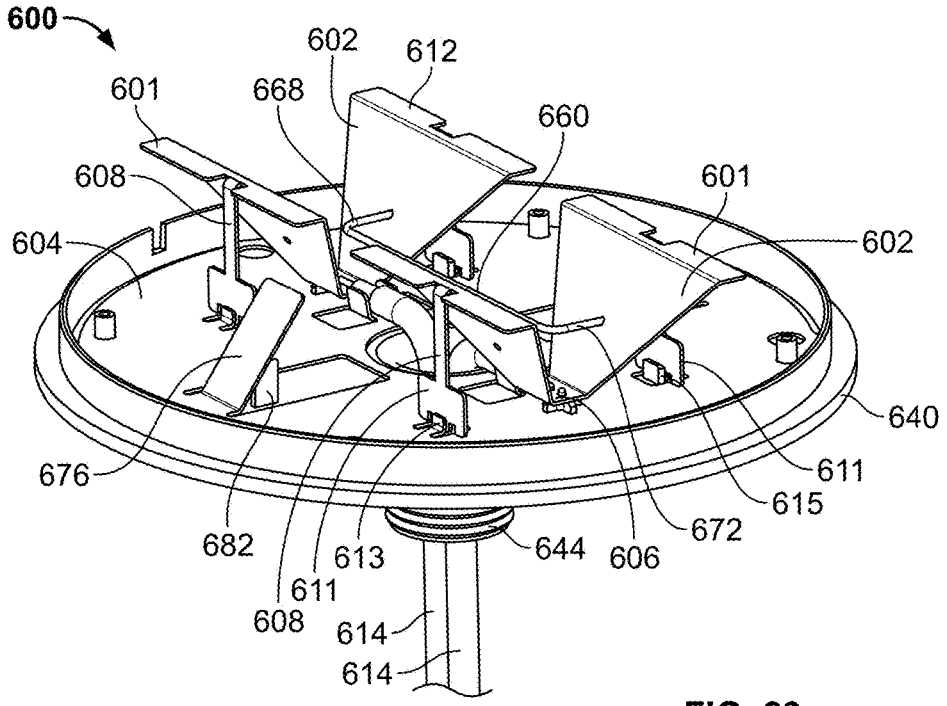
Figure 30:
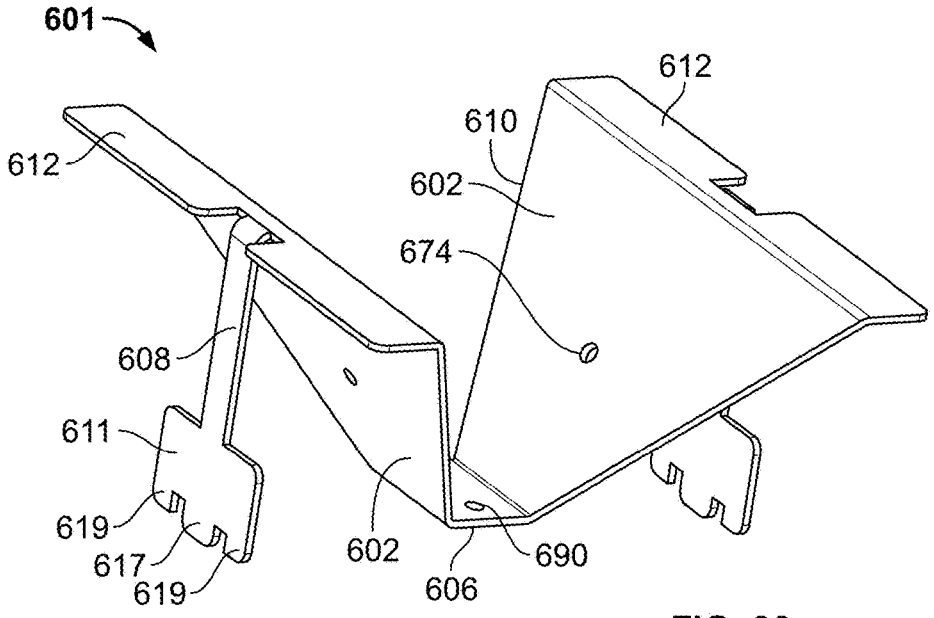
Figure 31:
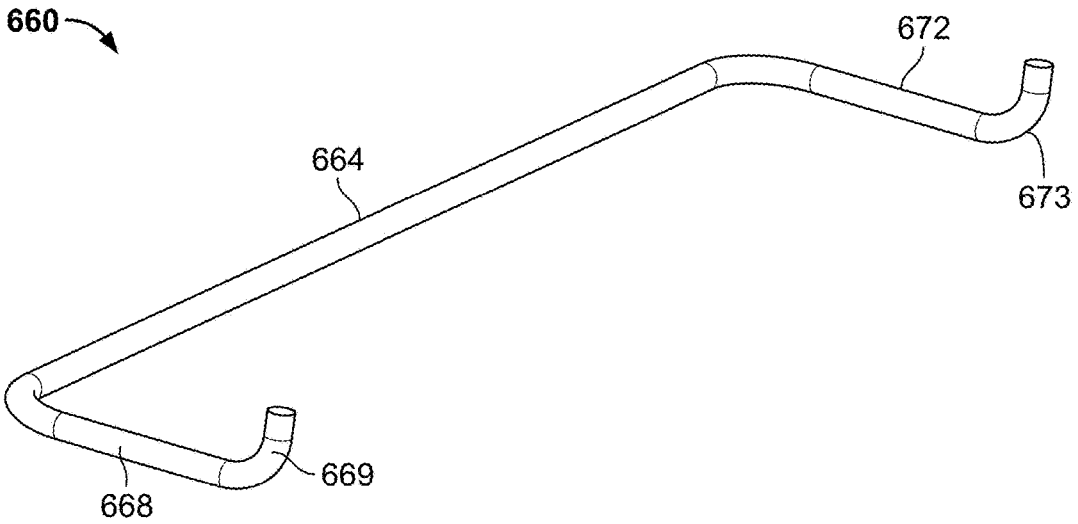
Figure 32:
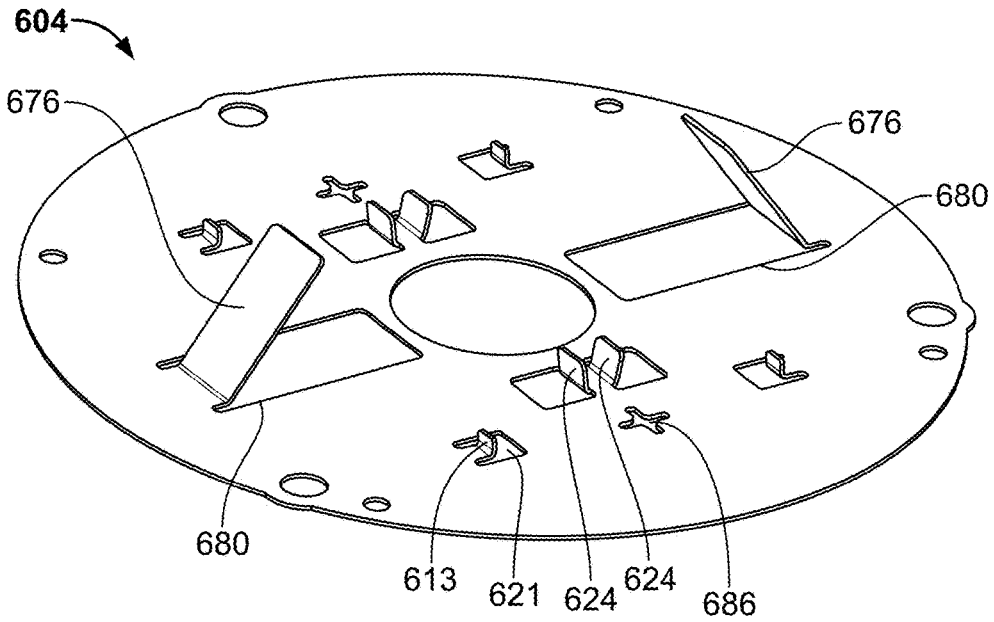
Figure 33:
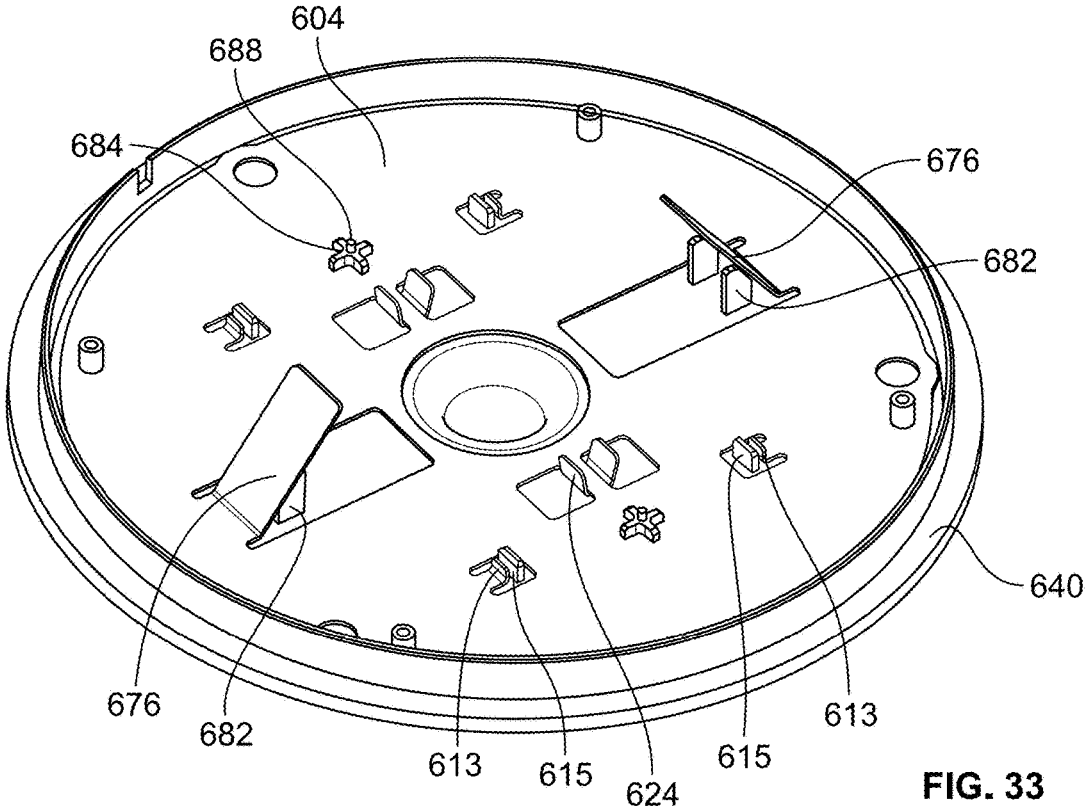
Figures 34, 35:
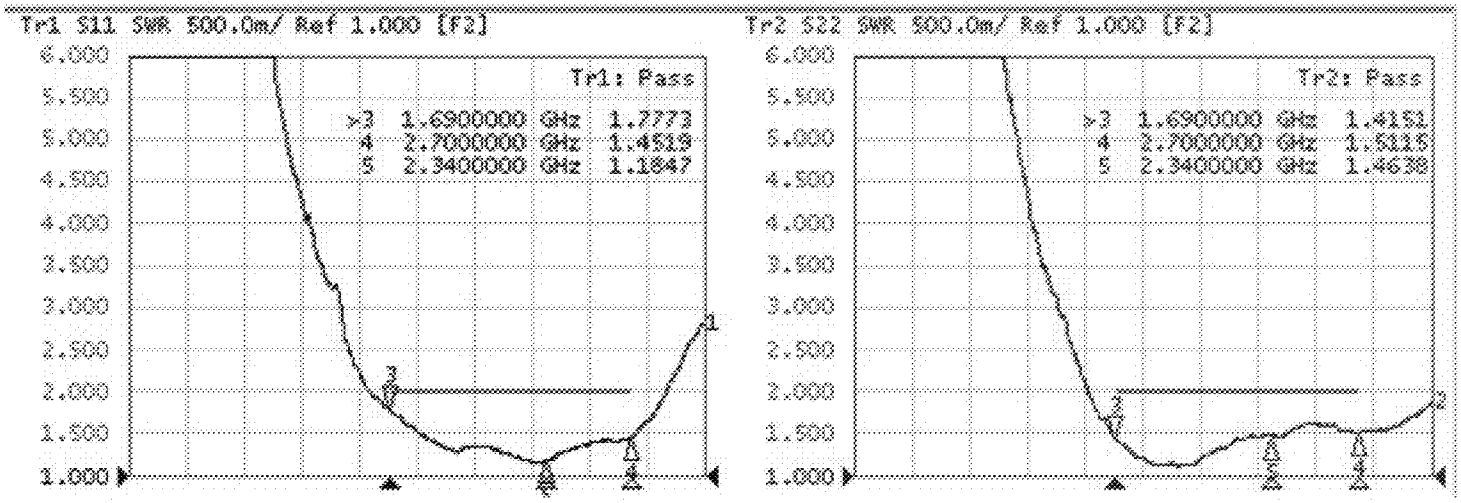
Figure 36:
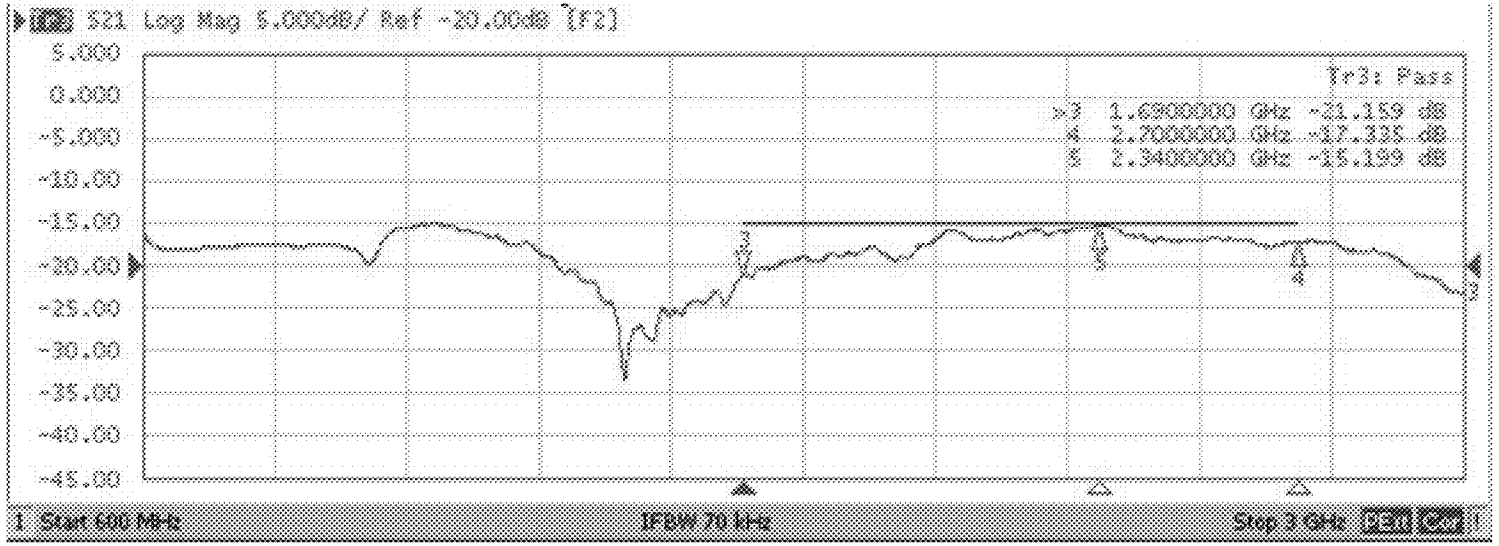
Figure 37:
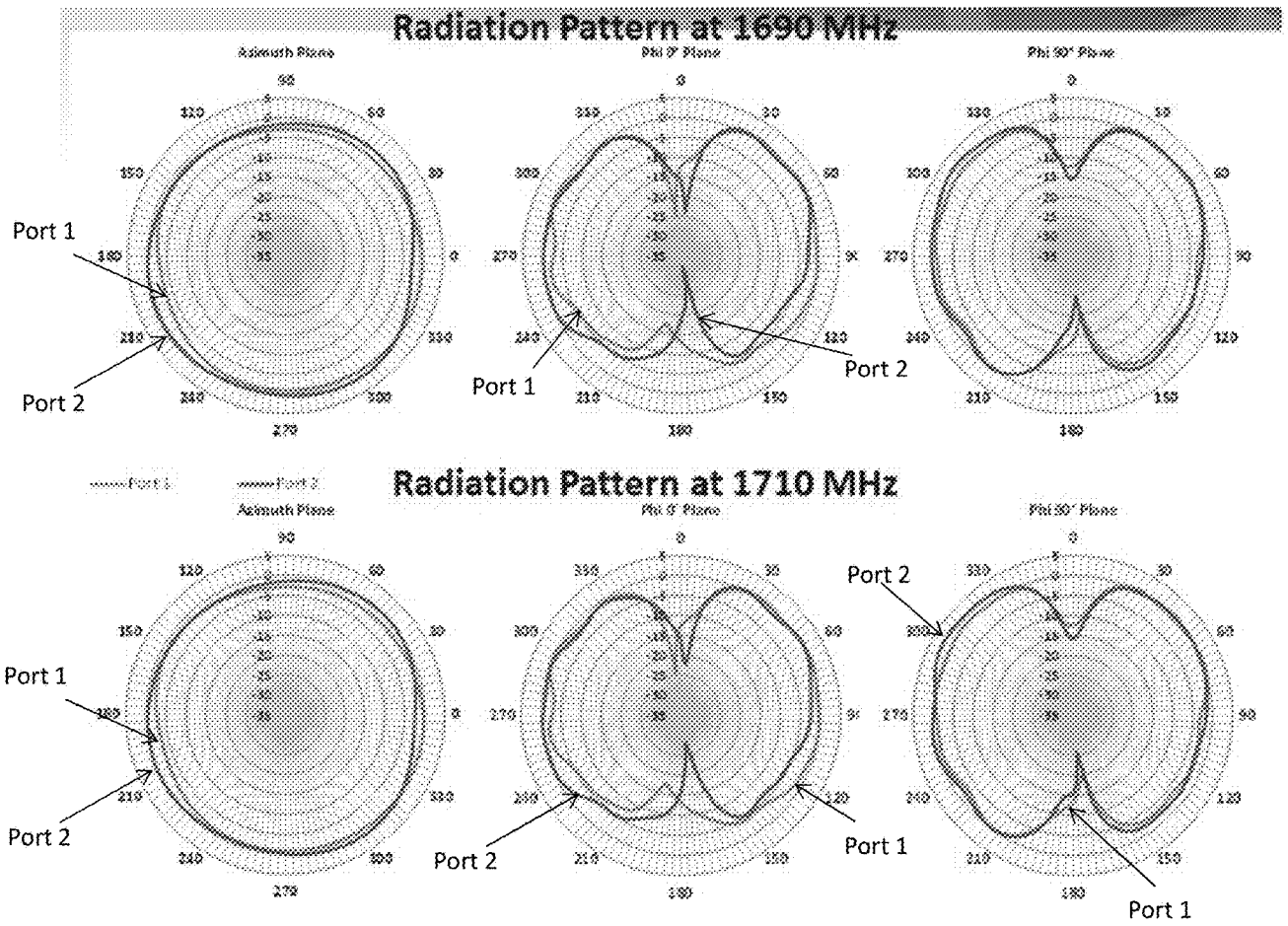
Figure 38:
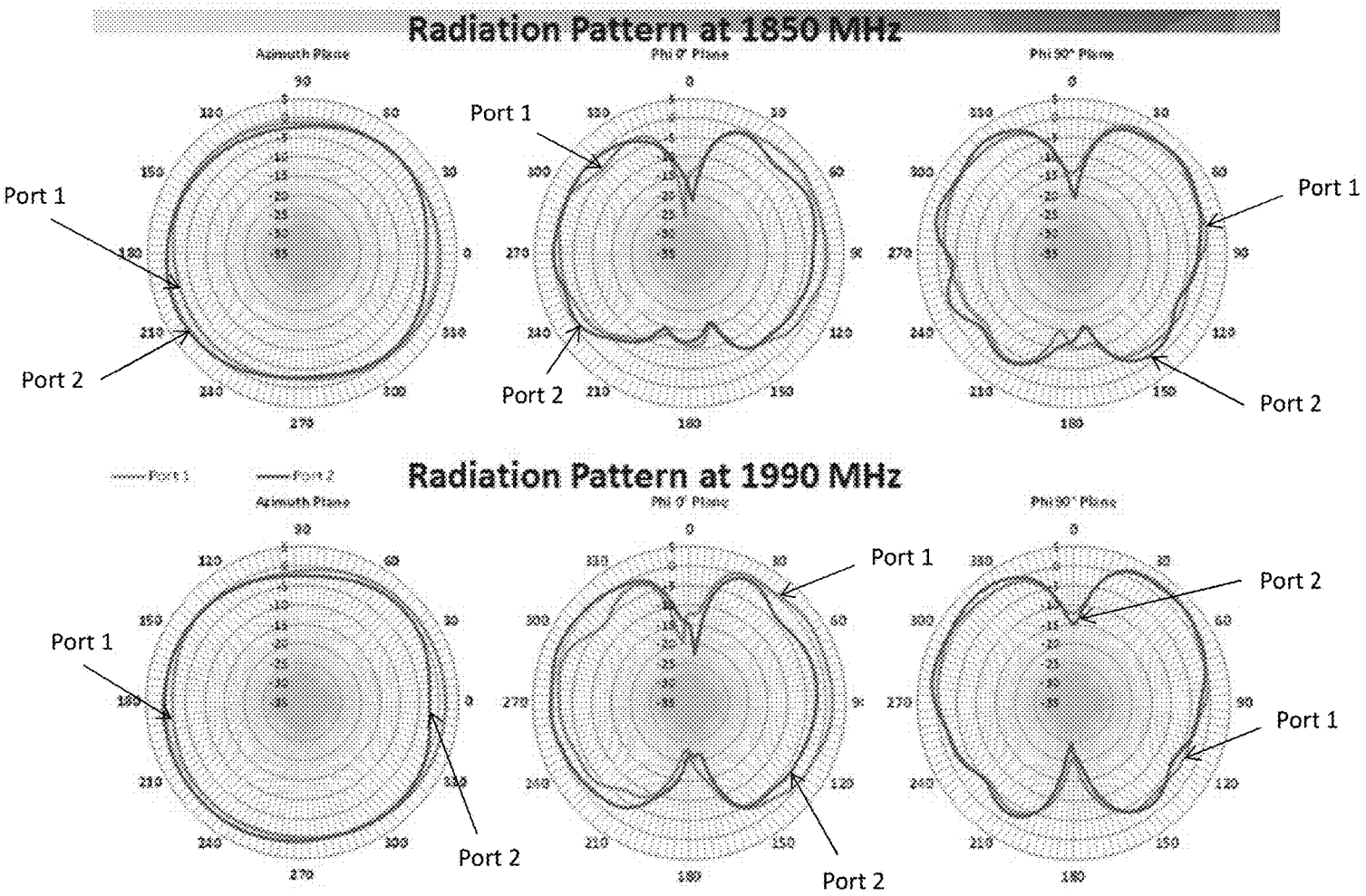
Figure 39:
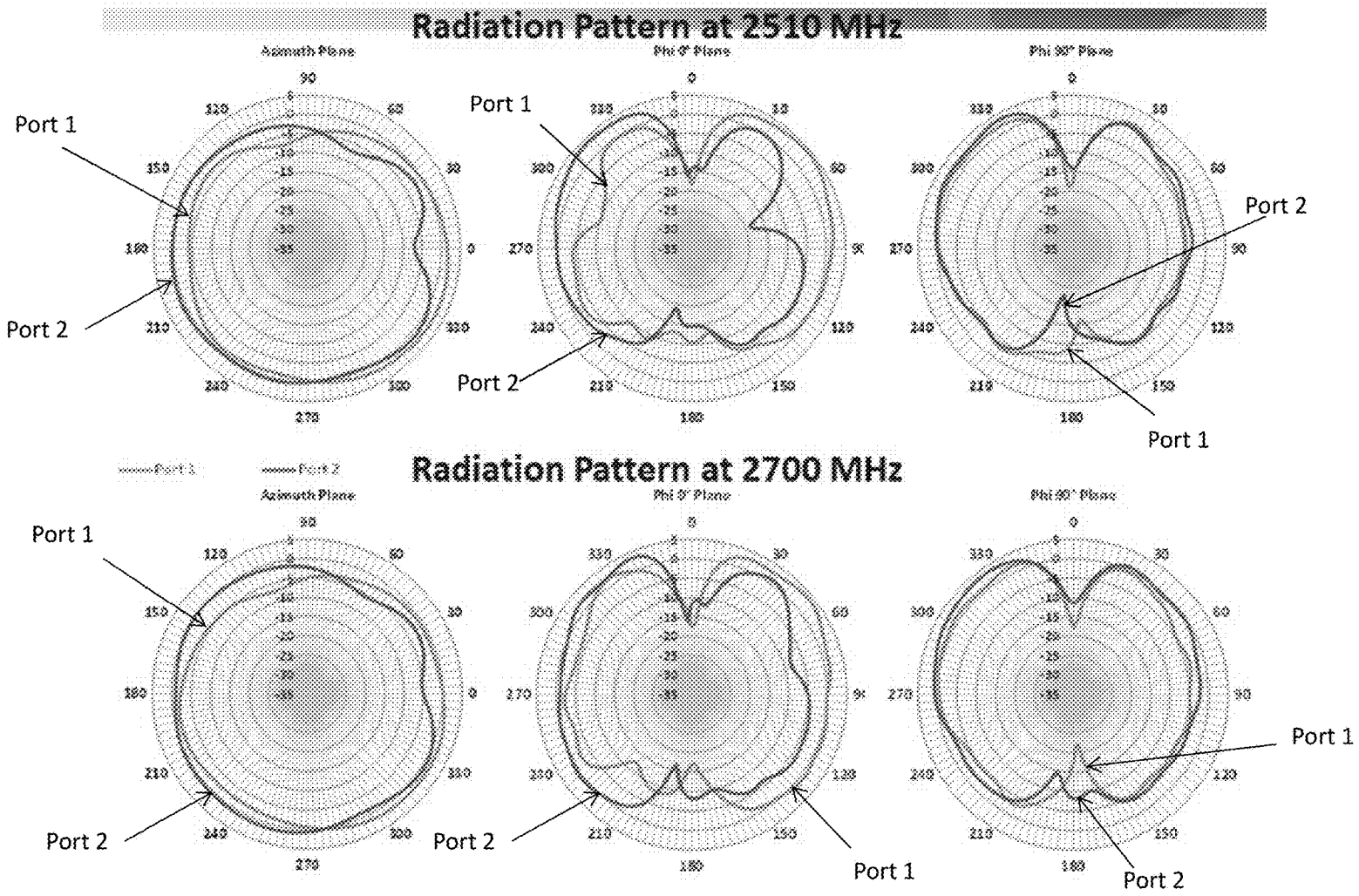

FIGS. 14A-D to 17A-D illustrate radiation patterns measured for each antenna of a prototype of the exemplary antenna system of FIG. 2 at frequencies of 2400 MHz, 2500 MHz, 5150 MHz, and 5750 MHz;

FIG. 18 is an exemplary line graph illustrating 3D maximum gain in decibels isotropic (dBi) versus frequency (MHz) measured for each of the four antennas of a prototype of the exemplary antenna system of FIG. 2;

FIG. 19 is an exemplary line graph illustrating peak gain (dBi) versus frequency (MHz) measured for each of the four antennas of a prototype of the exemplary antenna system of FIG. 2;

FIG. 20 is an exemplary line graph illustrating efficiency (%) versus frequency (MHz) measured for each of the four antennas of a prototype of the exemplary antenna system of FIG. 2;

FIG. 21 is an exemplary line graph of half-power beamwidth (HPBW) at Phi=0° illustrating angle (°) versus frequency (MHz) measured for each of the four antennas of a prototype of the exemplary antenna system of FIG. 2;

FIG. 22 is an exemplary line graph of HPBW at Phi=90° illustrating (°) versus frequency (MHz) measured for each of the four antennas of a prototype of the exemplary antenna system of FIG. 2;

FIG. 23 is an exemplary line graph illustrating ripple (dBi) versus frequency (MHz) measured for each of the four antennas of a prototype of the exemplary antenna system of FIG. 2;

FIG. 24 is a partial perspective view of an omnidirectional MIMO multiband/broadband antenna system according to another exemplary embodiment;

FIG. 25 is a perspective view of an antenna according to another exemplary embodiment;

FIG. 26 shows a prototype of an omnidirectional multiple-input multiple-output (MIMO) multiband/broadband antenna system according to an exemplary embodiment, where the antenna system includes a neutral line and a ground plane with integrally formed slanted decoupling stubs;

FIG. 27 is an exploded perspective view of the omnidirectional multiple-input multiple-output (MIMO) multiband/broadband antenna system shown in FIG. 26, and further illustrating an exemplary radome;

FIGS. 28 and 29 are perspective views showing the antennas, ground plane, and base of the antenna system shown in FIG. 27;

FIG. 30 is a perspective view of one of the two antennas of the antenna system shown in FIGS. 27 through 29;

FIG. 31 is a perspective view of the neutral line of the antenna system shown in FIGS. 27 through 29;

FIG. 32 is a perspective view of the ground plane of the antenna system shown in FIGS. 27 through 29;

FIG. 33 is a perspective view of the ground plane and the base of the antenna system shown in FIGS. 27 through 29;

FIGS. 34 and 35 are exemplary line graphs illustrating voltage standing wave ratio (VSWR) versus frequency measured for the two ports S11, S22, respectively, of the exemplary antenna system of FIG. 26;

FIG. 36 is an exemplary line graph illustrating port to port isolation (S21) in decibels (dB)) versus frequency (MHz) measured for the exemplary antenna system of FIG. 26; and FIGS. 37, 38, and 39 illustrate radiation patterns (Azimuth Plane, Phi 0° Plane, Phi 90° Plane) measured for Port 1 and Port 2 of the exemplary antenna system shown in FIG. 26 at frequencies of 1690 MHz, 1710, MHz, 1850 MHz, 1990 MHz, 2510 MHz, and 2700 MHz.

Corresponding reference numerals indicate corresponding parts throughout the several views of the drawings.

DETAILED DESCRIPTION

Example embodiments will now be described more fully with reference to the accompanying drawings.

Omnidirectional antennas can be built with inverted cones, shorted inverted cones, etc., which can provide very good omnidirectional radiation over a broad frequency band. A monopole cone antenna may not be self-supporting and may need other mechanical structure(s) to hold a radiator in place, and a shorted monopole may provide an advantage. Inverted cone antennas may require a complicated process to construct, and may be more expensive. Some monopole cone antennas (e.g., sheet metal, etc.) may need additional processes to join different parts together, and some simpler constructions involving stamping parts may not be able to provide similar performance to inverted shorted cone antennas.

Accordingly, disclosed herein are exemplary embodiments of antennas that produce radiation patterns similar to inverted cone antennas, but may be constructed using a single sheet of stamped parts. For example, antennas may include tapering feeds configured similarly to inverted cone antennas with capability of enabling broadband characteristics to the antenna. Some exemplary antennas disclosed herein may have a simpler construction as compared to existing inverted cone antenna structures.

In some exemplary embodiments, a tapering angle of one or more feeds may be approximately linear, multi-step, curved, etc., and may depend on how optimization is performed. With the tapering or gradual dimension change (gradual increase or decrease in width), the antenna may have a gradual change of impedance that allows the antenna to achieve very wide bandwidth. Some embodiments may include one or more shorting legs or elements, with each shorting leg providing sufficient mechanical support such that the antenna is self-supporting and with a shorting height that provides good omnidirectional radiation and/or a low profile. In addition to providing mechanical support, the shorting legs also provide DC (direct current) short for the antenna to reduce or minimize of ESD (electrostatic discharge) effect. The shorting legs may also allow for a reduction in the overall size of the antenna. Some embodiments may not require separate shorting legs, as the shorting legs may instead be integral to the antenna. For example, exemplary embodiments may include a single-piece antenna element having triangular and/or step-shaped and/or tapering feeds or features, shorting legs, and a feed point that are all integrally or monolithically formed from (e.g., via stamping and folding, etc.) a single piece of electrically-conductive material. For example, a single-piece antenna may have one or more triangular feeds having a width that tapers or decreases in a direction toward a feed point. Or, for example, a single-piece antenna may have one or more feeds that are step-shaped, have a stepped configuration, and/or include or define one or more steps.

An antenna or radiator may be fed via a side feed, a bottom of a ground plane, etc., and may depend on the application, industrial design, etc. of the antenna system. In some configurations, an extended ground plane may be used near a feed to optimize higher band matching, radiation patterns, etc. Example antennas or antenna systems may be operable within desired frequency ranges, including about 2300 megahertz to about 2700 megahertz, about 4900 megahertz to about 5875 megahertz, etc.

Multiple antennas or radiators may be placed on a single ground plane, separate ground planes, etc., and may be used in a multiple-input multiple-output (MIMO) application. Separate ground planes may provide an advantage of better omnidirectionality of the antenna system and/or may prevent any excessive high gain which may otherwise make the antenna system unable to meet requirements of peak gain, etc. The antennas may be arranged symmetrically, which may help optimize or improve the antenna system for omnidirectionality and/or isolation between ports.

In some exemplary embodiments, an antenna system may include a neutral line placed horizontally or in horizon to improve isolation and minimize (or at least reduce) impact to the radiation pattern and a slanted decoupling stub (e.g., stamped, integrally formed, etc.) from the ground to improve isolation. In such exemplary embodiments, the addition of the neutral line and slanted decoupling stub from the ground may improve isolation where a conventional split ground plane or rotating radiators may not be sufficient to meet the isolation specification of the antenna in a very compact radome. This improved isolation may be achievable with minimal impact to the radiation pattern.

Figure 1:
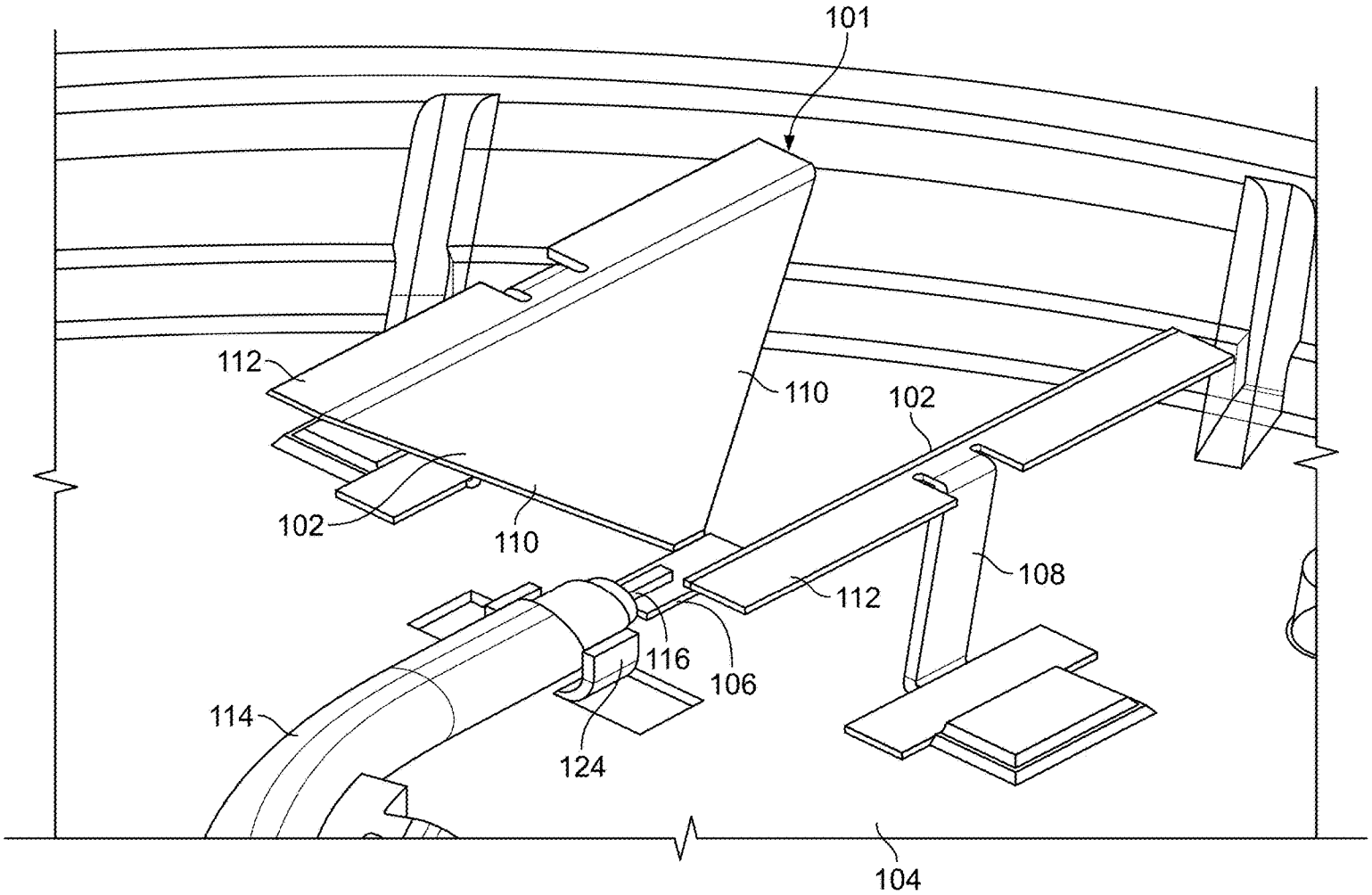

Referring now to the figures, FIG. 1 illustrates an example antenna 101 (e.g., a radiating antenna element or radiator, etc.) embodying one or more aspects of the present disclosure. The antenna 101 includes first and second feeds 102. A feed point 106 is between and connected to the feeds 102. The feeds 102 are generally triangular and/or tapering such that a width of each feed 102 reduces or tapers in a direction towards the feed point 106. Accordingly, each feed 102 is narrowest at or adjacent the feed point 106. With the tapering or gradual change in width, the antenna 101 may have a gradual change of impedance that allows the antenna 101 to achieve very wide bandwidth.

The antenna 101 includes first and second shorting legs or elements 108 for mechanical support and for electrically coupling (e.g., via direct galvanic contact, etc.) the antenna 101 to a ground plane 104. The first and second shorting legs 108 depend or extend from (e.g., are integrally connected to, etc.) the first and second feeds 102, respectively (e.g., at about a middle top portion of the feed 102, etc.) to thereby electrically couple the feeds 102 to the ground plane 104. In addition to providing mechanical support, the shorting legs 108 may also provide DC (direct current) short for the antenna 101 to reduce or minimize of ESD (electrostatic discharge) effect. The shorting legs 108 may also allow for a reduction in the overall size of the antenna 101.

As shown in FIG. 1, the first and second feeds 102 generally oppose and/or are opposite each other. The antenna 101 includes first and second opposing openings or open sides (or non-existent sides) adjacent and defined between the first and second feeds 102. The feeds 102 define the two open sides such that the two open sides also have triangular and/or tapering shapes identical to or similar to the feeds 102. Accordingly, the feeds 102 define or provide the antenna 101 with a shape resembling a partial (e.g., interrupted, etc.) rectangular pyramid or cone shape. The antenna 101 includes two solid sides defined by the first and second feeds 102 and two open or nonexistent sides. By way of example, the first and second feeds 102 may resemble or be shaped like butterfly wings as shown in FIG. 1. Or, for example, the feeds 102 may define a V-shaped channel that is open on both ends.

The antenna 101 may mimic or simulate an inverted cone without having a full cone shape (due to the two sides that are open or missing). This may allow the antenna 101 to simulate an inverted cone antenna in its radiation pattern, frequency, etc., while having a simpler construction.

The antenna 101 may be stamped from a suitable material (e.g., metal, other electrically-conductive material, etc.) in a defined shape, and then folded to form the opposing triangular tapering feeds 102. For example, an antenna may be stamped from a substantially flat sheet (e.g., sheet metal, etc.) with points of triangular tapering feeds 102 separated by a small strip, joint, feed point, etc. The triangular tapering feeds 102 can then be folded upwards to a desired angle (e.g., non-perpendicular with a ground plane, non-parallel with each other, etc.). This may allow for a simpler construction as compared to other inverted cone antennas that may require welding of different components, drawing of the antenna structure, etc. Accordingly, some embodiments of the present disclosure may not require any welding or drawing to form the antenna.

Each triangular tapering feed 102 may include slanted opposing edge portions 110, such that the width of the tapering feed 102 is narrowest at an end of the feed 102 adjacent the feed point 106 and widest at an end of the tapering feed 102 farthest from the feed point 106. The tapering of the side edge portions 110 may be slanted or angled inwardly toward the middle. Stated differently, the side edge portions 110 of the feeds 102 are slanted or angled inwardly toward each other along these edge portions 110 in a direction from a top of the feeds 102 toward the ground plane 104. Accordingly, the upper portion of each feed 102 decreases in width due to the tapering features or inwardly angled upper side edge portions 110. The tapering may be an inward slant at any suitable angle, which may be more or less than the angle illustrated in FIG. 1. As used herein, triangular includes a tapering feed having three different sides. Although FIG. 1 illustrates triangular tapering feeds 102 having a specific shape, other embodiments may include tapering feeds having different shapes (e.g., different angles between sides, different lengths of sides, etc.).

Each triangular tapering feed 102 may include a wing portion 112, which may be disposed at a top of the triangular tapering feed 102. The wing portion 112 may be an extension of the triangular tapering feed 102 that is bent or folded to form an angle (e.g., right angle, etc.) with the triangular tapering feed 102. Accordingly, the wing portion 112 may be integral or have a monolithic one-piece construction with the triangular tapering feed 102. In exemplary embodiments, the total length of the feed 102 and wing portion 112 is sufficient to reach the electrical length of the low band-edge of the low band (e.g., 2300 MHz to 2700 MHz, etc.) while at the same time remain a required or predetermined height to achieve good omnidirectionality of the antenna and match of the VSWR.

Each triangular tapering feed 102 may be electrically coupled to the ground plane 104 via a shorting element 108. The shorting element 108 may be configured to provide mechanical support to the antenna 101. For example, each triangular tapering feed 102 may not be sufficiently supported at the proper angle with respect to the ground plane 104 in the absence of the shorting element 108. Without sufficient mechanical support, the triangular tapering feed 102 may bend back towards the ground plane 104 due to gravity, shock to the antenna 101 during shipping or installation, etc., which may change the performance of the antenna 101. The shorting element 108 may provide support to inhibit the triangular tapering feed 102 from moving over time. The shorting element 108 can help reduce or miniaturize the antenna size while not significantly affecting the omnidirectionality of the antenna.

The shorting element 108 may be an extension of the triangular tapering feed 102. As shown in FIG. 1, the shorting element 108 is a strip extending from a center top portion of the triangular tapering feed 102. In other embodiments, the shorting element 108 may have a different shape, extend from a different portion of the tapering feed 102, etc. The shorting element 108 may be integral with the tapering feed 102. Accordingly, the shorting element 108 may be defined at the same time the triangular tapering feeds 102 are stamped, resulting in easier construction. The shorting element 108 could then be bent during assembly of the antenna 101 (e.g., the shorting element 108 could be bent after the tapering feeds 102 are bent, before the tapering feeds 102 are bent, etc.).

The antenna 101 may be coupled to a feed signal at the feed point 106. For example, a feed cable 114 may be coupled to the feed point 106 to provide a feed signal to the feed point 106 of the radiating element. Any suitable feed cable 114 may be used (e.g., a plenum cable with a Sub-Miniature version A (SMA)-Male connector, an approximately 36 inch exposed cable, etc.). By way of example, the feed cable 114 may comprise a coaxial cable having an inner conductor 116 (FIG. 1) that is soldered to the feed point 106. The feed point 106 may be located between (e.g., integrally connected to, etc.) the two opposing triangular tapering feeds 102. The feed cable 114 may thus provide a similar radiating feed signal to each triangular tapering feed 102 via the feed point 106. In other embodiments, other suitable feed techniques may be used.

The ground plane 104 may include an integrally formed (e.g., stamped, bent, folded, etc.) feature for soldering a cable braid. This feature may provide minimum (or at least reduced) direct galvanic contact surface between the cable braid and the ground plane 104 as only the cross section of the integrally formed feature contacts the ground plane 104. Advantageously, this may help to prevent (or at least reduce) any inconsistency in the contact between the cable braid and the ground plane. FIG. 1 shows a cable holder 124 that has been directly formed (e.g., stamped, folded, bent, etc.) from the ground plane 104.

Example antenna systems described herein may be four port, dual band, omnidirectional antenna systems. Each antenna may occupy at least a portion of one corner of a rectangular base, with each port being dual band omnidirectional. Some antenna systems may include a through hole ceiling mount for mounting the antenna system to a ceiling, wall, building, vehicle, machine, etc.

FIG. 2 illustrates an exemplary embodiment of an antenna system or assembly 200 embodying one or more aspects of the present disclosure. The antenna system 200 includes four of the antennas 101 shown in FIG. 1. The four antennas 101 are spaced apart from one another in a rectangular configuration. The four antennas 101 of the antenna system 200 may be identical to the antenna 101 shown in FIG. 1 and described above. Alternative embodiments may include one or more other antennas different than the antenna 101.

As shown in FIG. 2, the triangular tapering feeds 102 of each antenna 101 have the same orientation and are symmetrical. The configuration of FIG. 2 may increase omnidirectionality of the antenna system 200 and improve isolation between each port. Isolation performance can be improved by increasing the distance that the antennas are separated and spaced apart from one another improves the isolation performance. When the antennas are confined into a small area, orientation and arrangement is important to offer good isolation performance. Other embodiments may include non-symmetrical configurations, square or non-square embodiments, etc.

The antenna system 200 includes four separate or distinct ground plane portions or sectors 216. Each separate ground plane portion 216 is positioned adjacent a different antenna 101. Each antenna 101 receives a feed signal from a different feed cable 114. Accordingly, the antenna system 200 may thus be a multiple-input multiple-output (MIMO) antenna system. Separate ground plane portions 216 may allow for improved omnidirectionality of the antenna system 200 and/or may inhibit excessive high gain that would make the antenna unable to meet peak gain requirements.

Each triangular tapering feed 102 also includes a shorting element or leg 108. The shorting element 108 electrically couples the tapering feed 102 to its respective ground plane portion 216. The shorting element 108 may also provide mechanical support for the tapering feed 102 as described above relative to FIG. 1. In other embodiments, less (or none) of the tapering feeds 102 may include shorting elements 108.

FIG. 2 also shows a radome 218 that may be used to cover the antennas 101, etc. The radome 218 may be any suitable radome for housing components of the antenna system 200. The radome 218 may provide protection to the antenna system components from weather, debris, physical contact during transportation and/or use, etc.

Immediately below are tables 1-4 with performance summary data measured for each port of the antenna system 200 shown in FIG. 2. As shown by the table, each port has good performance characteristics (e.g., VSWR, port to port isolation, gain, beam width, ripple, etc.) at desired operating frequencies.

TABLE 1

Port 1 Performance Characteristics

| | Range 1 | Range 2 |
|---|---|---|
| Operating Frequency Range | 2400-2500 MHz | 4900-5900 MHz |
| VSWR Max | 1.2:1 | 1.7:1 |
| Port to Port Isolation | P1-P2: 24.97 dB<br>P1-P3: −19.83 dB<br>P1-P4: −22.42 dB | P1-P2: −29.15 dB<br>P1-P3: −27.52 dB<br>P1-P4: −25.18 dB |
| Maximum Gain (dBi) | 3.6 | 4.1 |
| Typical Gain (dBi) | 2.4 | 1.6 |

TABLE 2

Port 2 Performance Characteristics

| | Range 1 | Range 2 |
|---|---|---|
| Operating Frequency Range | 2400-2500 MHz | 4900-5900 MHz |
| VSWR Max | 1.41:1 | 1.62:1 |
| Port to Port Isolation | P2-P1: 24.97 dB<br>P2-P3: −23.08 dB<br>P2-P4: −19.25 dB | P2-P1: −29.15 dB<br>P2-P3: −25.7 dB<br>P2-P4: −27.23 dB |
| Maximum Gain (dBi) | 3.8 | 1.9 |
| Typical Gain (dBi) | 2.2 | 0.9 |

TABLE 3

Port 3 Performance Characteristics

| | Range 1 | Range 2 |
|---|---|---|
| Operating Frequency Range | 2400-2500 MHz | 4900-5900 MHz |
| VSWR Max | 1.24:1 | 1.58:1 |
| Port to Port Isolation | P3-P2: 23.08 dB<br>P3-P1: −19.83 dB<br>P3-P4: −23.61 dB | P3-P2: −25.7 dB<br>P3-P1: −27.52 dB<br>P3-P4: −29.55 dB |
| Maximum Gain (dBi) | 3.1 | 2.7 |
| Typical Gain (dBi) | 1.8 | 1.0 |

TABLE 4

Port 4 Performance Characteristics

| | Range 1 | Range 2 |
|---|---|---|
| Operating Frequency Range | 2400-2500 MHz | 4900-5900 MHz |
| VSWR Max | 1.16:1 | 1.61:1 |
| Port to Port Isolation | P4-P2: 19.25 dB<br>P4-P3: −23.61 dB<br>P4-P1: −22.42 dB | P4-P2: −27.23 dB<br>P4-P3: −29.55 dB<br>P4-P1: −25.18 dB |
| Maximum Gain (dBi) | 3.8 | 3.4 |
| Typical Gain (dBi) | 2.2 | 1.5 |

Figure 3:
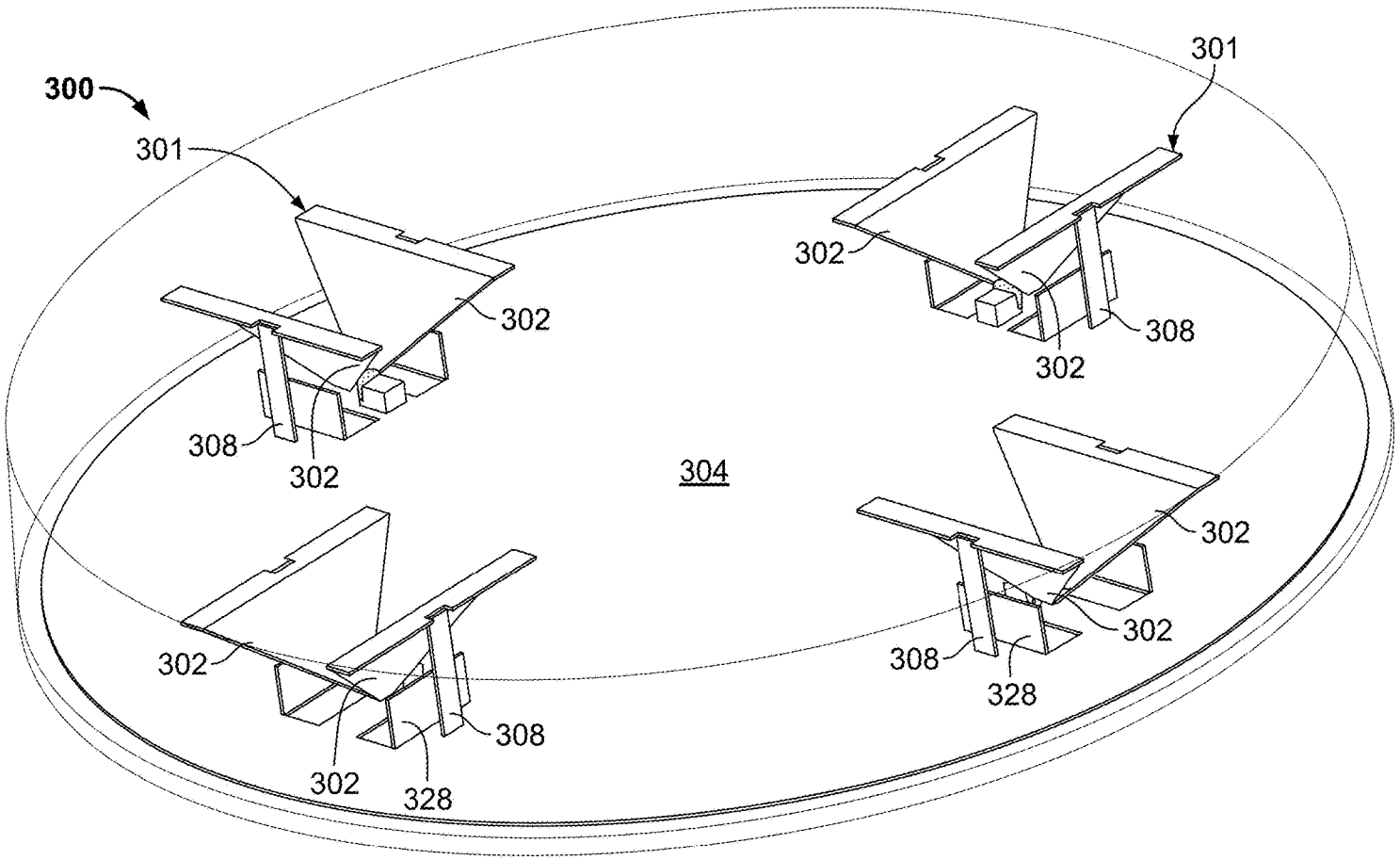
FIG. 3 is a perspective view of an omnidirectional MIMO multiband/broadband antenna system according to an exemplary embodiment, where the antenna system includes four antennas and a single common ground plane for all four antennas.

FIG. 3 illustrates another example embodiment of an antenna system or assembly 300 embodying one or more aspects of the present disclosure. The antenna system 300 is similar to the antenna system 200 of FIG. 2. But the antenna system 300 includes antennas 301 having a different orientation. For example, the feeds 102 of the antennas 101 in the antenna system 200 (FIG. 2) are all oriented in a same direction. For the antenna system 300 (FIG. 3), the feeds 302 of the antennas 301 are oriented in two different directions (e.g., perpendicular or orthogonal directions, etc.). In the antenna system 300, opposite antennas 301 have feeds 302 aligned in the same direction, whereas adjacent antennas 301 have feeds 302 aligned in perpendicular directions. Other embodiments may have differently configured antennas or radiating elements such as in other orientations.

Each triangular and/or tapering feed 302 of the antennas 301 may include a shorting element or leg 308 electrically coupling the tapering feed 302 to a ground plane 304. The example antenna system 300 of FIG. 3 includes a single common ground plane 304. Each triangular tapering feed 302 is electrically shorted or coupled to the same common ground plane 304.

With the tapering or gradual change in width of the feeds 302, the antennas 301 may have a gradual change of impedance that allows the antennas 301 to achieve very wide bandwidth. In addition to providing mechanical support, the shorting legs 308 may also provide DC (direct current) short for the antennas 301 to reduce or minimize of ESD (electrostatic discharge) effect. The shorting legs 308 may also allow for a reduction in the overall size of the antennas 301.

The ground plane 304 may also include one or more flaps 328 (sometimes referred to as ground flaps) that are integrally formed (e.g., stamped, bent, folded, etc.) from the ground plane 304. The ground flaps 328 may extend outwardly from the ground plane 304. The ground flaps 328 may assist in impedance matching, introduce capacitance to the feeding elements 302, etc.

Immediately below is table 5 with performance summary data measured for the antenna system 300 shown in FIG. 3. As shown by the table, the antenna system 300 has good performance characteristics (e.g., VSWR, port to port isolation, gain, beam width, ripple, etc.) at desired operating frequencies.

TABLE 5

Antenna System 300 Performance Characteristics

| Antenna Parameter | | |
|---|---|---|
| Frequency Bands, MHz | 2300-2700 | 4900-5900 |
| Peak Gain, dBi (Typ) | 3.5 | 9.4 |
| Peak Gain, dBi (Max) | 3.9 | 9.6 |
| VSWR (Typ) | <2:1 | <2:1 |
| Isolation, dB (Typ) | <−15 | <−17 |
| Maximum VSWR | 2.0:1 | |
| Nominal Impedance | 50 Ω | |
| Max Power (Ambient temp of 25° C.) | 10 Watts | |
| Polarization | Linear | |
| Azimuth Beam Width | Omnidirectional | |
| Radome | PC/ABS, UV stable | |
| Mounting | Surface mount (stud and nut) | |
| Dimensions (diameter × height) | 150 mm × 25 mm | |
| Weight | — | |
| Storage Temperature (° C.) | −40° C. to +85° C. | |
| Operational Temperature (° C.) | −30° C. to +70° C. | |
| Flammability Rating (Radome) | UL 94V0 Materials | |
| Material Substance Compliance | RoHS Compliant | |

FIGS. 4, 5, and 13-23 provide analysis results for the antenna system 200 (FIG. 2). FIGS. 6-12 provide analysis results for the antenna system 300 (FIG. 3). These analysis results shown in FIGS. 4-23 are provided only for purposes of illustration and not for purposes of limitation.

Figure 4:
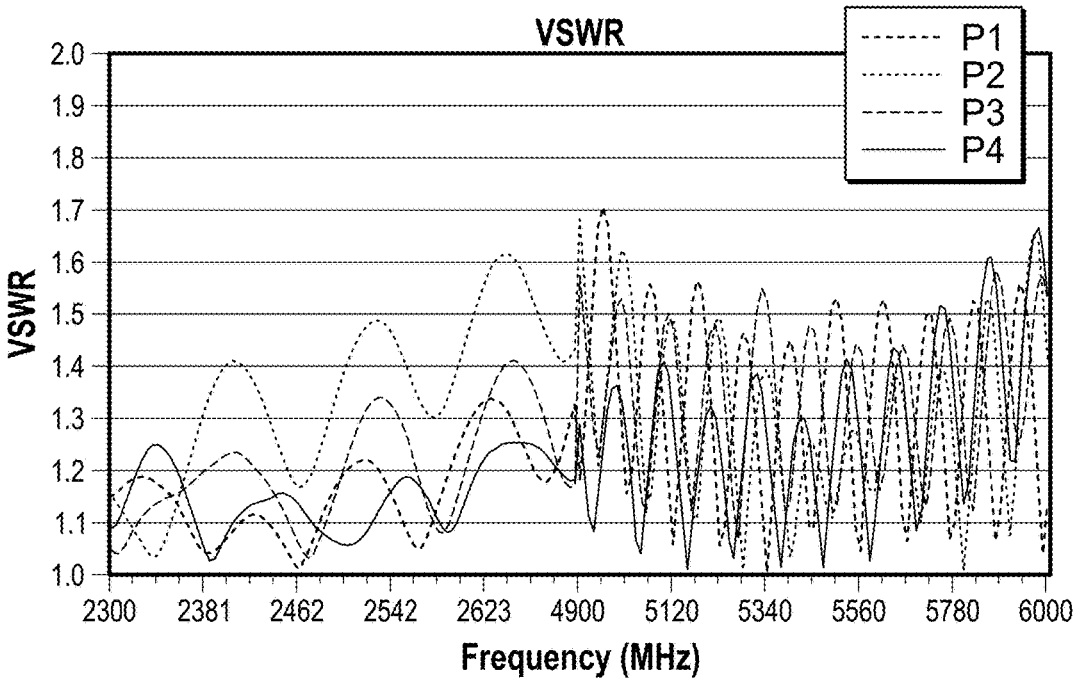
FIG. 4 is an exemplary line graph illustrating voltage standing wave ratio (VSWR) versus frequency in megahertz (MHz) measured for each port of a prototype of the exemplary antenna system of FIG. 2.

More specifically, FIG. 4 is an exemplary line graph illustrating VSWR versus frequency in megahertz (MHz) measured for each port of the prototype of the antenna system 200 of FIG. 2. Generally, FIG. 4 shows that the antenna system 200 is operable with a good standing wave ratio for each port in frequency bands from about 2300 MHz to about 2700 MHz and about 4900 MHz to about 6000 MHz.

Figure 5:
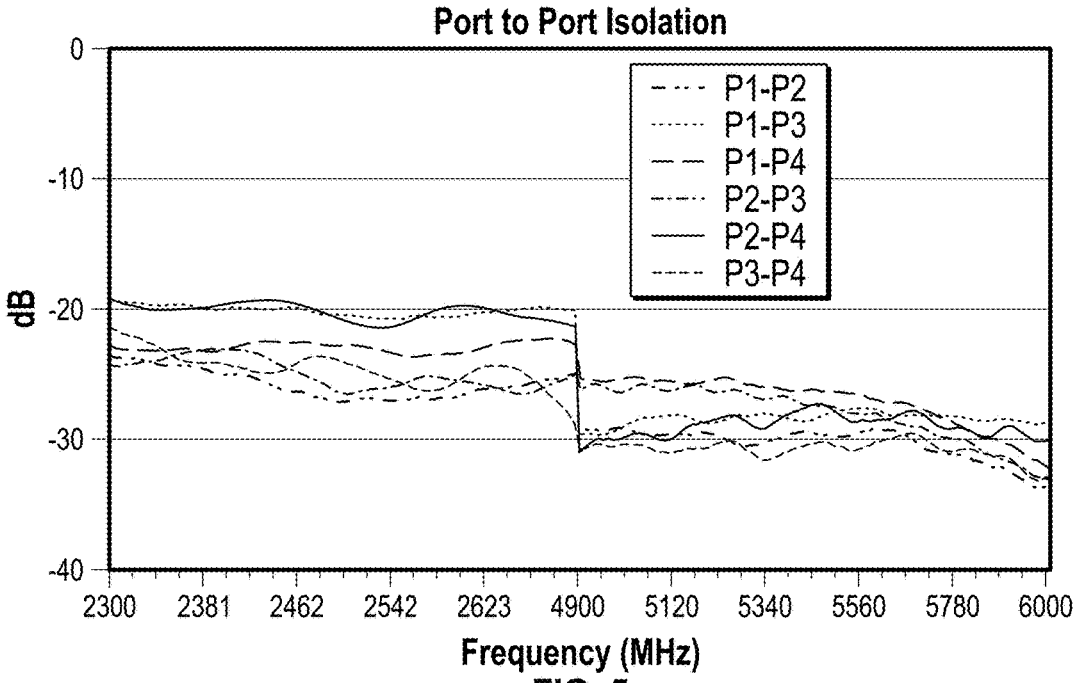
FIG. 5 is an exemplary line graph illustrating port to port isolation in decibels (dB)) versus frequency (MHz) measured for a prototype of the exemplary antenna system of FIG. 2.

FIG. 5 is an exemplary line graph illustrating port to port isolation in decibels (dB) versus frequency in megahertz (MHz) measured for the prototype of the antenna system 200. Generally, FIG. 5 shows that the antenna system 200 is operable with good port to port isolation in frequency bands from about 2300 MHz to about 2700 MHz and about 4900 MHz to about 6000 MHz.

Figure 6:
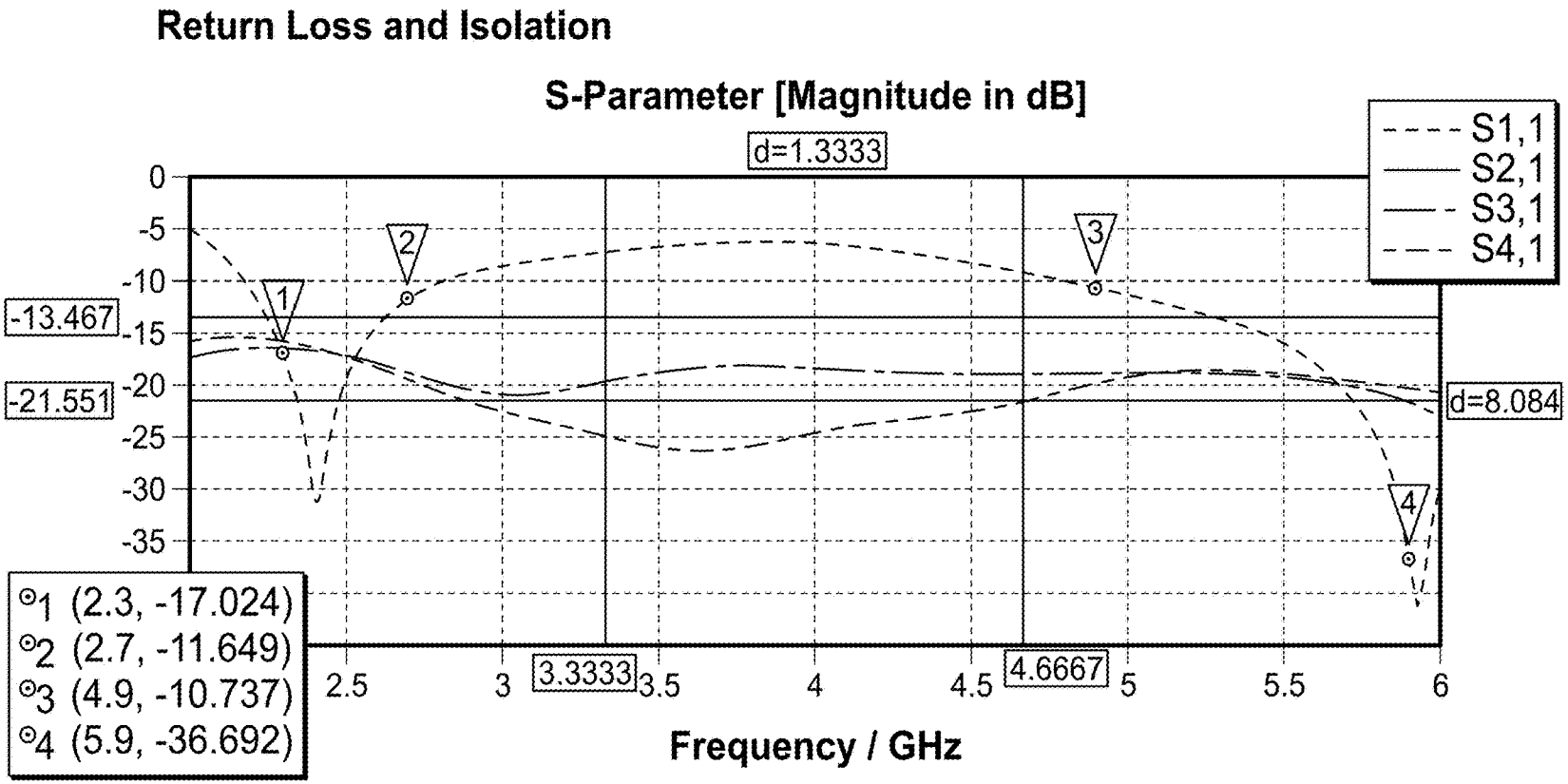
FIG. 6 is an exemplary line graph illustrating return loss and isolation (dB) versus frequency in gigahertz (GHz) simulated for each of the four antennas of the exemplary antenna system of FIG. 3.
Figure 7:
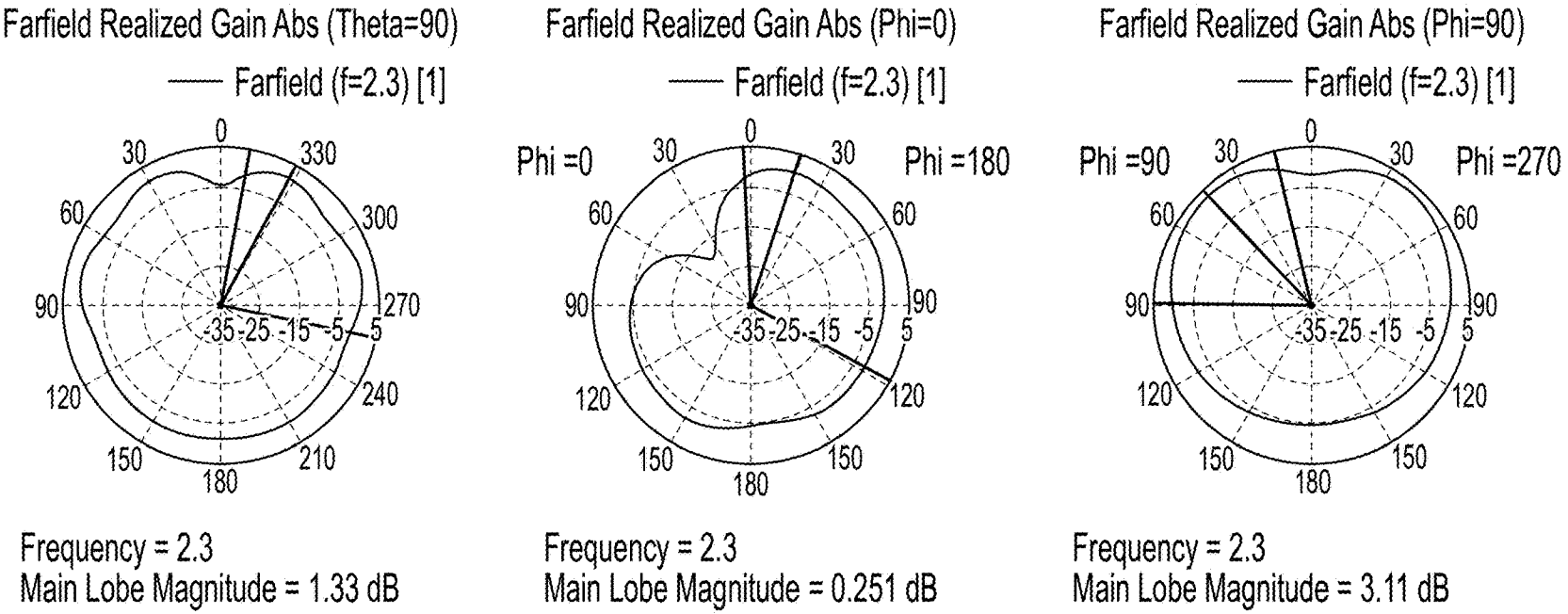
FIGS. 7-12 illustrate radiation patterns simulated for the exemplary antenna system of FIG. 3 at frequencies of 2.3 GHz, 2.5 GHz, 2.7 GHz, 4.9 GHz, 5.5 GHz, and 5.875 GHz.
Figure 8:
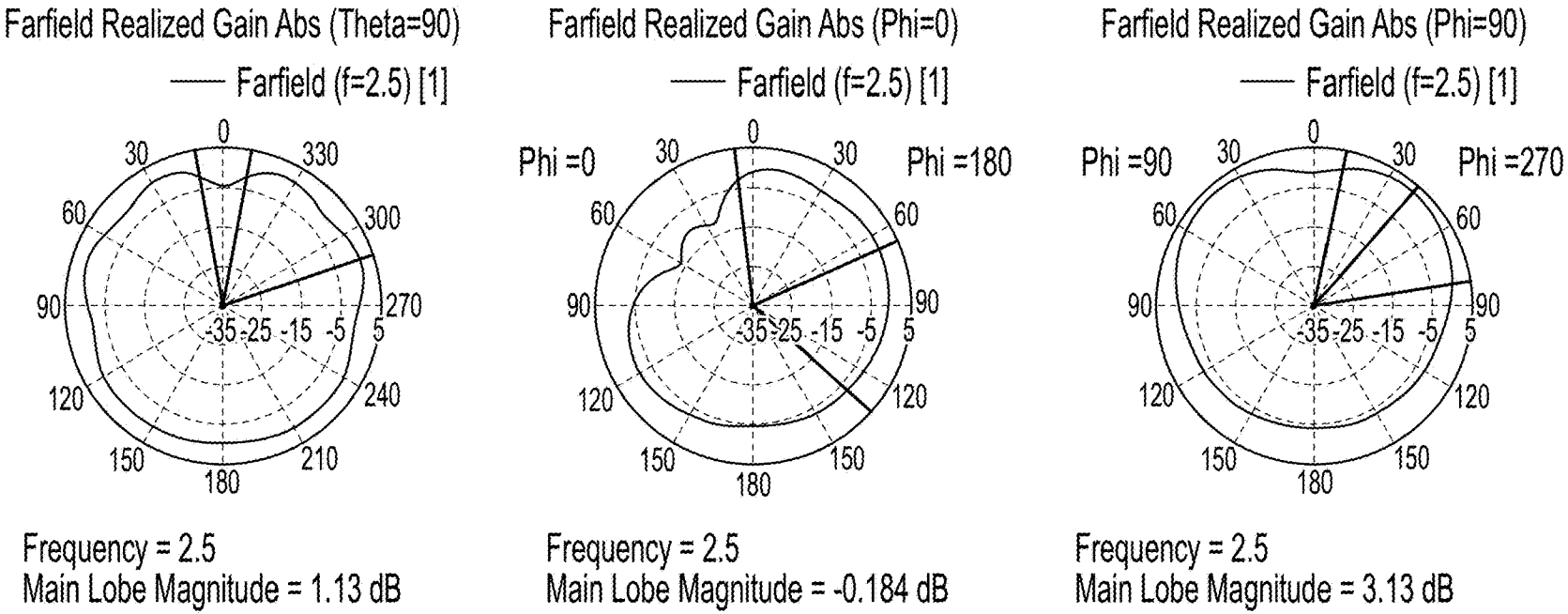
Figure 9:
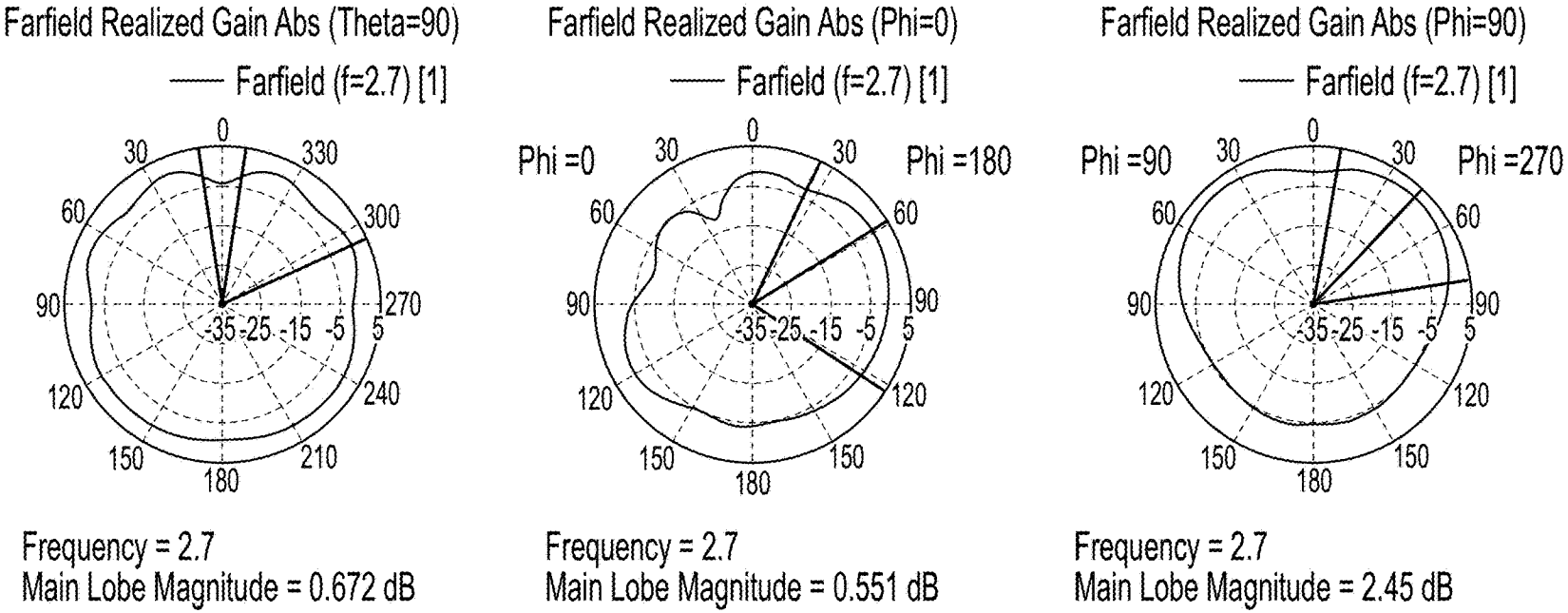
Figure 10:
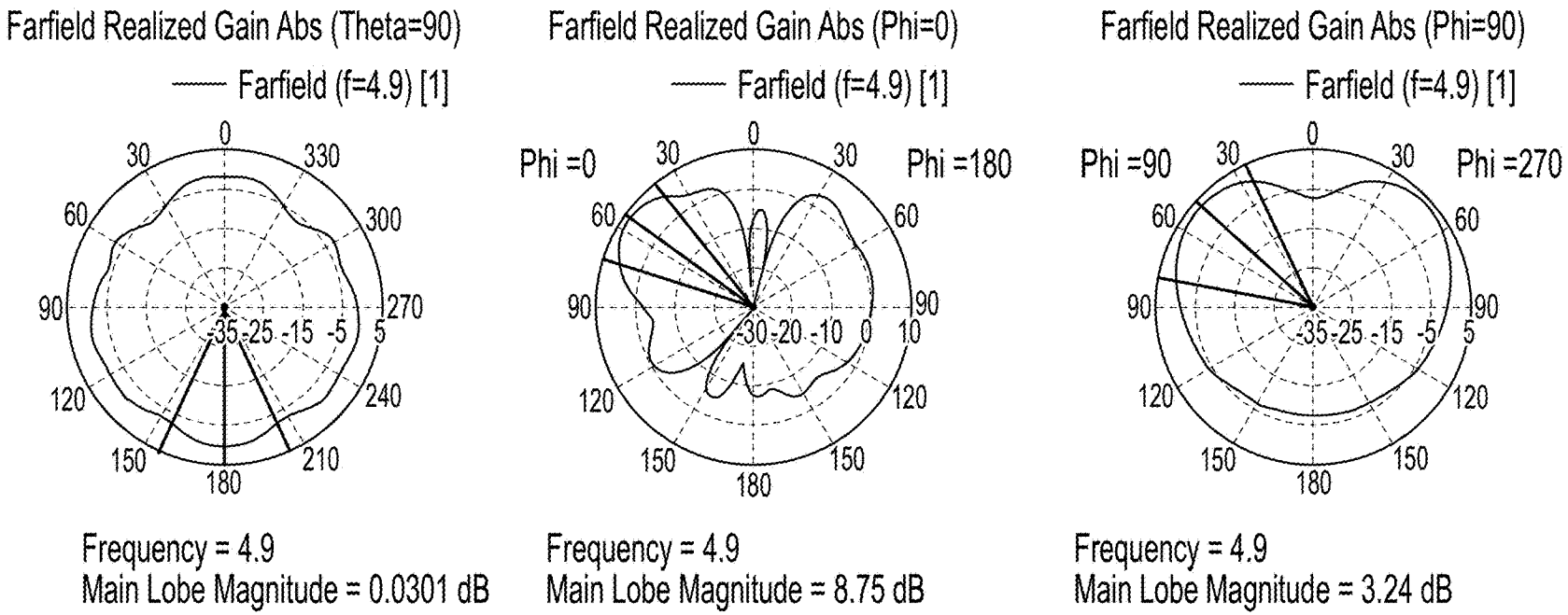
Figure 11:
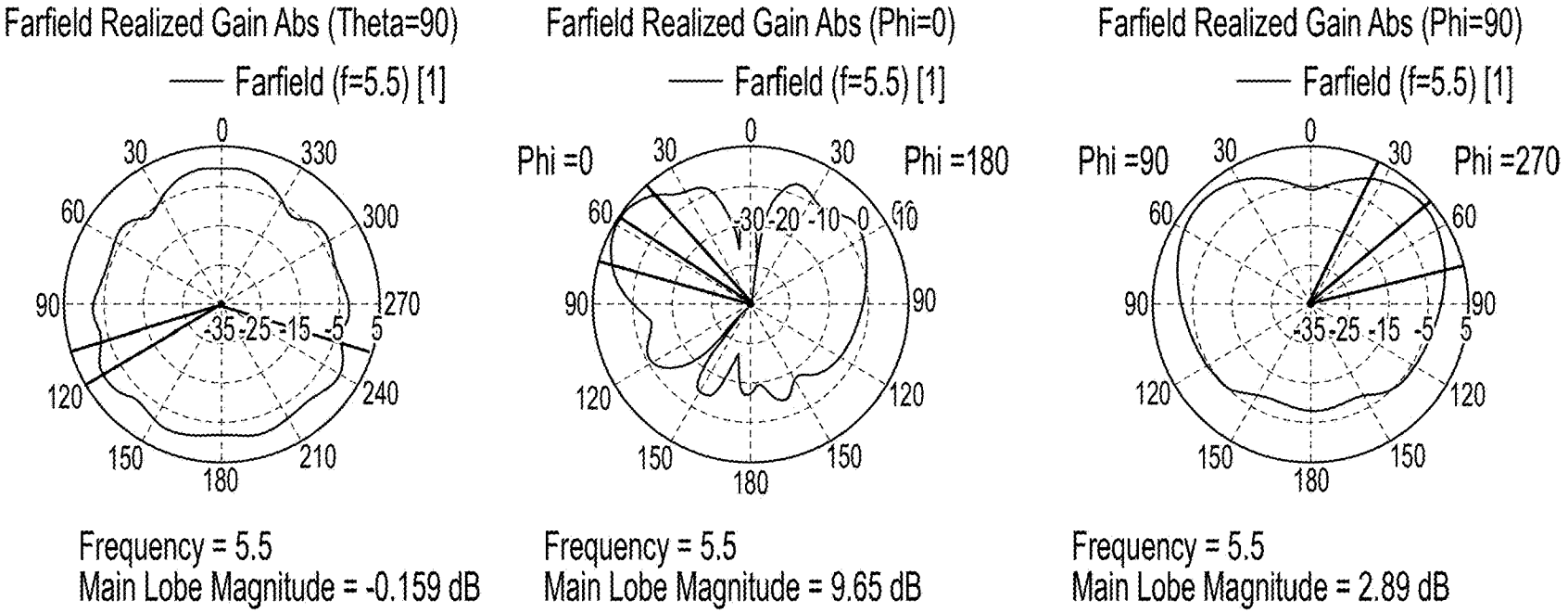
Figure 12:
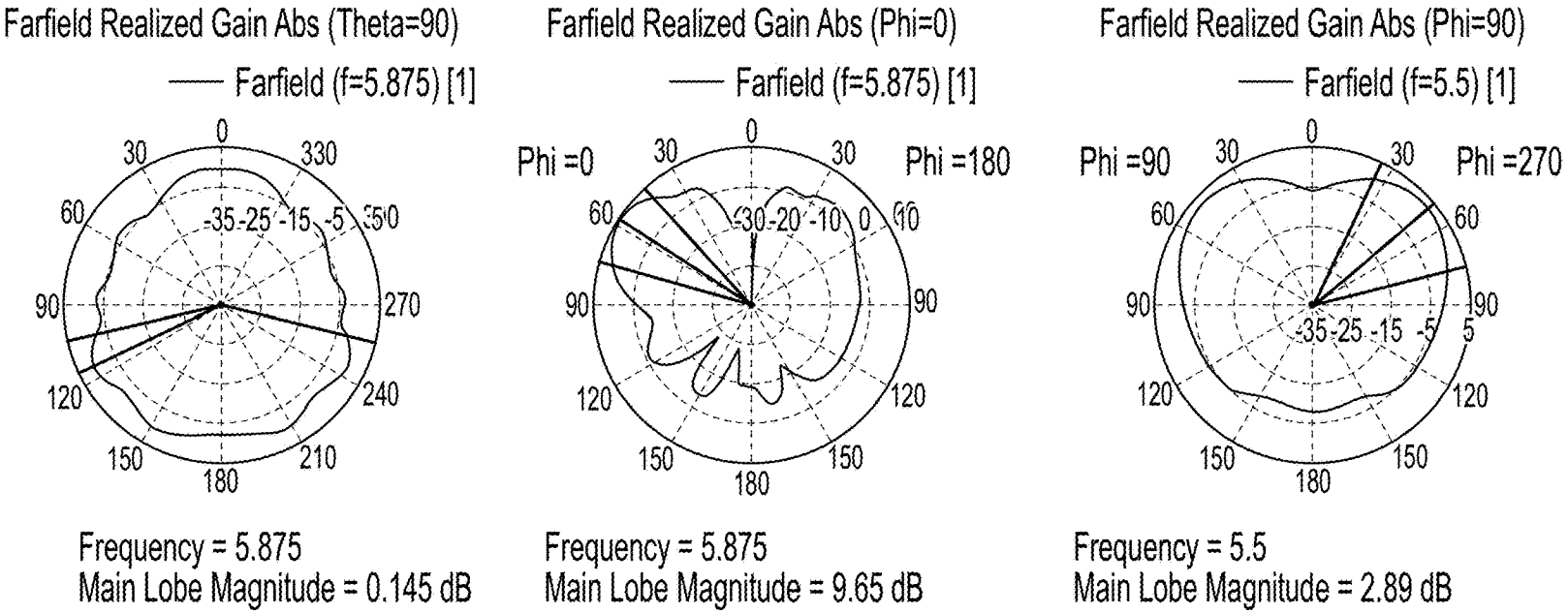

FIG. 6 is an exemplary line graph illustrating return loss and isolation in decibels (dB) versus frequency in gigahertz (GHz) for the simulated design of the antenna system 300 of FIG. 3. Generally, FIG. 6 shows that the antenna system 300 is operable with good return loss and isolation in frequency bands from about 2 GHz to about 6 GHz.

FIGS. 7-12 illustrate various radiation patterns for the simulated design of the antenna system 300. More specifically, FIGS. 7-12 illustrate farfield realized gain at Theta=90° (left), Phi=0° (center), and Phi=90° (right) at frequencies of 2.3 GHz, 2.5 GHz, 2.7 GHz, 4.9 GHz, 5.5 GHz, and 5.875 GHz.

Figure 13:
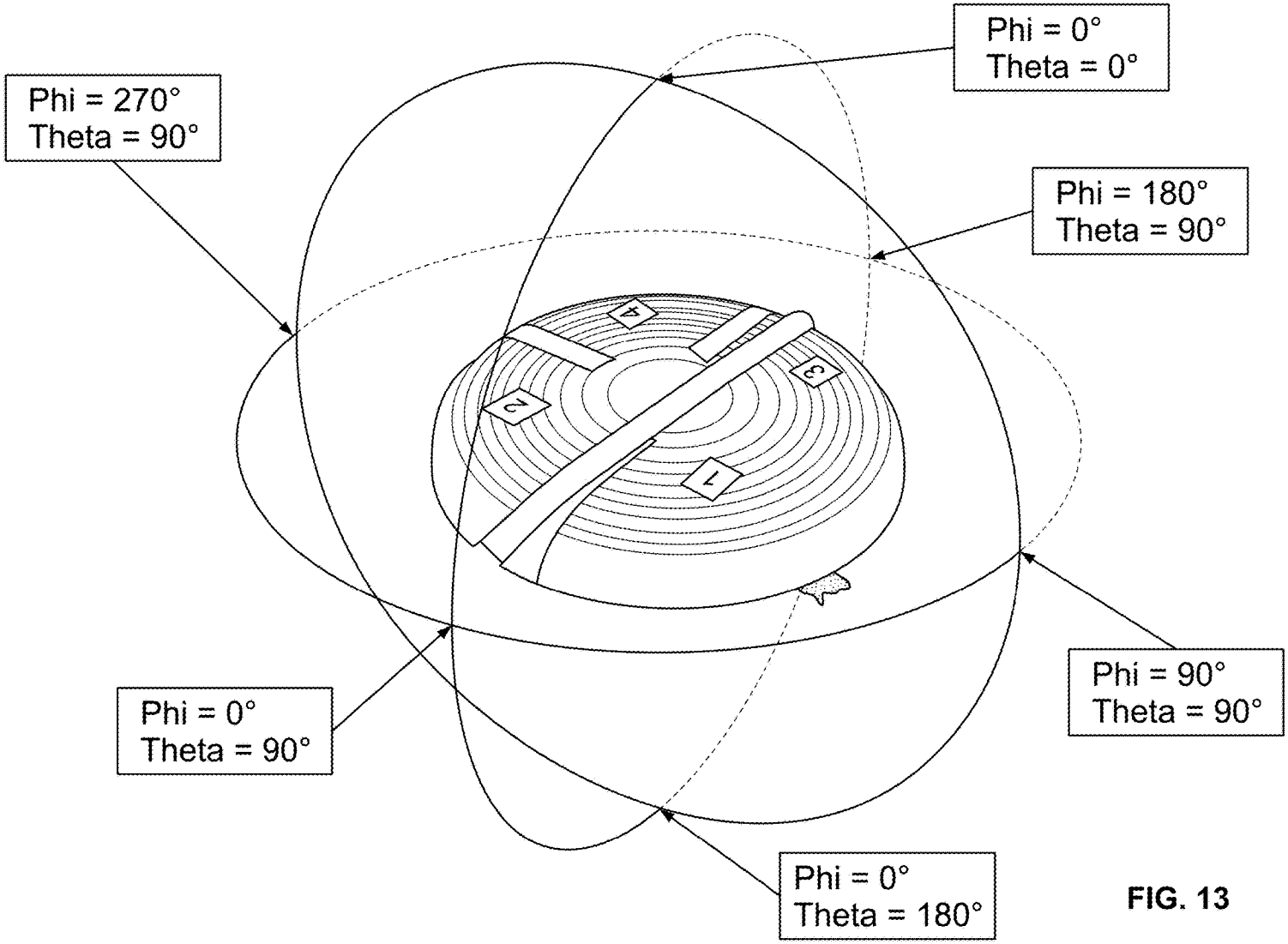
FIG. 13 illustrates orientations of different radiation patterns for the exemplary antenna system of FIG. 2.
Figure 14A:
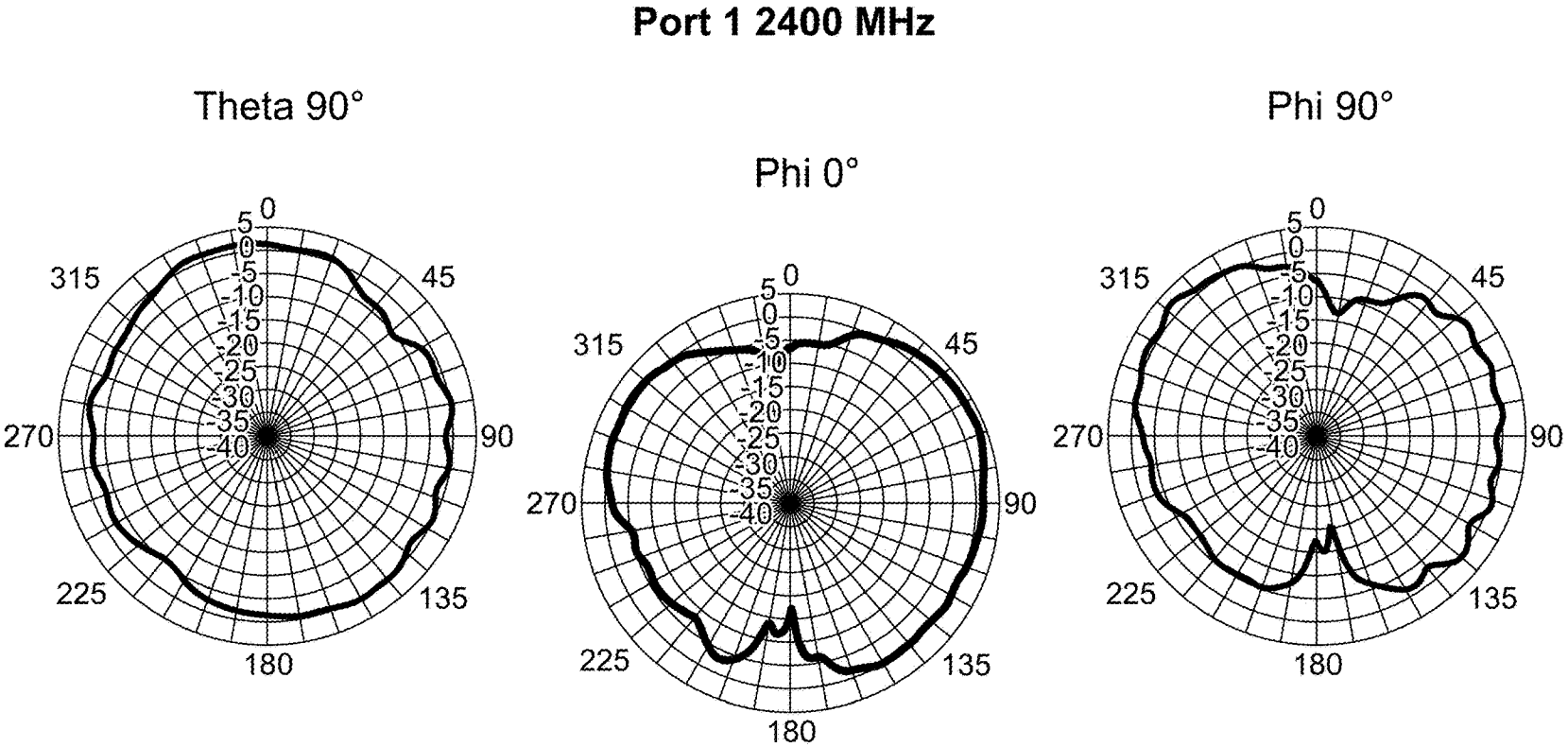
Figure 14B:
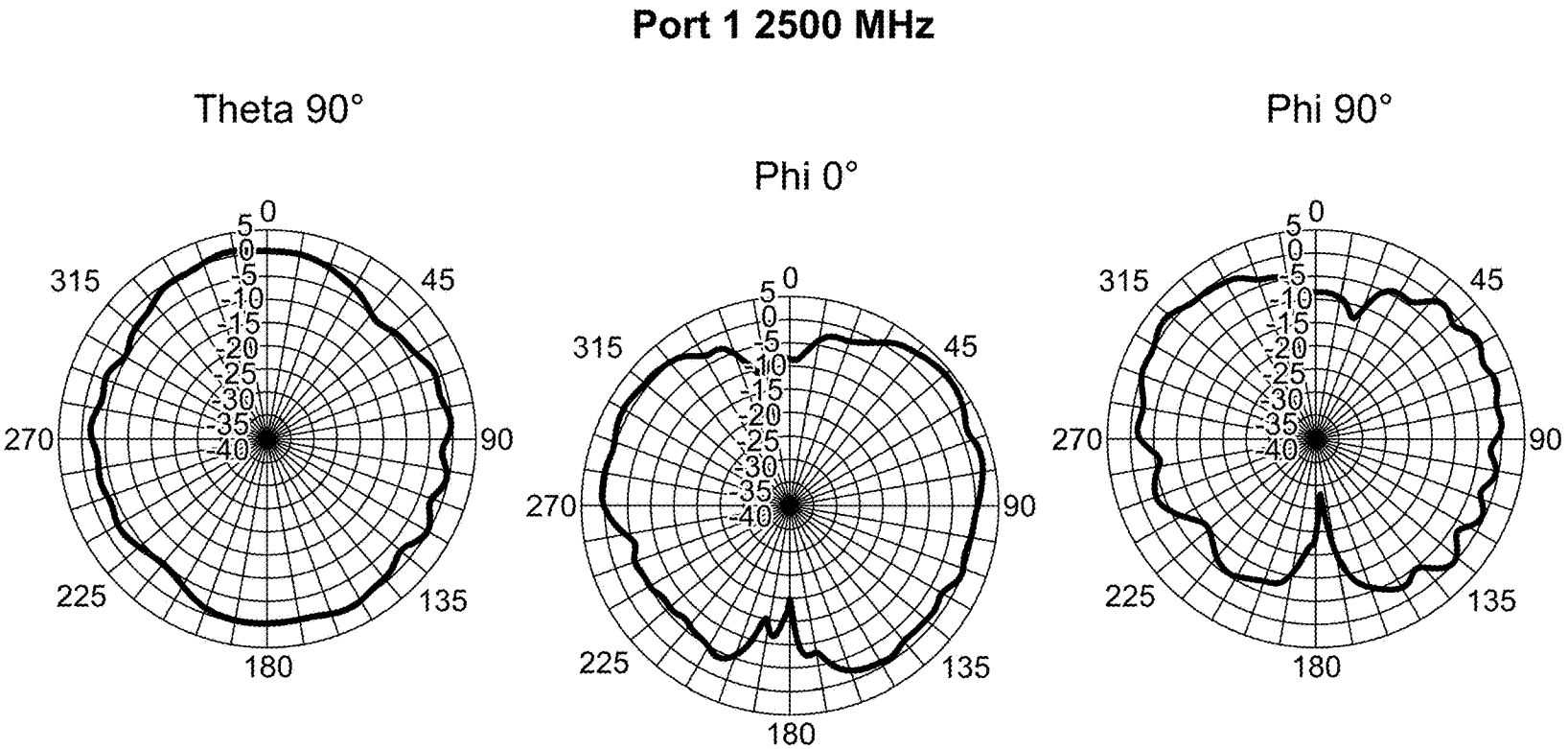
Figure 14C:
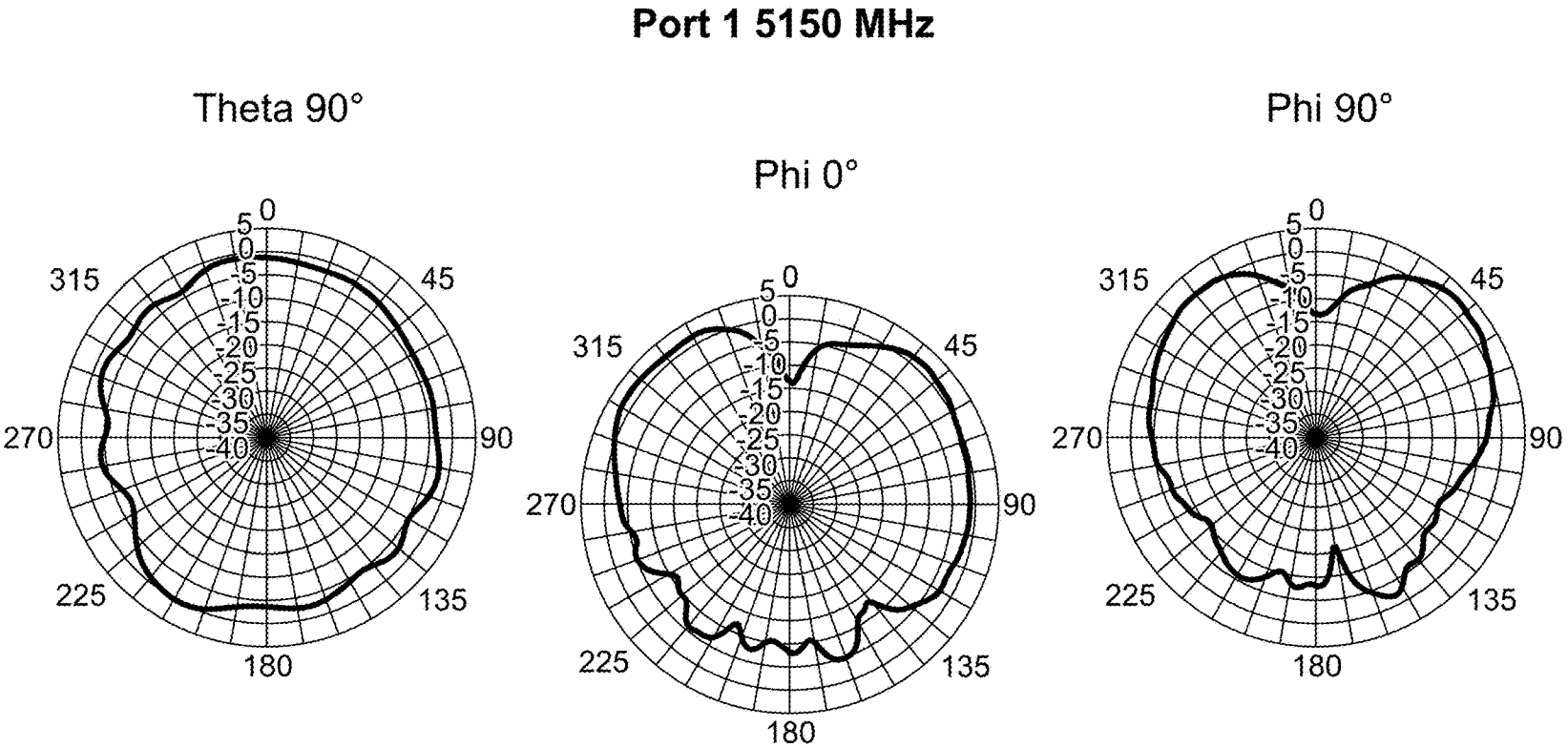
Figure 14D:
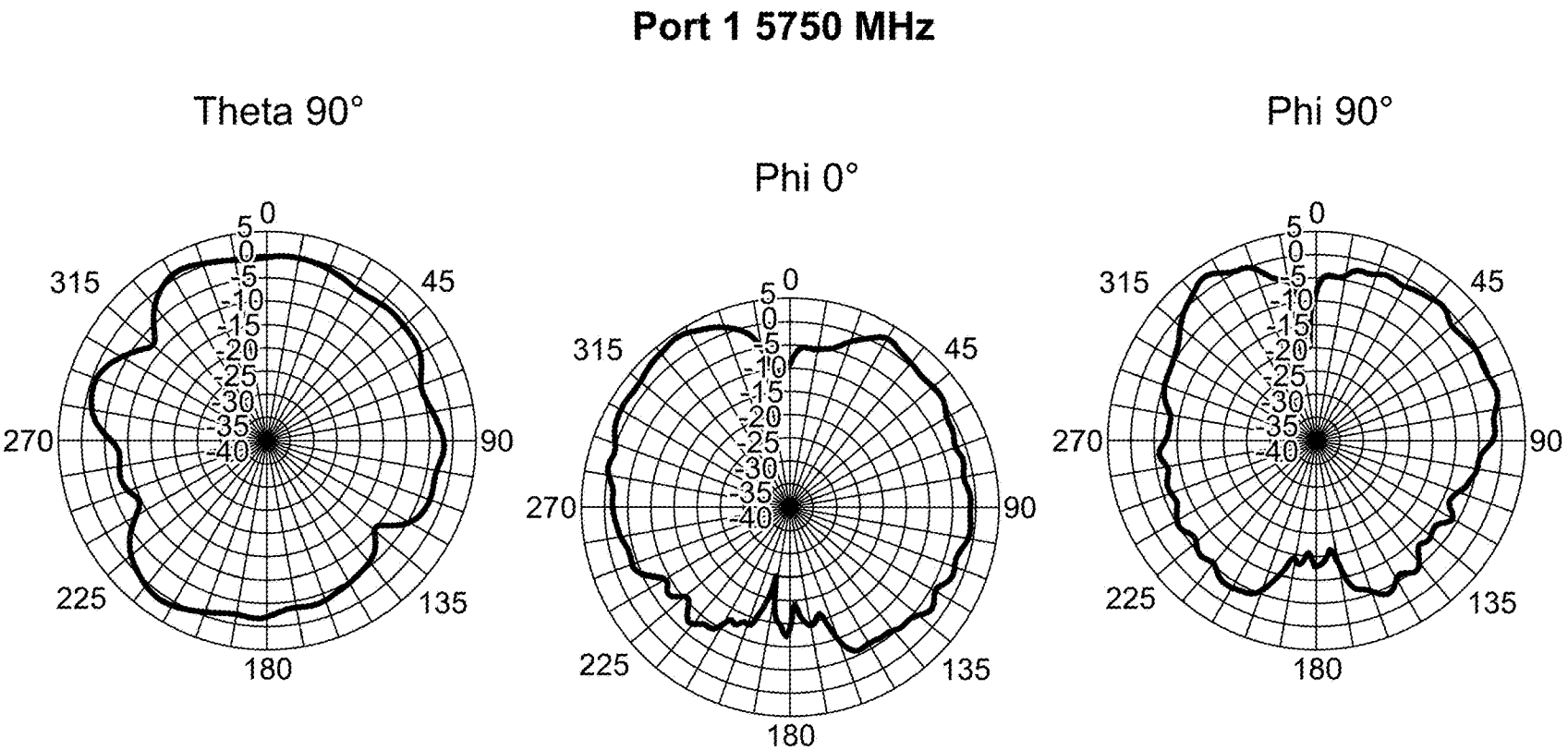
Figure 15A:
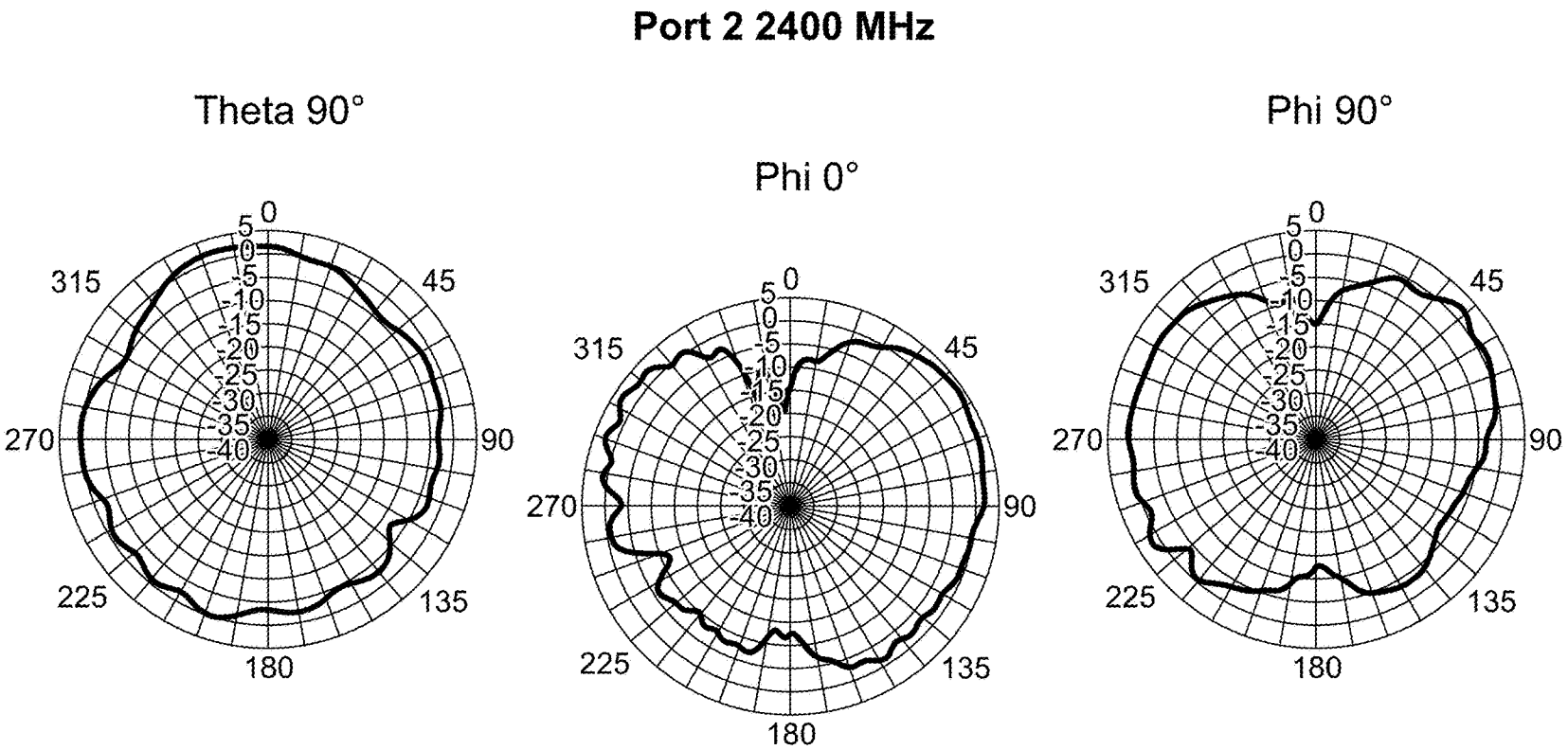
Figure 15B:
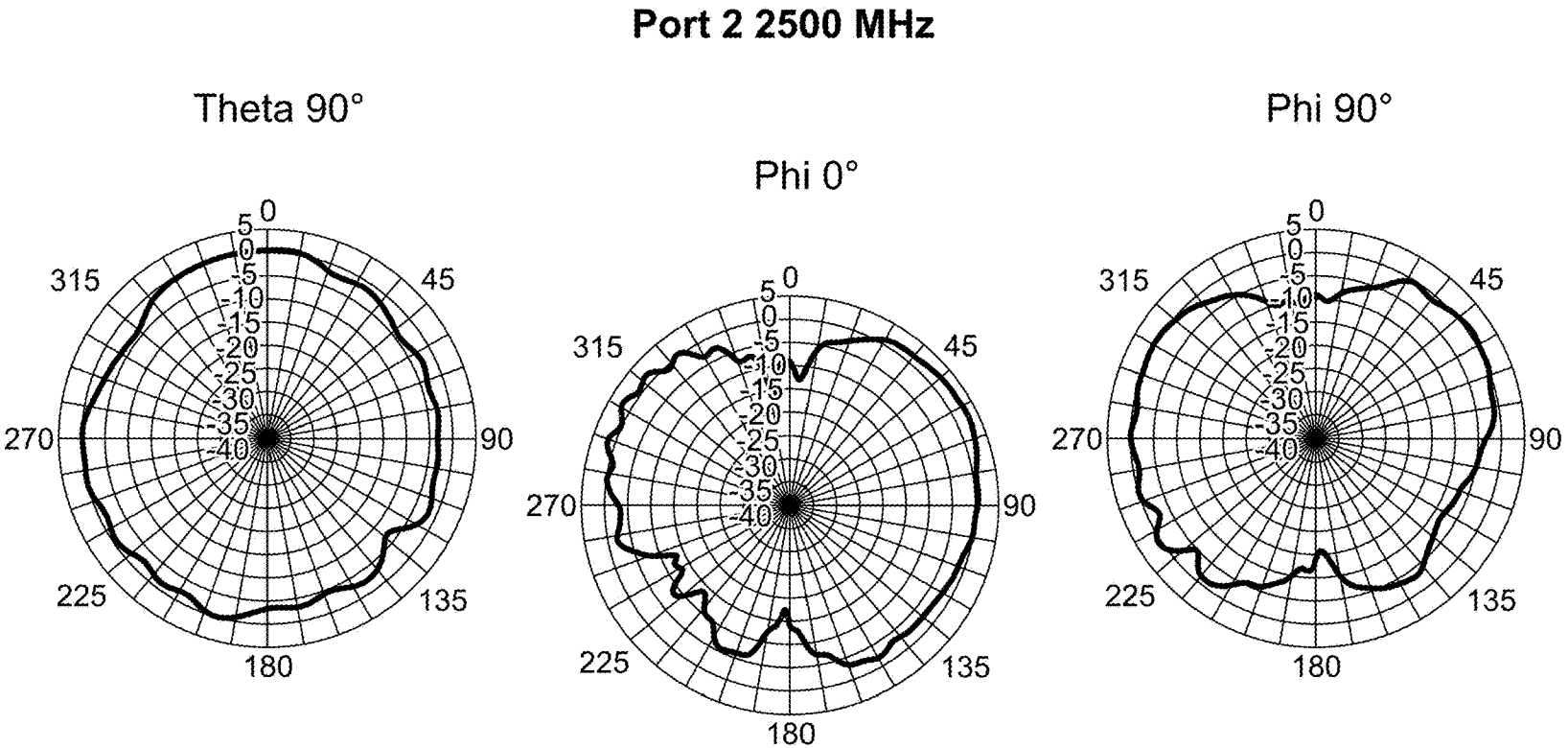
Figure 15C:
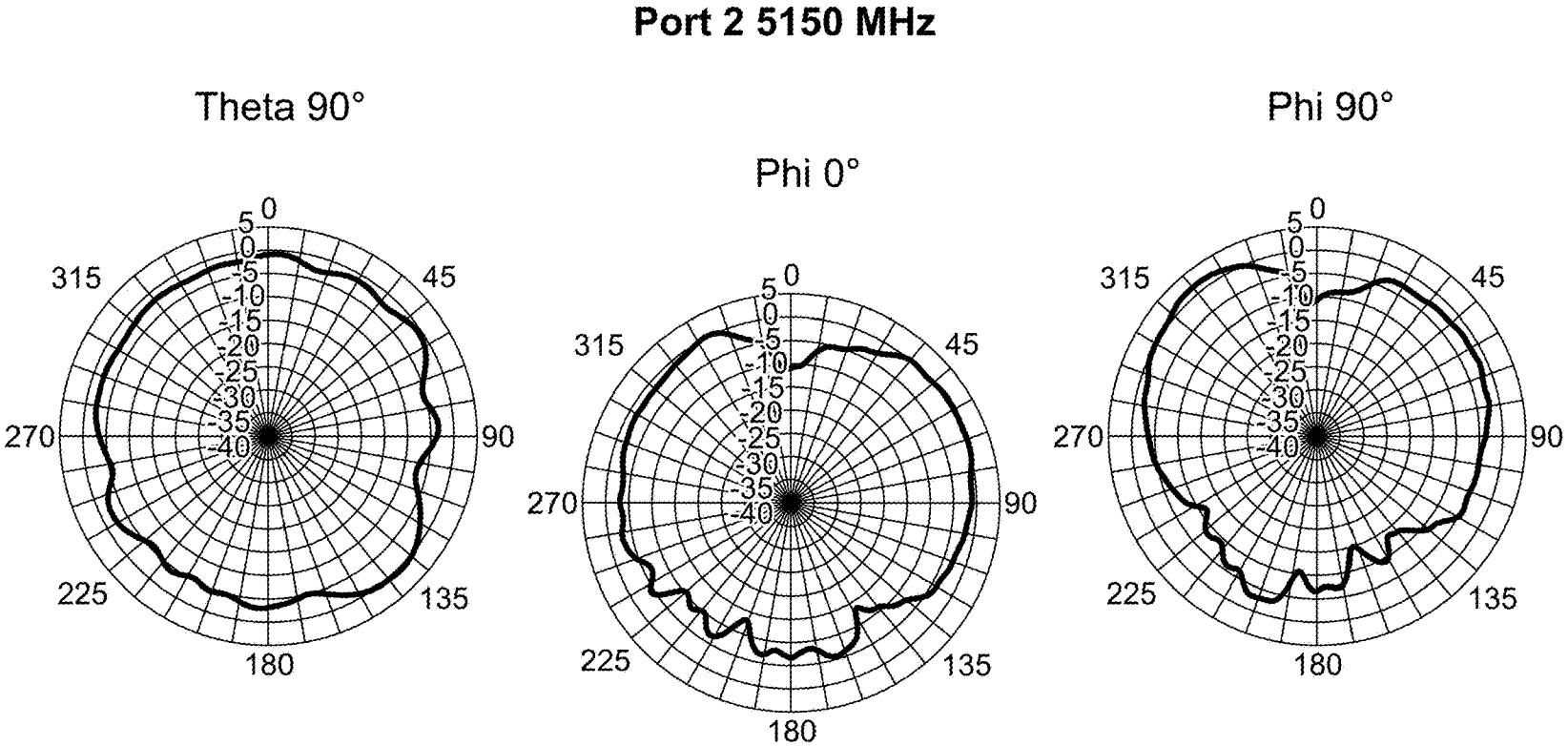
Figure 15D:
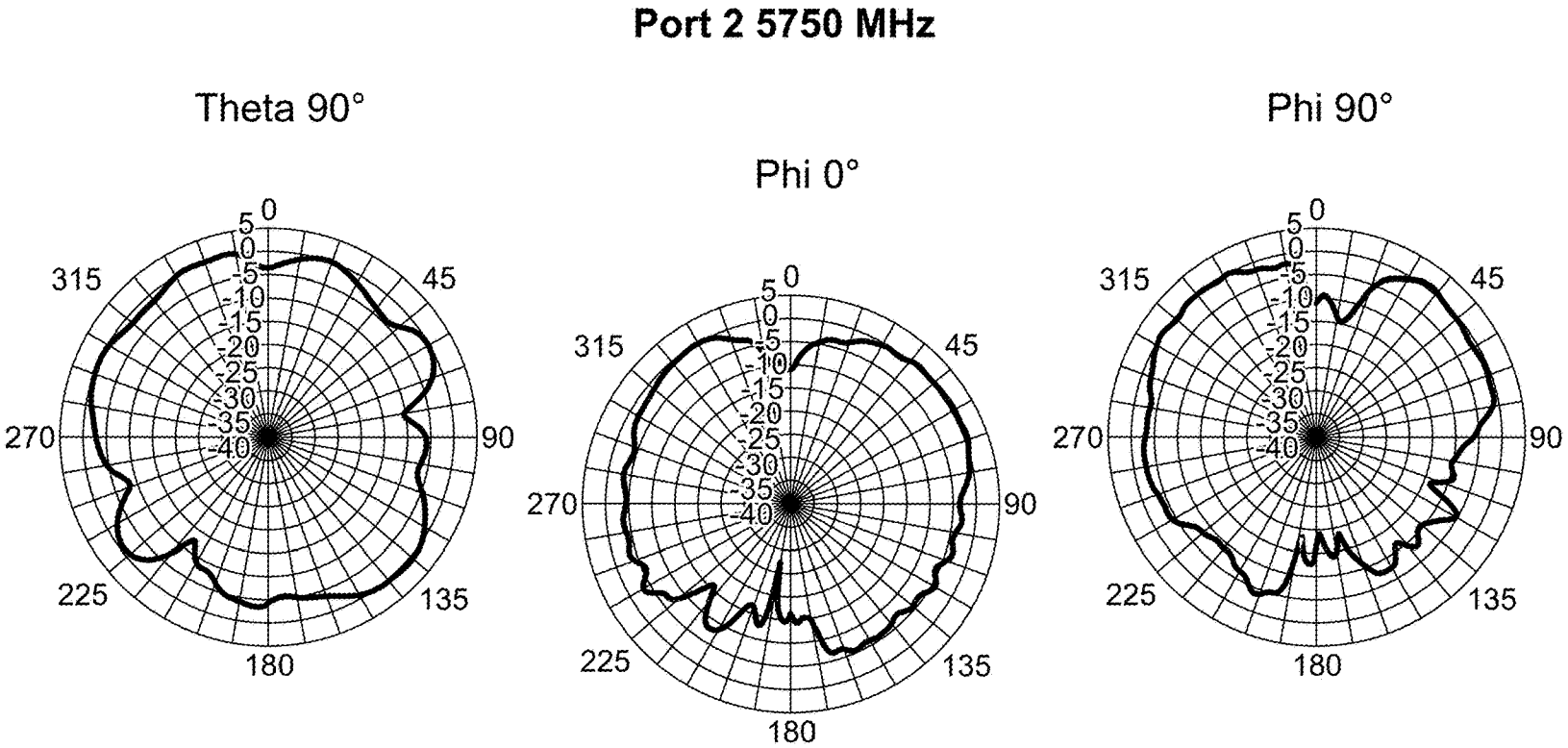
Figure 16A:
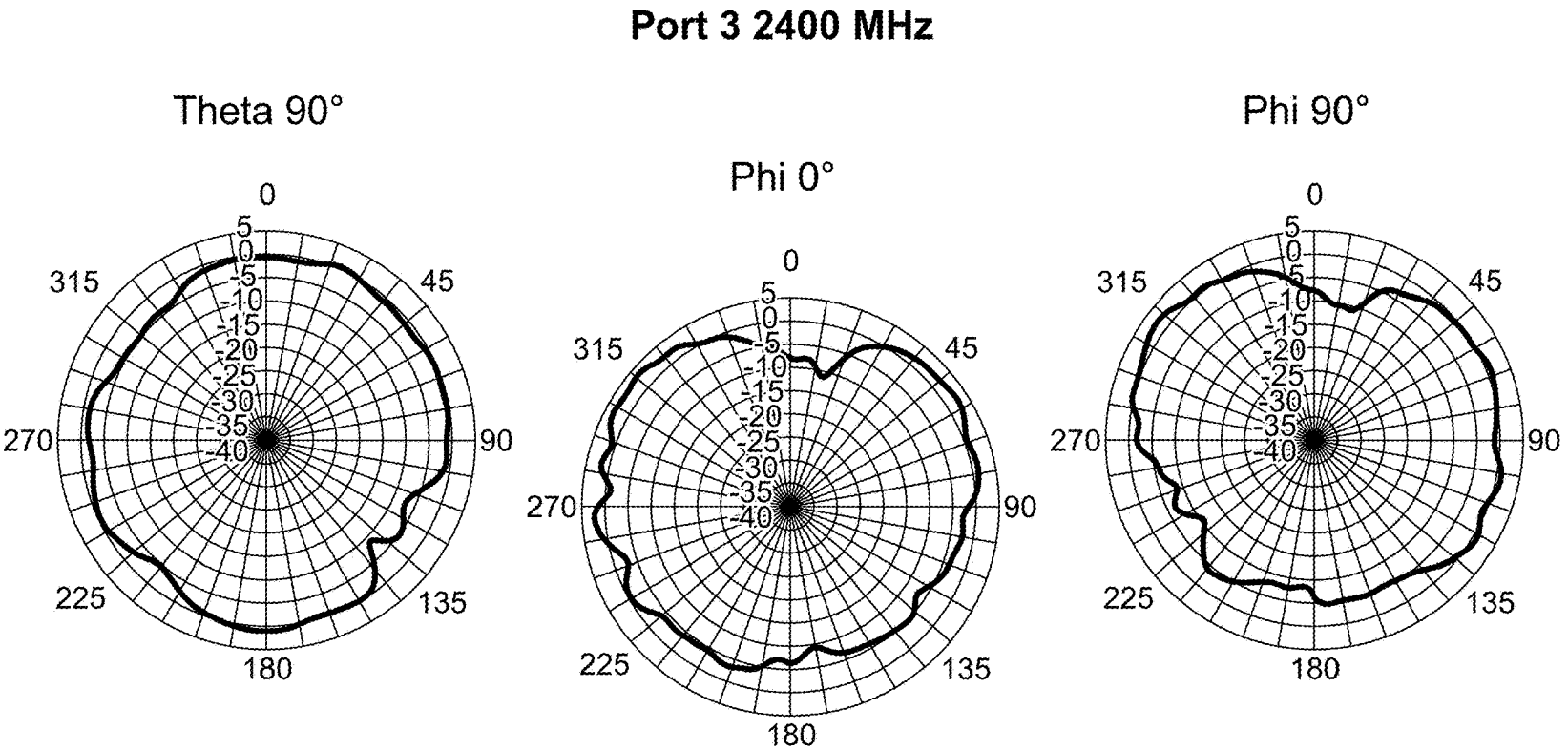
Figure 16B:
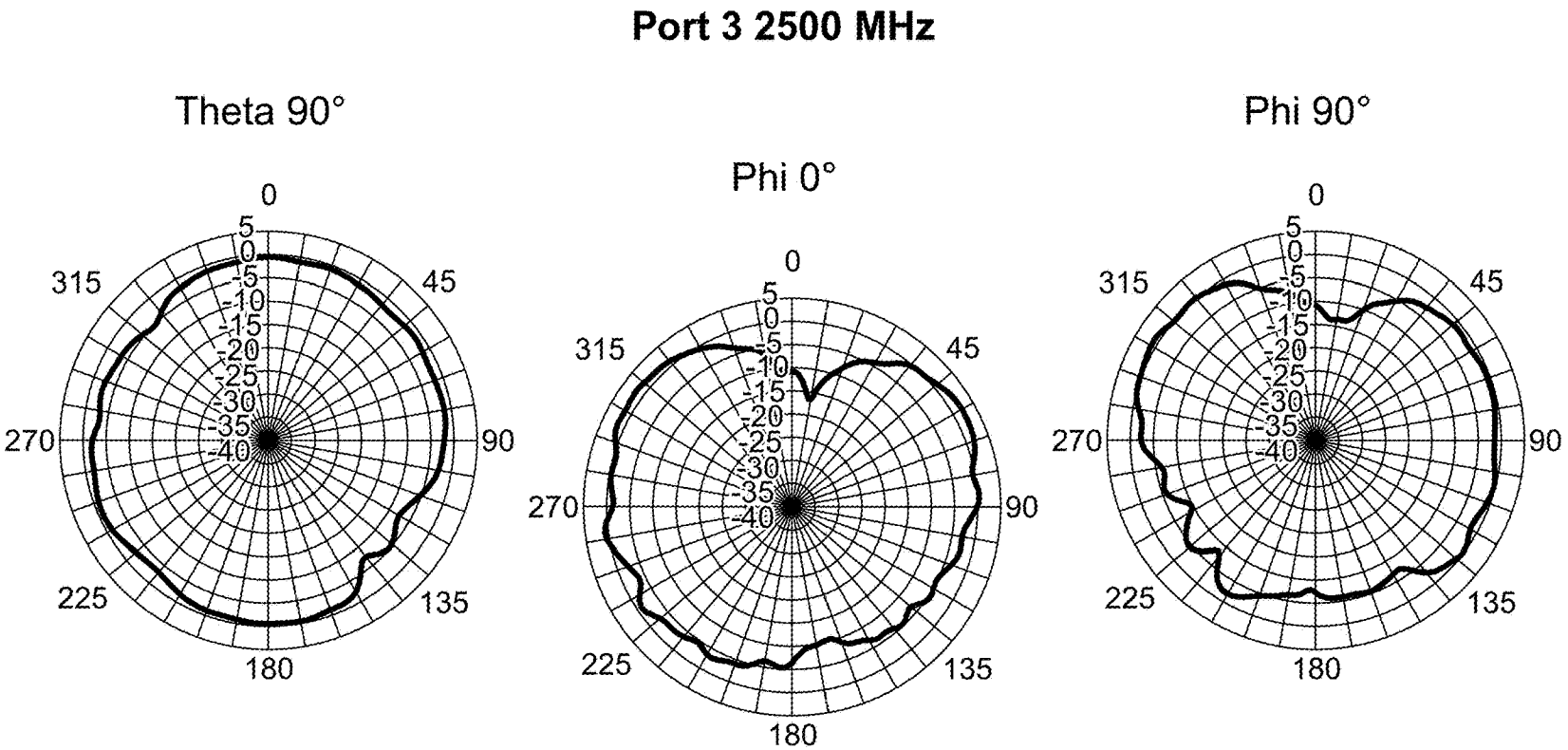
Figure 16C:
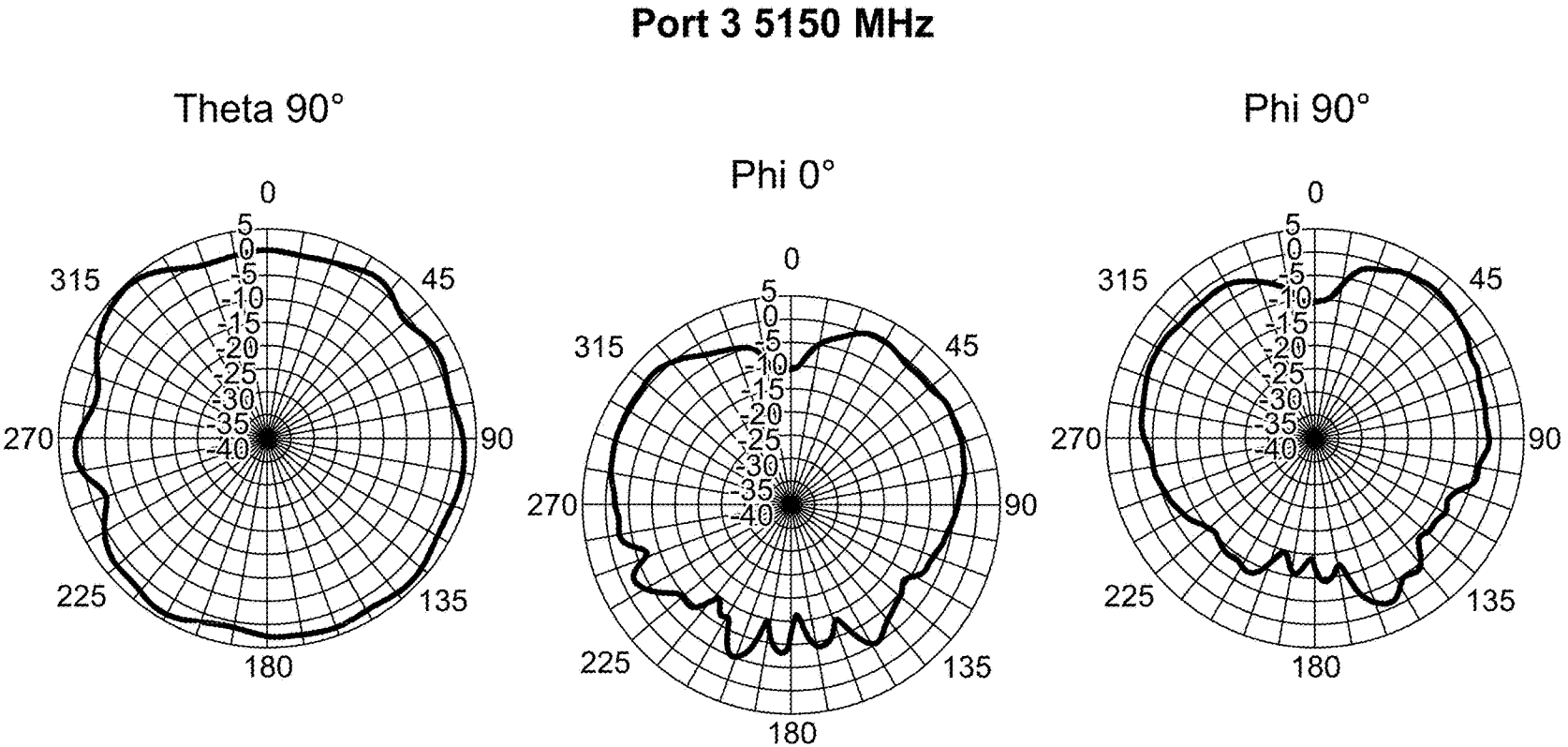
Figure 16D:
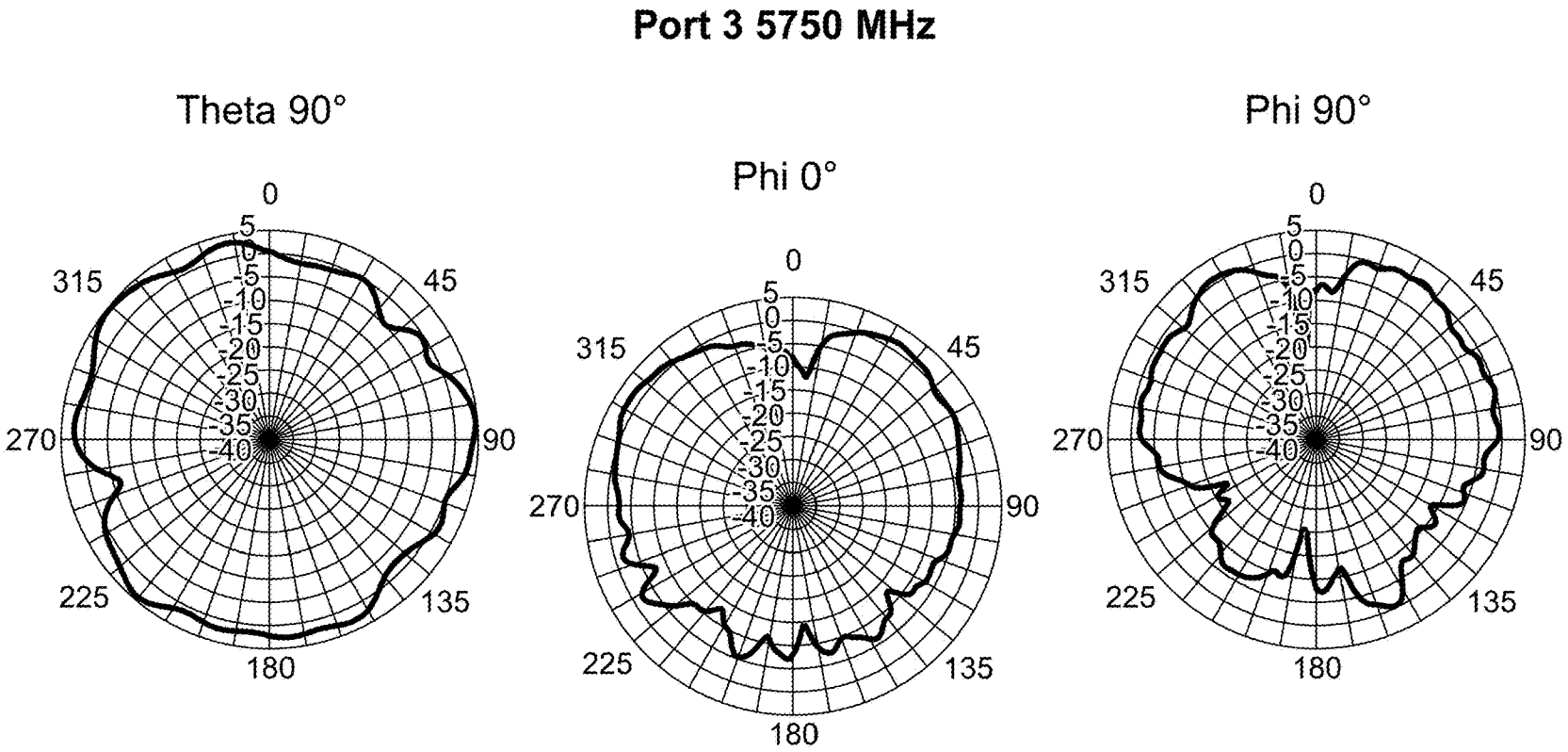
Figure 17A:
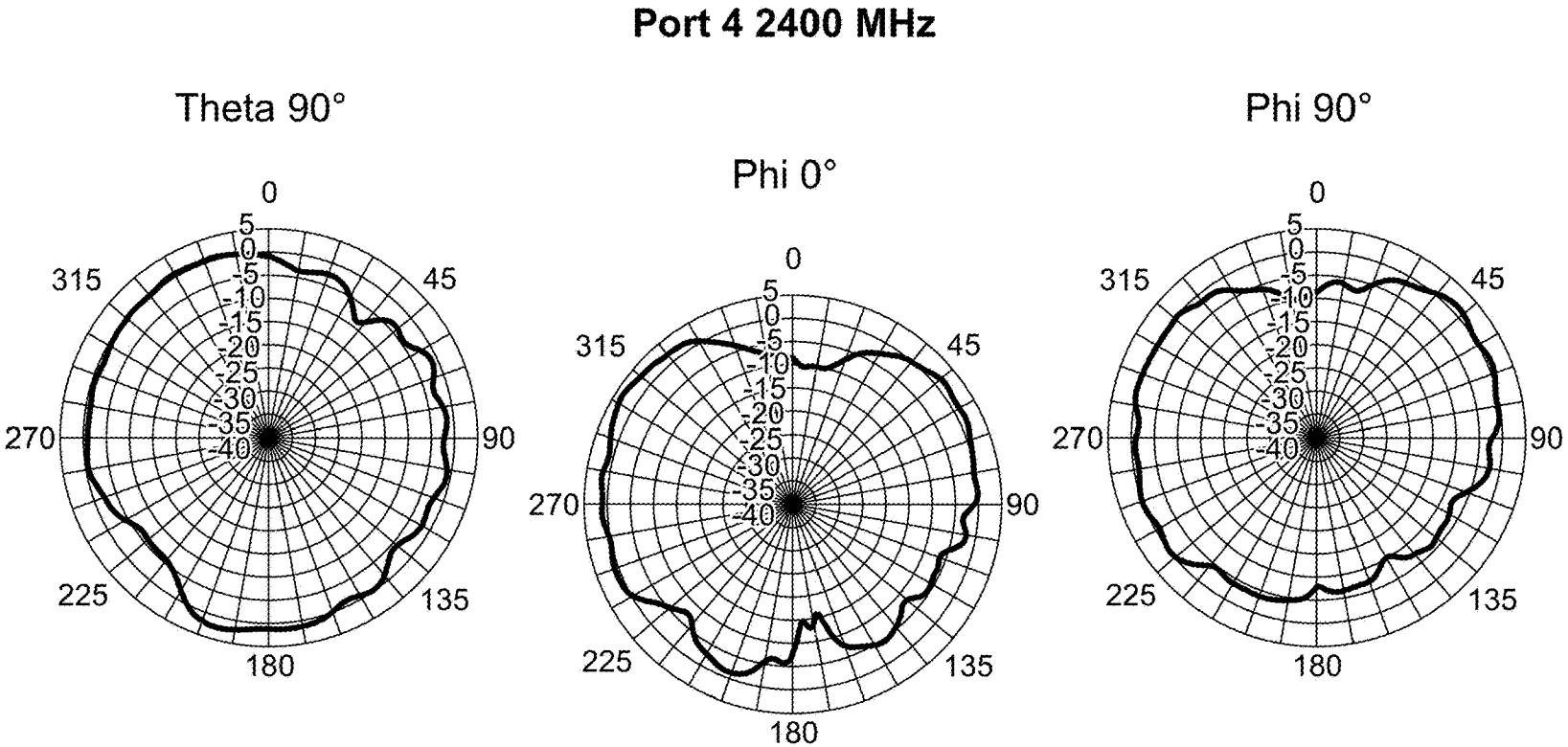
Figure 17B:
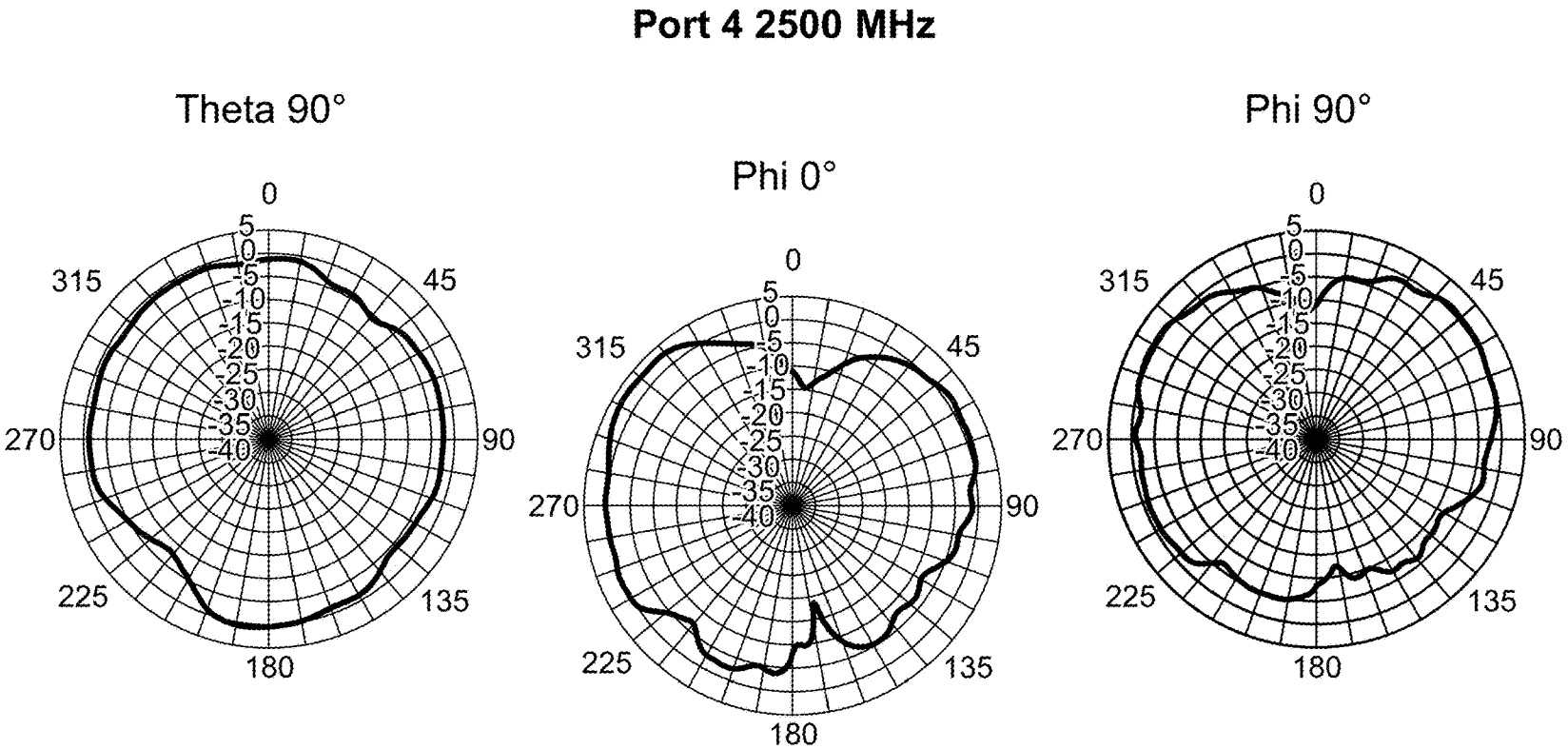
Figure 17C:
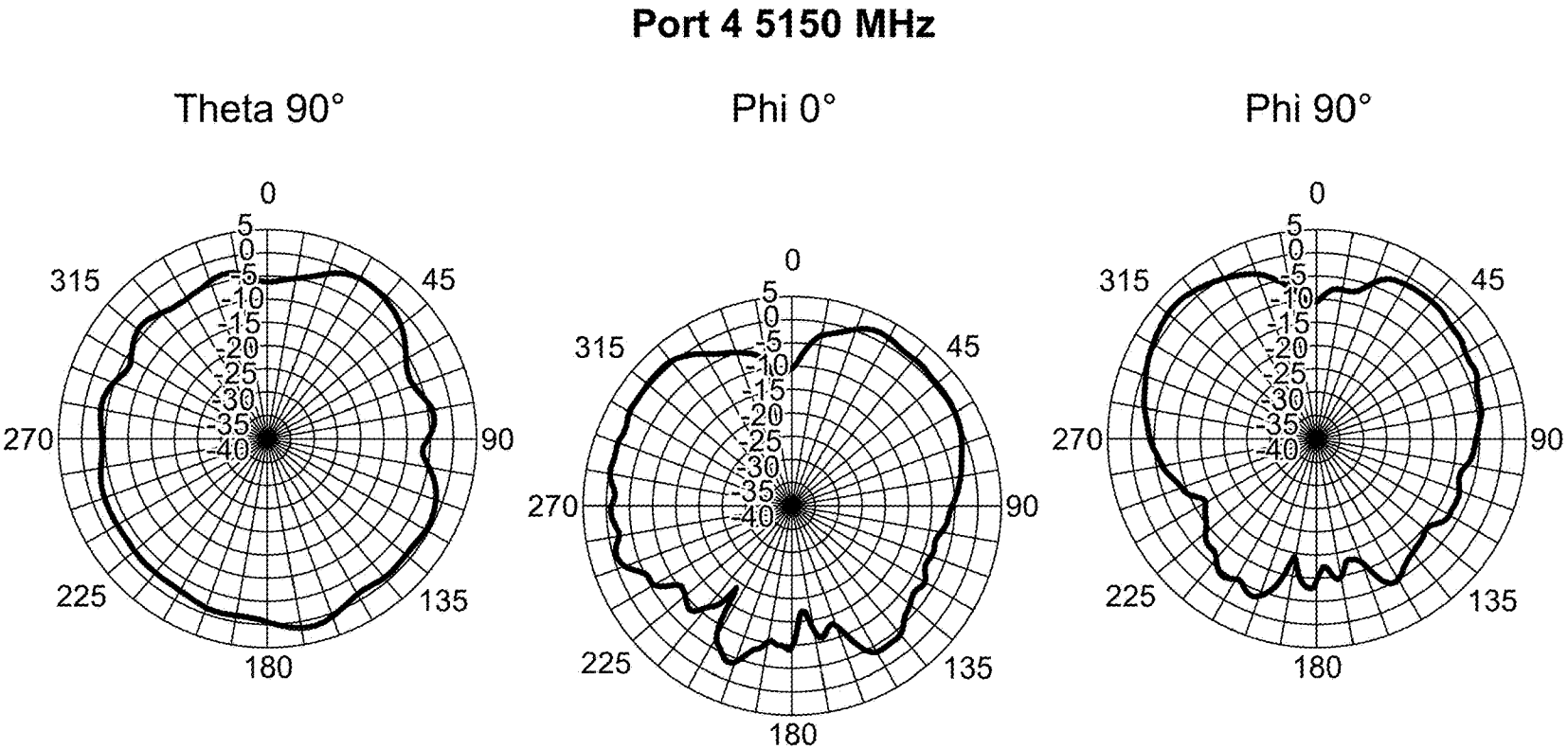
Figure 17D:
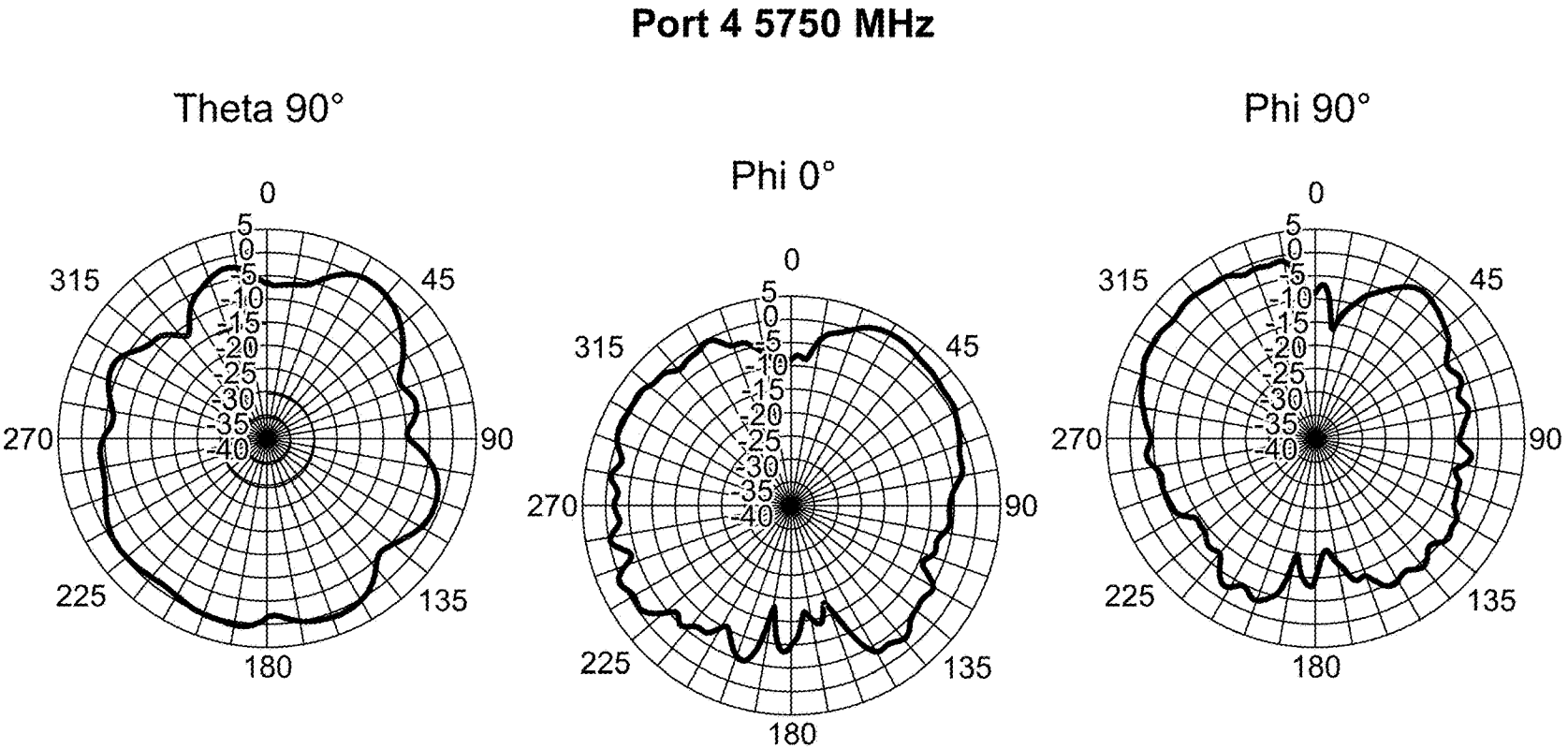

FIG. 13 illustrates various radiation patterns for the antenna system 200 (FIG. 2). More specifically, FIG. 13 illustrates the orientation of different radiation patterns relative to the antenna system 200 at different values of Phi and Theta.

FIGS. 14A-D to 17A-D illustrate various radiation patterns measured for the prototype of the antenna system 200 of FIG. 2. More specifically, FIGS. 14A-D to 17A-D illustrate radiation patterns at Theta=90° (left), Phi=0° (center), and Phi=90° (right) for each of the four ports of the prototype antenna system 200 at frequencies of 2400 MHz, 2500 MHz, 5150 MHz, and 5750 MHz.

FIG. 18 is an exemplary line graph illustrating 3D Max Gain in decibels isotropic (dBi) versus frequency in megahertz (MHz) measured for each port of the prototype of the antenna system 200. Generally, FIG. 18 shows that the antenna system 200 is operable with good 3D Max Gain for each port in frequency bands from about 2300 MHz to about 2700 MHz and from about 4900 MHz to about 6000 MHz.

FIG. 19 is an exemplary line graph illustrating Peak Gain in decibels isotropic (dBi) versus frequency in megahertz (MHz) measured for each port of the prototype of the antenna system 200. Generally, FIG. 19 shows that the antenna system 200 is operable with good Peak Gain for each port in frequency bands from about 2300 MHz to about 2700 MHz and from about 4900 MHz to about 6000 MHz.

FIG. 20 is an exemplary line graph illustrating efficiency (%) versus frequency in megahertz (MHz) measured for each port of the prototype of the antenna system 200. Generally, FIG. 20 shows that the antenna system 200 is operable with good efficiency for each port in frequency bands from about 2300 MHz to about 2700 MHz and from about 4900 MHz to about 6000 MHz.

FIG. 21 is an exemplary line graph illustrating half-power beamwidth (HPBW) at Phi=0° versus frequency in megahertz (MHz) measured for each port of the prototype of the antenna system 200. Generally, FIG. 21 shows that the antenna system 200 is operable with good half-power beamwidth at Phi=0° for each port in frequency bands from about 2300 MHz to about 2700 MHz and from about 4900 MHz to about 6000 MHz.

FIG. 22 is an exemplary line graph illustrating half-power beamwidth (HPBW) at Phi=90° versus frequency in megahertz (MHz) measured for each port of the prototype of the antenna system 200. Generally, FIG. 22 shows that the antenna system 200 is operable with good half-power beamwidth at Phi=90° for each port in frequency bands from about 2300 MHz to about 2700 MHz and from about 4900 MHz to about 6000 MHz.

FIG. 23 is an exemplary line graph illustrating ripple versus frequency in megahertz (MHz) measured for each port of the prototype of the antenna system 200. Generally, FIG. 23 shows that the antenna system 200 is operable with good ripple for each port in frequency bands from about 2300 MHz to about 2700 MHz and from about 4900 MHz to about 6000 MHz.

FIG. 24 illustrates another example embodiment of an antenna system or assembly 400 embodying one or more aspects of the present disclosure. The antenna system 400 may be similar to the antenna system 200 (FIG. 2) or antenna system 300 (FIG. 3). For example, the antenna system 400 may include four antennas 401 spaced part from each other in a rectangular configuration. Each antenna 401 may be fed by a separate feed cable 414 connected to the antenna's feed point. The antennas 401 may be coupled to a single common ground plane 404. Cable holders 424 have been directly, integrally formed (e.g., stamped, folded, bent, etc.) from the ground plane 404.

The antennas 401 have a different configuration than the antennas 101 and 301. For example, each antenna 401 includes an upper or top surface 403 extending between (e.g., integrally connected to, etc.) the feeds 402 of the antenna 401. The upper surface 403 includes a circular hole at about the center of the upper surface 403. Each antenna 401 also includes shorting elements or legs 408 for mechanical support and electrically coupling to the ground plane 404. The shorting legs 408 may allow the antennas 401 to be self-supporting on the ground plane 404. In addition to providing mechanical support, the shorting legs 408 may also provide DC (direct current) short for the antennas 401 to reduce or minimize of ESD (electrostatic discharge) effect. The shorting legs 408 may also allow for a reduction in the overall size of the antennas 401. With the tapering or gradual change in width, the antennas 401 may have a gradual change of impedance that allows the antenna 401 to achieve very wide bandwidth.

A radome 418 is positioned over the antenna system 400 and coupled to a base 440. A threaded portion 444 protrudes or extends outwardly from the base 440. The threaded portion 444 may be hollow. The feed cables 414 may pass through the hollow center of the threaded portion 444. The antenna system 400 may be mounted to a support surface (e.g., ceiling, etc.) by positioning the base 440 on one side of the support surface and positioning and threading a mounting nut onto the threaded portion 444 on the opposite side of the support surface.

The feeds 402 of the antennas 401 in the antenna system 400 (FIG. 4) are all oriented in a same direction. In other embodiments, one or more of the antennas 401 may be rotated to have an orientation different from another antenna 401.

FIG. 25 illustrates another example embodiment of an antenna 501 embodying one or more aspects of the present disclosure. The antenna 501 may be used in the antenna systems disclosed herein, e.g., antenna system 200 (FIG. 2), antenna system 300 (FIG. 3), antenna system 400 (FIG. 24). The antenna 501 includes an upper or top surface 503 extending between (e.g., integrally connected to, etc.) the feeds 502. The antenna 501 includes shorting elements or legs 508 for mechanical support and electrically coupling to a ground plane. The shorting legs 508 may allow the antenna 501 to be self-supporting on a ground plane. In addition to providing mechanical support, the shorting legs 508 may also provide DC (direct current) short for the antenna 501 to reduce or minimize of ESD (electrostatic discharge) effect. The shorting leg 508 may also allow for a reduction in the overall size of the antenna 501. With the tapering or gradual change in width, the antenna 501 may have a gradual change of impedance that allows the antenna 501 to achieve very wide bandwidth.

FIGS. 26 through 33 illustrates another example embodiment of an antenna system or assembly 600 embodying one or more aspects of the present disclosure. As shown in FIGS. 26-29, the antenna system 600 includes only two antennas 601 (e.g., radiating antenna elements or radiators, etc.) and a neutral line 660 (e.g., electrically-conductive wire, etc.) coupled to (e.g., soldered, etc.) to the antennas 601.

The neutral line 660 is configured (e.g., shaped, sized, etc.) to have a length to make the field of coupling out of phase to thereby cancel each other. The field of coupling may be mostly due to the mutual coupling that interacts between the first and second radiating elements or antennas 601. With the neutral line 660, at least some of the field of mutual coupling is out of phase and thereby cancels each other.

As shown in FIGS. 26 and 31, the neutral line 660 includes a middle portion 664 and first and second end portions or connecting portions 668, 672. The neutral line 660 also includes free ends or tips 669, 673 as shown in FIG. 31. In this example, the middle portion 664 is generally straight or linear. The first and second end portions or connecting portions 668 and 672 are also generally straight or linear. The first and second end portions or connecting portions 668, 672 connect and extend generally between the respective free end or tip 669, 673 and the middle straight portion 664. The first and second end portions or connecting portions 668 and 672 are configured (e.g., bent, folded, angled generally perpendicular to or non-parallel with, etc.) relative to the middle portion 664. The free ends or tips 669, 673 are configured (e.g., upturned, bent, folded, angled generally perpendicular to or non-parallel with, etc.) relative to the respective first and second end portions or connecting portions 668, 672. Accordingly, the neutral line 660 has a non-linear configuration such that its overall length is greater than the distance separating the locations at which neutral line 660 is electrically connected or coupled (e.g., soldered, etc.) to the first and second antennas 601. The length of the neutral line 660 is preferably predetermined or set so that the neutral line 660 will cause at least some of the field of mutual coupling between the first and second antennas 601 to be out of phase and thereby cancel each other.

By way of example only, the neutral line 660 may comprise copper wire. The ends of the copper wire may be respectively soldered to the first and second antennas 601 at about a center or midpoint of the corresponding feed 602 as shown in FIG. 26. As shown in FIGS. 28 and 30, the antennas 601 includes openings 674 (e.g., circular thru-holes, etc.) along the triangular feeds 602. The openings 674 are configured (e.g., sized, shaped, located, etc.) to receive the free ends or tips 669, 673 of the neutral line 660 as shown in FIG. 30. Alternatively, other conductors (e.g., stamped metal or other electrically-conductive part, etc.) besides copper wire and/or other connection methods besides soldering may be used in other embodiments. Also, the neutral line 660 may be electrically connected (e.g., soldered, etc.) to the feeds 602 at other locations besides the center or midpoint of the feeds 60. For example, the soldering location of the neutral line 660 to the feeds 602 may be adjusted depending to the length of the neutral line 660, the operating frequency, and/or the gap between the elements. Accordingly, the height location of the neutral line 660 may be predetermined (e.g., optimized, etc.) by the location at which the first and second ends of the neutral line 660 are electrically coupled (e.g., soldered, etc.) to the feeds 602 of the first and second radiating elements 601, respectively.

In this exemplary embodiment, the antenna system 600 includes a ground plane 604 having one or more decoupling stubs, flaps, tabs, or portions 676 as shown in FIGS. 26-29, 32, and 33. The decoupling stubs 676 extend outwardly relative to the ground plane 604. The decoupling stubs 676 may be integrally formed from the ground plane 604, e.g., stamped, bent, folded, etc. The decoupling stubs 676 are configured (e.g., shaped, sized, located, etc.) to further improve isolation. One or more slots or openings 680 are formed or created in the ground plane 604 when the decoupling stubs 676 are integrally formed from the ground plane 604. The slots 680 may also help improve isolation.

By way of example, the decoupling stubs 676 may be rectangular and extend or slant upwardly at an acute angle (e.g., about 60 degrees, etc.) relative to the ground plane 604. Alternatively, the decoupling stubs 676 may be configured differently, e.g., with a different or non-rectangular shape, slant at an angle greater or less than 60 degrees, etc.

The ground plane 604 may be circular and have a diameter of about 110 millimeters. The first and second antennas 601 may be spaced apart by about 14 mm from each other. Alternatively, the antenna system 600 may include a differently configured ground plane (e.g., larger, smaller, non-circular, etc.) and/or the antennas 601 may be spaced apart by more or less than 14 mm. Additionally, or alternatively, the antenna system may include more than two antennas in other exemplary embodiments. For example, the neutral line 660 and/or decoupling stubs 676 may be added to any of the antenna systems disclosed herein, such as the antenna system 100, 200, 300, and/or 400 that include four antennas, etc.

As shown in FIGS. 26 and 30, each antenna 601 includes first and second feeds 602. A feed point 606 is between and connected to the feeds 602. The feeds 602 are generally triangular and/or tapering such that a width of each feed 602 reduces or tapers in a direction towards the feed point 606. Accordingly, each feed 602 is narrowest at or adjacent the feed point 606. With the tapering or gradual change in width, the antenna 601 may have a gradual change of impedance that allows the antenna 601 to achieve very wide bandwidth.

Each antenna 601 includes first and second shorting legs or elements 608 for mechanical support and for electrically coupling (e.g., via direct galvanic contact, soldering, etc.) the antenna 601 to the ground plane 604. In addition to providing mechanical support, the shorting legs 608 may also provide DC (direct current) short for the antenna 601 to reduce or minimize of ESD (electrostatic discharge) effect. The shorting legs 608 may also allow for a reduction in the overall size of the antenna 601.

The first and second shorting legs 608 depend or extend from (e.g., are integrally connected to, etc.) the first and second feeds 602, respectively (e.g., at about a middle top portion of the feed 602, etc.) to thereby electrically couple the feeds 602 to the ground plane 604. In this example, the shorting legs or elements 608 are soldered 609 to the ground plane 604 as shown in FIG. 26.

As shown in FIG. 30, the shorting leg 608 includes an end portion 611 (e.g., enlarged mounting foot, etc.) configured (e.g., sized, shaped, located, etc.) to be positioned (e.g., slot mounted, etc.) at least partially within an opening (e.g., slot, etc.) defined between upwardly protruding portions or opposing tabs 613, 615 (FIGS. 29 and 33) of (e.g., integrally formed from, etc.) the ground plane 604 and base 640, respectively. The end portion 611 of the shorting leg 608 includes a middle portion or member 617 spaced apart from and between two outer portions or members 619. The middle portion 617 is configured to be positioned at least partially within the opening 621 (FIG. 32) in the ground plane 604 defined by the absence of ground plane material used to create the tab 613. As shown in FIG. 29, the outer portions 619 of the shorting leg 608 are configured to be position on (e.g., abut against, galvanically contact, etc.) the upper surface of the ground plane 604.

The first and second feeds 602 of each antenna 601 generally oppose and/or are opposite each other. Each antenna 601 includes first and second opposing openings or open sides (or non-existent sides) adjacent and defined between the first and second feeds 602. The feeds 602 define the two open sides such that the two open sides also have triangular and/or tapering shapes substantially identical to or similar to the shapes of the feeds 602. Accordingly, the feeds 602 define or provide the antenna 601 with a shape resembling a partial (e.g., interrupted, etc.) rectangular pyramid or cone shape. The antenna 601 includes two solid sides defined by the first and second feeds 602 and two open or nonexistent sides. By way of example, the first and second feeds 602 may resemble or be shaped like butterfly wings as shown in FIG. 26. Or, for example, the feeds 602 may define a V-shaped channel that is open on both ends.

The antenna 601 may mimic or simulate an inverted cone without having a full cone shape (due to the two sides that are open or missing). This may allow the antenna 601 to simulate an inverted cone antenna in its radiation pattern, frequency, etc., while having a simpler construction.

The antenna 601 may be stamped from a suitable material (e.g., metal, other electrically-conductive material, etc.) in a defined shape, and then folded to form the opposing triangular tapering feeds 602. For example, an antenna may be stamped from a substantially flat sheet (e.g., sheet metal, etc.) with points of triangular tapering feeds 602 separated by a small strip, joint, feed point, etc. The triangular tapering feeds 602 can then be folded upwards to a desired angle (e.g., non-perpendicular with a ground plane, non-parallel with each other, etc.). This may allow for a simpler construction as compared to other inverted cone antennas that may require welding of different components, drawing of the antenna structure, etc. Accordingly, some embodiments of the present disclosure may not require any welding or drawing to form the antennas 601

Each triangular tapering feed 602 may include slanted opposing edge portions 610, such that the width of the tapering feed 602 is narrowest at an end of the feed 602 adjacent the feed point 606 and widest at an end of the tapering feed 602 farthest from the feed point 606. The tapering of the side edge portions 610 may be slanted or angled inwardly toward the middle. Stated differently, the side edge portions 610 of the feeds 602 are slanted or angled inwardly toward each other along these edge portions 610 in a direction from a top of the feeds 602 toward the ground plane 604. Accordingly, the upper portion of each feed 602 decreases in width due to the tapering features or inwardly angled upper side edge portions 610. The tapering may be an inward slant at any suitable angle, which may be more or less than the angle illustrated in FIGS. 26 and 30. As used herein, triangular includes a tapering feed having three different sides. Although FIGS. 26 and 30 illustrate triangular tapering feeds 602 having a specific shape, other embodiments may include tapering feeds having different shapes (e.g., different angles between sides, different lengths of sides, etc.).

Each triangular tapering feed 602 may include a wing portion 612, which may be disposed at a top of the triangular tapering feed 602. The wing portion 612 may be an extension of the triangular tapering feed 602 that is bent or folded to form an angle (e.g., right angle, etc.) with the triangular tapering feed 602. Accordingly, the wing portion 612 may be integral or have a monolithic one-piece construction with the triangular tapering feed 602.

Each triangular tapering feed 602 may be electrically coupled to the ground plane 604 via a corresponding one of the shorting elements 608. The shorting element 608 may be configured to provide mechanical support to the antenna 601. For example, each triangular tapering feed 602 may not be sufficiently supported at the proper angle with respect to the ground plane 604 in the absence of the shorting element 608. Without sufficient mechanical support, the triangular tapering feed 602 may bend back towards the ground plane 604 due to gravity, shock to the antenna 601 during shipping or installation, etc., which may change the performance of the antenna 601. The shorting element 608 may provide support to inhibit the triangular tapering feed 602 from moving over time. The shorting element 608 may help reduce or miniaturize the antenna size while not significantly affecting the omnidirectionality of the antenna.

The shorting element 608 may be an extension of the triangular tapering feed 602. As shown in FIG. 26, the shorting element 608 is a strip extending from a center top portion of the triangular tapering feed 602. In other embodiments, the shorting element 608 may have a different shape, extend from a different portion of the tapering feed 602, etc. The shorting element 608 may be integral with the tapering feed 602. Accordingly, the shorting element 608 may be defined at the same time the triangular tapering feeds 602 are stamped, resulting in easier construction. The shorting element 608 may then be bent during assembly of the antenna 601 (e.g., the shorting element 608 could be bent after the tapering feeds 602 are bent, before the tapering feeds 602 are bent, etc.).

The antenna 601 may be coupled to a feed signal at the feed point 606. For example, a feed cable 614 may be coupled to the feed point 606 to provide a feed signal to the feed point 606 of the radiating element. Any suitable feed cable 614 may be used (e.g., a plenum cable with a Sub-Miniature version A (SMA)-Male connector, an approximately 36 inch exposed cable, etc.). By way of example, the feed cable 614 may comprise a coaxial cable having an inner conductor 616 (FIG. 28) soldered (FIG. 26) to the feed point 606. The feed point 606 may be located between (e.g., integrally connected to, etc.) the two opposing triangular tapering feeds 602. The feed cable 614 may thus provide a similar radiating feed signal to each triangular tapering feed 602 via the feed point 606. In other embodiments, other suitable feed techniques may be used.

The ground plane 604 may include an integrally formed (e.g., stamped, bent, folded, etc.) feature for soldering a cable braid. For example, the ground plane 604 may have stamped features to enable the cable braid to be soldered to the ground plane 604 relatively easily and cost effectively without any additional parts while also allowing the cable braid to be consistently soldered to the ground plane 604 at the correct location. This feature may also provide minimum (or at least reduced) direct galvanic contact surface (e.g., when necessary when the antenna is produced for low PIM (Passive Intermodulation) specification, etc.) between the cable braid and the ground plane 604 as only the cross section of the integrally formed feature contacts the ground plane 604. Advantageously, this may help to prevent (or at least reduce) any inconsistency in the contact between the cable braid and the ground plane.

Each antenna 601 of the antenna system 600 may be fed by a separate feed cable 614 connected to the antenna's feed point. Accordingly, the antenna system 600 may thus be a multiple-input multiple-output (MIMO) antenna system. Cable holders 624 may be integrally formed (e.g., stamped, folded, bent, etc.) from the ground plane 604.

A radome 618 (FIG. 27) may be positioned over the antenna system 600 and coupled (e.g., mechanically fastened, etc.) to a base 640. The radome 618 may be any suitable radome for housing components of the antenna system 600. The radome may provide protection to the antenna system components from weather, debris, physical contact during transportation and/or use, etc.

The base 640 may include one or more upwardly protruding portions or supports 682 (FIGS. 28, 29, and 33) to provide mechanical support to the decoupling stubs 676. For example, the decoupling stubs 676 may not be sufficiently supported at the proper angle with respect to the ground plane 604 in the absence of the supports 682 of the base 640. Without sufficient mechanical support, the decoupling stubs 676 may bend back towards the ground plane 604 due to gravity, shock to the antenna system 600 during shipping or installation, etc., which may change the performance of the antenna system 600. The supports 682 may provide support to inhibit the decoupling stubs 676 from moving downward over time.

The base 640 may also include one or more upwardly protruding portions 684 (FIG. 33) to help with alignment of the antennas 601 and ground plane 604 relative to the base 640. As shown in FIG. 33, the base's upwardly protruding portions 684 are configured (e.g., shaped, sized, located, etc.) to be positioned within openings 686 (FIG. 32) of the ground plane 604 to thereby align and couple the ground plane 604 with the base 640. The base's upwardly protruding portions 684 include top portions 688 (e.g., circular pins or members, etc.) configured to be positioned within openings 690 (e.g., circular thru-holes shown in FIG. 30, etc.) along the feeds 606 of the antennas 601 as shown in FIGS. 28 and 29.

A threaded portion 644 (FIG. 28) may protrude or extend outwardly from the base 640. The threaded portion 644 may be hollow. The feed cables 414 may pass through the hollow center of the threaded portion 644. The antenna system 600 may be mounted to a support surface (e.g., ceiling, etc.) by positioning the base 640 on one side of the support surface and positioning and threading a mounting nut 646 (FIG. 27) onto the threaded portion 644 on the opposite side of the support surface.

The feeds 602 of the first and second antennas 601 in the antenna system 600 (FIG. 26) are oriented in a same direction, parallel, and aligned with each other. In other embodiments, one of the antennas 601 may be rotated (e.g., 90 degrees, etc.) to have a different orientation than the other antenna 601, e.g., a feed 602 non-parallel and/or non-aligned with the feed 602 of the other antenna 601, etc.

FIGS. 34 through 39 provide analysis results for the antenna system 600 shown in FIG. 26. These analysis results shown in FIGS. 34-39 are provided only for purposes of illustration and not for purposes of limitation.

More specifically, FIGS. 34 and 35 are exemplary line graphs illustrating voltage standing wave ratio (VSWR) versus frequency measured for the two ports S11, S22, respectively, of the exemplary antenna system 600 shown in FIG. 26. Generally, FIGS. 34 and 35 show that the antenna system 600 is operable with a good standing wave ratio (e.g., less than 2, etc.) for the two ports of the antennas 601 to which the neutral line 660 is coupled (e.g., soldered, etc.) in a frequency band from about 1.69 GHz to about 2.7 GHz. For example, FIG. 34 shows that the first port had a VSWR (S11) of 1.773 at 1.69 GHz, 1.1847 at 2.34 GHz, and 1.4519 at 2.7 GHz. FIG. 35 shows that the second port had a VSWR (S22) of 1.4151 at 1.69 GHz, 1.4638 at 2.34 GHz, and 1.5115 at 2.7 GHz.

FIG. 36 is an exemplary line graph illustrating port to port isolation (S21) in decibels (dB) versus frequency (MHz) measured for the exemplary antenna system 600 shown in FIG. 26. Generally, FIG. 36 shows that the antenna system 600 is operable with good port to port isolation in frequency band from about 1690 MHz to about 2700 MHz. For example, FIG. 36 shows that the antenna system 600 had a port to port isolation (S21) of −21.159 dB at 1.69 GHz, −15.199 dB at 2.34 GHz, and −17.335 dB at 2.7 GHz.

FIGS. 37 through 39 illustrate radiation patterns (Azimuth Plane, Phi 0° Plane, Phi 90° Plane) measured for Port 1 and Port 2 of the exemplary antenna system 600 shown in FIG. 26 at frequencies of 1690 MHz, 1710, MHz, 1850 MHz, 1990 MHz, 2510 MHz, and 2700 MHz. Generally, FIGS. 37 through 39 show that the antenna system 600 has good omnidirectional radiation patterns at these frequencies within the frequency band from about 1.69 GHz to about 2.7 GHz.

In an exemplary embodiment, an antenna generally includes at least two feeds that are triangular, step-shaped, and/or tapering and at least one open side defined between the at least two feeds. A feed point is between and/or connected to the opposing feeds. The antenna also includes shorting legs for mechanical support and electrically coupling to a ground plane. The at least two feeds may comprise a first triangular tapering feed and a second triangular tapering feed generally opposing the first triangular tapering feed. The first triangular tapering feed may comprise first and second slanted edge portions such that a width of the first triangular tapering feed tapers in a direction towards the feed point whereby the width of the first triangular tapering feed is narrowest at or adjacent the feed point. The second triangular tapering feed may comprise third and fourth slanted edge portions such that a width of the second triangular tapering feed tapers in a direction towards the feed point whereby the width of the second triangular tapering feed is narrowest at or adjacent the feed point. The at least one open side may comprise a first open side defined between the first and third slanted edge portions, and a second open side defined between the second and fourth slanted edge portions. The shorting legs may comprise a first shorting leg for mechanically supporting and electrically coupling the first triangular tapering feed to a ground plane, a second shorting leg for mechanically supporting and electrically coupling the second triangular tapering feed to a ground plane. The first and second shorting legs may allow the antenna to be self-supporting on the ground plane. The antenna may have a partial rectangular pyramid or cone shape defined by the first and second triangular tapering feeds and the first and second open sides. The antenna may have a single piece monolithic construction in which the first and second triangular tapering feeds, the feed point, and the first and second shorting legs are all integrally or monolithically formed from the same single piece of electrically-conductive material. The opposing feeds may be non-perpendicular to the feed point. The opposing feeds may be non-parallel with each other. The antenna may be operable with a radiation pattern simulating a radiation pattern of an inverted full cone antenna radiation with an omnidirectional polarization. The antenna may be operable within at least a first frequency range from about 2300 megahertz to about 2700 megahertz and a second frequency range from about 4900 megahertz to about 5875 megahertz. An antenna system may comprise at least four antennas spaced apart from one another in a rectangular configuration, whereby the antenna system is omnidirectional, multiple-input multiple-output (MIMO), multiband, and broadband.

In an exemplary embodiment, an antenna system includes at least one ground plane and at least one antenna. The at least one antenna includes first and second triangular tapering feeds. First and second open sides are defined between the first and second triangular tapering feeds. A feed point is between and/or connected to the first and second triangular tapering feeds. The at least one antenna also includes first and second shorting legs mechanical supporting and electrically coupling the respective first and second triangular feeds to the at least one ground plane. The at least one antenna may comprise at least four antennas spaced apart from one another in a rectangular configuration and/or symmetrical configuration. The at least one ground plane may comprise a common ground plane, and the at least four antennas may be mechanically supported on and electrically coupled to the same common ground plane. Or, the at least one ground plane may include at least four separate ground plane portions, and each of the at least four antennas may be mechanically supported on and electrically coupled to a different one of the at least four separate ground plane portions.

In an exemplary embodiment, a method generally includes stamping a single piece of electrically-conductive material. The method also includes folding the stamped single piece of electrically-conductive material to form an antenna having two triangular tapering feeds opposing one another, a feed point between the two triangular tapering feeds, open sides defined between the two triangular tapering feeds, and shorting legs for mechanical supporting and electrically coupling the two triangular tapering feeds to at least one ground plane. The method may not require any welding or drawing of the electrically-conductive material. The antenna may have a partial rectangular pyramid or cone shape defined by the two triangular tapering feeds and the open sides defined between the two triangular tapering feeds.

In an exemplary embodiment, an antenna system generally includes a ground plane and first and second antennas each including a first feed. The antenna system further comprises a neutral line having first and second end portions coupled to the first feed of the respective first and second antennas; and/or one or more decoupling stubs integrally formed from and extending outwardly relative to the ground plane.

The neutral line may be configured to be operable for improving isolation between the first and second antennas with a minimal or reduced impact on a radiation pattern of the antenna system. The neutral line may extend horizontally between the first feed of the first antenna and the first feed of the second antenna. The neutral line may have a length such that the field of coupling is out of phase thereby cancelling each other. The neutral line may comprise electrically-conductive wire, such as copper wire, etc. The first and second end portions of the neutral line may be soldered to the first feed of the respective first and second antennas at about a midpoint or center of the first feed. The neutral line may comprise a middle straight portion between the first and second end portions. The first and second end portions may be straight and perpendicular to the middle straight portion.

The one or more decoupling stubs may be configured to be operable for improving isolation between the first and second antennas. The one or more decoupling stubs may be stamped from the ground plane and folded relative to the ground plane such that the one or more decoupling stubs are at an acute angle relative to the ground plane. The one or more decoupling stubs may comprise first and second decoupling stubs integrally formed from the ground plane at locations generally between the first and second antennas. The ground plane may include one or more slots defined by an absence of material used to create the one or more decoupling stubs. The one or more slots may be operable for improving isolation between the first and second antennas.

Each of the first and second antennas may include a second feed, a feed point between and/or connected to the first and second feeds, first and second shorting legs mechanical supporting and electrically coupling the respective first and second feeds to the ground plane, and first and second open sides defined between the first and second feeds. For each of the first and second antennas, the first and second feeds may respectively comprise first and second triangular tapering feeds. The second triangular tapering feed may generally opposes the first triangular tapering feed. The first triangular tapering feed may comprise first and second slanted edge portions such that a width of the first triangular tapering feed tapers in a direction towards the feed point whereby the width of the first triangular tapering feed is narrowest at or adjacent the feed point. The second triangular tapering feed may comprise third and fourth slanted edge portions such that a width of the second triangular tapering feed tapers in a direction towards the feed point whereby the width of the second triangular tapering feed is narrowest at or adjacent the feed point. The first open side may be defined between the first and third slanted edge portions. The second open side may be defined between the second and fourth slanted edge portions. The first and second shorting legs allow the antenna to be self-supporting on the ground plane.

The first and second antennas may have a partial rectangular pyramid or cone shape defined by the first and second triangular tapering feeds and the first and second open sides. Each of the first and second antennas may have a single piece monolithic construction in which the first and second feeds, the feed point, and the first and second shorting legs are all integrally or monolithically formed from the same single piece of electrically-conductive material.

The antenna system may be configured to be operable from about 1690 megahertz to about 2700 megahertz. The antenna system may be omnidirectional, multiple-input multiple-output (MIMO), multiband, and broadband.

In another exemplary embodiment, a method of improving isolation between first and second antennas of an antenna system generally includes coupling first and second end portions of a neutral line to a first feed of the respective first and second antennas; and/or integrally forming one or more decoupling stubs from a ground plane.

The method may include soldering the first and second end portions of the neutral line to the first feed of the respective first and second antennas; and/or stamping a portion of the ground plane and folding the stamped portion relative to the ground plane to thereby form the one or more decoupling stubs at an acute angle relative to the ground plane.

The neutral line may comprise electrically-conductive wire having the first and second end portions. The method may include soldering the first and second end portions of the electrically-conductive wire to the first feed of the respective first and second antennas at about a midpoint or center of the first feed.

The neutral line may extend horizontally between the first feed of the first antenna and the first feed of the second antenna. The neutral line may have a length such that the field of coupling is out of phase thereby cancelling each other. The neutral line may be configured to be operable for improving isolation between the first and second antennas with a minimal or reduced impact on a radiation pattern of the antenna system. The neutral line may comprise a middle straight portion between the first and second end portions. The first and second end portions may be straight and perpendicular to the middle straight portion.

The method may include integrally forming first and second decoupling stubs from the ground plane at locations generally between the first and second antennas, whereby the first and second decoupling stubs are configured to be operable for improving isolation between the first and second antennas. The method may include stamping a portion of the ground plane and folding the stamped portion relative to the ground plane to thereby form the first and second decoupling stubs. The ground plane may include first and second slots defined by an absence of the stamped and folded material used to create the first and second decoupling stubs.

Each of the first and second antennas may include a second feed, a feed point between and/or connected to the first and second feeds, first and second shorting legs mechanical supporting and electrically coupling the respective first and second feeds to the ground plane, and first and second open sides defined between the first and second feeds. For each of the first and second antennas, the first and second feeds may respectively comprise first and second triangular tapering feeds. The second triangular tapering feed may generally oppose the first triangular tapering feed. The first triangular tapering feed may comprise first and second slanted edge portions such that a width of the first triangular tapering feed tapers in a direction towards the feed point whereby the width of the first triangular tapering feed is narrowest at or adjacent the feed point. The second triangular tapering feed may comprise third and fourth slanted edge portions such that a width of the second triangular tapering feed tapers in a direction towards the feed point whereby the width of the second triangular tapering feed is narrowest at or adjacent the feed point. The first open side may be defined between the first and third slanted edge portions. The second open side may be defined between the second and fourth slanted edge portions. The first and second shorting legs may allow the antenna to be self-supporting on the ground plane.

The antenna systems disclosed herein including the antennas, the ground planes, feeding elements, the shorting elements, etc., may be any suitable size (e.g., height, diameter, etc.). The size of each component of an antenna system may be determined based on particular specifications, desired results, etc. For example, the height of the feeding elements disclosed herein may be determined so that an impedance match in the high band may be substantially achieved.

Exemplary embodiments of the antenna systems disclosed herein may be suitable for a wide range of applications, e.g., that use more than one antenna, such as LTE/4G applications and/or infrastructure antenna systems (e.g., customer premises equipment (CPE), terminal stations, central stations, in-building antenna systems, etc.). An antenna system disclosed herein may be configured for use as an omnidirectional MIMO antenna, although aspects of the present disclosure are not limited solely to omnidirectional and/or MIMO antennas. An antenna system disclosed herein may be implemented inside an electronic device, such as machine to machine, vehicular, in-building unit, etc. In which case, the internal antenna components would typically be internal to and covered by the electronic device housing. As another example, the antenna system may instead be housed within a radome, which may have a low profile. In this latter case, the internal antenna components would be housed within and covered by the radome. Accordingly, the antenna systems disclosed herein should not be limited to any one particular end use.

Some example embodiments disclosed herein may provide one or more (or none) of the following advantages: a low profile, a broad or wide bandwidth, sufficient isolation between ports, a simple construction involving stamping using simple stamping tools, a single stamped part for the whole antenna or radiator that does not require any mechanically fastened or welded joints, no requirement of any welding of parts for the antenna or radiator, shorting legs that provide sufficient mechanical support to the antenna or radiator, providing a soldering side which enables easier routing of cable for a MIMO antenna system, reduced cost, etc. In some exemplary embodiments, the antenna system may include a neutral line placed horizontally or in horizon to improve isolation and minimize (or at least reduce)

impact to the radiation pattern and a slanted decoupling stub (e.g., stamped, integrally formed, etc.) from the ground to improve isolation. In such exemplary embodiments, the addition of the neutral line and slanted decoupling stub from the ground may improve isolation where a conventional split ground plane or rotating radiators may not be sufficient to meet the isolation specification of the antenna in a very compact radome. This improved isolation may be achievable with minimal impact to the radiation pattern.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purpose of illustration only and do not limit the scope of the present disclosure, as exemplary embodiments disclosed herein may provide all or none of the above mentioned advantages and improvements and still fall within the scope of the present disclosure.

Specific numerical dimensions and values, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally", "about", and "substantially" may be used herein to mean within manufacturing tolerances.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An antenna system comprising a ground plane and first and second antennas each including a first feed, wherein the antenna system further comprises:

a neutral line having first and second end portions coupled to the first feed of the respective first and second antennas; and one or more decoupling stubs integrally formed from and extending outwardly and upwardly at an angle relative to the ground plane;

wherein the ground plane includes one or more slots defined by an absence of ground plane material that integrally forms the one or more decoupling stubs, whereby the one or more slots are operable for improving isolation between the first and second antennas.

2. The antenna system of claim 1, wherein the neutral line is configured to be operable for improving isolation between the first and second antennas with a minimal or reduced impact on a radiation pattern of the antenna system.

3. The antenna system of claim 1, wherein the neutral line extends horizontally between the first feed of the first antenna and the first feed of the second antenna.

4. The antenna system of claim 1, wherein the neutral line has a length such that at least some of a field of mutual coupling between the first and second antennas is out of phase and cancels each other.

5. The antenna system of claim 1, wherein the neutral line comprises electrically-conductive wire.

6. The antenna system of claim 1, wherein the first and second end portions of the neutral line are soldered to the first feed of the respective first and second antennas at about a midpoint or center of the first feed.

7. The antenna system of claim 1, wherein the neutral line comprises a middle straight portion between the first and second end portions, and wherein the first and second end portions are straight and perpendicular to the middle straight portion.

8. The antenna system of claim 1, wherein the one or more decoupling stubs are configured to be operable for improving isolation between the first and second antennas.

9. An antenna system comprising a ground plane and first and second antennas each including a first feed, wherein the antenna system further comprises:

a neutral line having first and second end portions coupled to the first feed of the respective first and second antennas; and one or more decoupling stubs integrally formed from and extending outwardly relative to the ground plane;

wherein the antenna system includes the one or more decoupling stubs that are stamped from the ground plane and folded relative to the ground plane such that the one or more decoupling stubs are at an acute angle relative to the ground plane.

10. The antenna system of claim 1, wherein the one or more decoupling stubs comprise first and second decoupling stubs integrally formed from the ground plane at locations generally between the first and second antennas.

11. The antenna system of claim 9, wherein the ground plane includes one or more slots defined by an absence of ground plane material that integrally forms the one or more decoupling stubs, whereby the one or more slots are operable for improving isolation between the first and second antennas.

12. The antenna system of claim 1, wherein each of the first and second antennas includes:

a second feed;

a feed point between and connected to the first and second feeds;

first and second shorting legs mechanical supporting and electrically coupling the respective first and second feeds to the ground plane; and first and second open sides defined between the first and second feeds.

13. An antenna system comprising a ground plane and first and second antennas each including a first feed, wherein the antenna system further comprises:

a neutral line having first and second end portions coupled to the first feed of the respective first and second antennas; and one or more decoupling stubs integrally formed from and extending outwardly relative to the ground plane;

wherein each of the first and second antennas includes:

a second feed;

a feed point between and connected to the first and second feeds;

first and second shorting legs mechanical supporting and electrically coupling the respective first and second feeds to the ground plane; and first and second open sides defined between the first and second feeds; and wherein each of the first and second antennas has a single piece monolithic construction in which the first and second feeds, the feed point, and the first and second shorting legs are all integrally or monolithically formed from the same single piece of electrically-conductive material; and wherein for each of the first and second antennas:

the first and second feeds respectively comprise first and second triangular tapering feeds;

the second triangular tapering feed generally opposes the first triangular tapering feed;

the first triangular tapering feed comprises first and second slanted edge portions such that a width of the first triangular tapering feed tapers in a direction towards the feed point whereby the width of the first triangular tapering feed is narrowest at or adjacent the feed point;

the second triangular tapering feed comprises third and fourth slanted edge portions such that a width of the second triangular tapering feed tapers in a direction towards the feed point whereby the width of the second triangular tapering feed is narrowest at or adjacent the feed point;

the first open side is defined between the first and third slanted edge portions; and the second open side is defined between the second and fourth slanted edge portions;

whereby the first and second shorting legs allow the antenna to be self-supporting on the ground plane.

14. The antenna system of claim 1, wherein:

the antenna system is configured to be operable from about 1690 megahertz to about 2700 megahertz; and the antenna system is omnidirectional, multiple-input multiple-output (MIMO), multiband, and broadband.

15. A method of improving isolation between first and second antennas of an antenna system including a ground plane, the method comprising:

coupling first and second end portions of a neutral line to a first feed of the respective first and second antennas; and integrally forming one or more decoupling stubs from the ground plane that comprises stamping a portion of the ground plane and folding the stamped portion relative to the ground plane to thereby form one or more decoupling stubs at locations generally between the first and second antennas, whereby the ground plane includes one or more slots defined by an absence of the stamped and folded material used to create the one or more decoupling stubs.

16. The method of claim 15, wherein the method includes stamping the portion of the ground plane and folding the stamped portion relative to the ground plane to thereby form the one or more decoupling stubs at an acute angle relative to the ground plane.

17. The method of claim 15, wherein:

the neutral line comprises electrically-conductive wire having the first and second end portions; and the method includes soldering the first and second end portions of the electrically-conductive wire to the first feed of the respective first and second antennas at about a midpoint or center of the first feed.

18. The method of claim 15, wherein the method includes integrally forming first and second decoupling stubs that comprises stamping portions of the ground plane and folding the stamped portions relative to the ground plane to thereby form the first and second decoupling stubs at locations generally between the first and second antennas, whereby the ground plane includes first and second slots defined by an absence of the stamped and folded material used to create the first and second decoupling stubs.

19. The antenna system of claim 1, wherein the one or more decoupling stubs are not co-planar with the ground plane and slant upwardly at an acute angle relative to the ground plane.

20. An antenna system comprising a ground plane and first and second antennas each including a first feed, wherein the antenna system further comprises:

a neutral line having first and second end portions coupled to the first feed of the respective first and second antennas; and one or more decoupling stubs integrally formed from and extending outwardly relative to the ground plane;

wherein:

the neutral line extends horizontally between the first feed of the first antenna and the first feed of the second antenna;

the first and second end portions of the neutral line are coupled to the first feed of the respective first and second antennas at about a midpoint or center of the first feed;

the neutral line that comprises a middle straight portion between the first and second end portions, and wherein the first and second end portions are straight and perpendicular to the middle straight portion; and the one or more decoupling stubs comprise first and second decoupling stubs stamped from the ground plane and folded relative to the ground plane such that the first and second decoupling stubs are at locations generally between the first and second antennas and are at an acute angle relative to the ground plane and the ground plane.

* * * * *